US011604030B2

(12) United States Patent
Singh et al.

(10) Patent No.: US 11,604,030 B2
(45) Date of Patent: Mar. 14, 2023

(54) AIR-COOLED CONDENSER SYSTEM

(71) Applicant: Holtec International, Camden, NJ (US)

(72) Inventors: Krishna P. Singh, Jupiter, FL (US); Vytautas Vincas Maciunas, Cherry Hill, NJ (US); Raghavendra Palle, Camden, NJ (US)

(73) Assignee: Holtec International

( * ) Notice: Subject to any disclaimer, the term of this patent is extended or adjusted under 35 U.S.C. 154(b) by 322 days.

(21) Appl. No.: 16/906,382

(22) Filed: Jun. 19, 2020

(65) Prior Publication Data

US 2020/0318909 A1 Oct. 8, 2020

Related U.S. Application Data

(63) Continuation-in-part of application No. 16/142,246, filed on Sep. 26, 2018, now Pat. No. 11,204,201.
(Continued)

(51) Int. Cl.
*F28B 1/06* (2006.01)
*F28B 9/00* (2006.01)
(Continued)

(52) U.S. Cl.
CPC ..... *F28B 1/06* (2013.01); *F28B 9/00* (2013.01); *F28B 9/02* (2013.01); *F28D 1/05366* (2013.01);
(Continued)

(58) Field of Classification Search
CPC . F28B 1/06; F28B 1/08; F28F 2265/06; F28F 9/007; F28F 19/02; F28F 2280/00;
(Continued)

(56) References Cited

U.S. PATENT DOCUMENTS 3,447,598 A * 6/1969 Kaess, Jr. ..... F28F 9/013 165/122
3,716,097 A * 2/1973 Kelp ..... F28B 1/06 165/111
(Continued)

FOREIGN PATENT DOCUMENTS

CA 2081695 9/1993
DE 102006029773 7/2007
(Continued)

OTHER PUBLICATIONS

International Search Report and Written Opinion issued in PCT/US2018/052813, dated Dec. 12, 2018, pp. 1-13.
(Continued)

*Primary Examiner* — Jianying C Atkisson
*Assistant Examiner* — For K Ling
(74) *Attorney, Agent, or Firm* — The Belles Group, P.C.

(57) ABSTRACT

An air-cooled condenser system for steam condensing applications in a power plant Rankine cycle includes an air cooled condenser having a plurality of interconnected modular cooling cells. Each cell comprises a frame-supported fan, inlet steam headers, outlet condensate headers, and tube bundle assemblies having extending between the headers. The tube bundle assemblies may be arranged in a V-shaped tube structure. A plurality of deflection limiter beams are arranged coplanar with the tube bundles. Top ends of each deflection limiter beam are slideably inserted in an associated floating end cap affixed to an upper tubesheet which moves vertically relative to the beams via thermal expansion/contraction concomitantly with the tubes. The deflection limiter beams provides guided restraint system for expansion/contraction of the tube bundles which prevents out of plane tube bowing.

21 Claims, 44 Drawing Sheets

Related U.S. Application Data

(60) Provisional application No. 62/863,360, filed on Jun. 19, 2019, provisional application No. 62/564,000, filed on Sep. 27, 2017.

(51) Int. Cl.
*F28B 9/02* (2006.01)
*F28D 1/053* (2006.01)

(52) U.S. Cl.
CPC ..... *F28F 2265/26* (2013.01); *F28F 2280/00* (2013.01)

(58) Field of Classification Search
CPC ... F28F 2280/105; F28F 2280/10; F16L 3/18; F16L 3/26; F16L 3/01; F16L 3/237; F16L 3/20; F25B 39/04; F28D 1/05366; F28D 1/05358; F28D 1/024; F28D 1/05308; F28D 1/0426; F28D 1/0443; F28D 2021/0063
See application file for complete search history.

(56) References Cited

U.S. PATENT DOCUMENTS

| | | | | |
|---|---|---|---|---|
| 5,490,559 | A * | 2/1996 | Dinulescu | F28D 1/05366 165/165 |
| 6,474,272 | B2 * | 11/2002 | Bensing | B01D 5/0012 165/110 |
| 6,691,742 | B1 * | 2/2004 | Cooper | F16L 3/14 248/62 |
| 8,297,561 | B1 | 10/2012 | Montplaisir et al. | |
| 9,786,395 | B2 | 10/2017 | Singh et al. | |
| 9,951,994 | B2 | 4/2018 | Vouche et al. | |
| 10,024,600 | B2 | 7/2018 | Bugler et al. | |
| 2002/0005176 | A1 | 1/2002 | Bensing et al. | |
| 2009/0178279 | A1 * | 7/2009 | Schabosky | F28F 9/002 29/890.07 |
| 2009/0220334 | A1 | 9/2009 | Vouche | |
| 2010/0078147 | A1 | 4/2010 | Samyn et al. | |
| 2013/0146274 | A1 * | 6/2013 | Sugimoto | H05K 7/20572 165/96 |
| 2013/0263840 | A1 | 11/2013 | Eindhoven | |
| 2013/0292103 | A1 * | 11/2013 | Eindhoven | F28F 9/02 29/890.038 |
| 2014/0367243 | A1 | 12/2014 | Kroger et al. | |
| 2015/0345166 | A1 | 12/2015 | Quickelber-Ghe et al. | |
| 2017/0051981 | A1 | 2/2017 | Singh et al. | |
| 2017/0130872 | A1 * | 5/2017 | Drummond | F16L 3/02 |
| 2018/0100700 | A1 | 4/2018 | Beaver et al. | |
| 2019/0093953 | A1 | 3/2019 | Singh et al. | |
| 2019/0242660 | A1 | 8/2019 | Badin et al. | |

FOREIGN PATENT DOCUMENTS

| | | | | |
|---|---|---|---|---|
| DE | 102014112707 | | 9/2014 | |
| DE | 102014112707 | | 3/2016 | |
| DE | 102014112707 | A1 * | 3/2016 | B01D 5/0012 |
| GB | 958481 | * | 5/1964 | F28B 1/06 |
| JP | 61082035 | | 4/1986 | |
| JP | 10170030 | A * | 6/1998 | F28B 1/06 |
| WO | WO2017/202730 | A1 | 11/2017 | |

OTHER PUBLICATIONS

International Search Report and Written Opinion for International Application No. PCT/US2020/038662 dated Sep. 8, 2020.
The Extended European Search Report, Application No. EP 18861811 dated May 25, 2021.

* cited by examiner

AIR-COOLED CONDENSER SYSTEM

CROSS-REFERENCE TO RELATED APPLICATIONS

The present application is a continuation-in-part of U.S. patent application Ser. No. 16/142,246 filed Sep. 26, 2018, which claims the benefit of priority to U.S. Provisional Application No. 62/564,000 filed Sep. 27, 2017. The present application further claims benefit of priority to U.S. Provisional Patent Application No. 62/863,360 filed Jun. 19, 2019. The entireties of the foregoing disclosures are incorporated herein by reference.

BACKGROUND

The present invention generally relates to dry cooling systems, and more particularly to an air-cooled condenser system suitable for steam condensing applications in a Rankine cycle of an electric generating power plant or other non-power generating applications.

An air-cooled condenser (ACC) provides a competent alternative to the water-cooled condenser to condense large quantities of low pressure waste steam from power plants and other industrial installations. Over the past seven decades, the state-of-the art in ACC design has evolved to the single tube row configuration wherein a blower/fan blasts ambient air past an array of inclined finned tubes that emulate a pitched A-frame roof. The angle of inclination of the finned tubes is typically 60 degrees from the horizontal plane. The finned tubes are in the shape of an elongated obround tube with the flat surfaces equipped with tall aluminum fins through which the blower's forced air must traverse to exit the ACC. The above arrangement of the blower and the finned tube bundles for efficient heat transfer is an established and proven technology that is widely used in ACC design. However, it is their structural design and constructability aspects of present and installation design practice that are amenable to innovation.

To frame the structural problem and put things in perspective, it is important to recognize that an ACC is a large massive structure. For a 500 MWe power plant, for example, a typical ACC has a footprint of about 40,000 square feet and rises about 110 feet high. The inclined tube bundles are each attached directly to and fully supported by a structural A-frame, which in turn is supported by a vertically-extending superstructure which elevates the fan and tube bundles above the ground. The heat transfer function of the ACC means that the tube bundles and piping headers of the structure undergoes significant thermal expansion and contraction under the ACC's normal operating conditions. Erecting a large ACC structure on site, particularly building the structural A-frame required to support the tube bundles, requires a significant amount of time and human effort.

An improved air-cooled condenser is therefore desired which minimizes the structural work required on site for erection and concomitantly provides thermal expansion/contraction capabilities to prevent differential thermal expansion induced crack formation particularly of the fluid components which form the pressure boundary for the steam and condensate.

SUMMARY

An air-cooled condenser (ACC) system according to the present disclosure provides a novel configuration and support system which overcomes the foregoing disadvantages of prior ACC design. The ACC system may include an ACC comprising a top common steam header and a pair of laterally spaced apart bottom condensate headers. The ACC may be a single row finned tube heat exchanger comprising a plurality of inclined and self-supporting planar tube bundles arranged in an A-shape tube construction or structure in one configuration. An acute angle is formed between opposing walls or panels of tube bundles. In contrast to prior ACC design, the present ACC advantageously does not require a structural A-frame to support the tube bundles. The present design instead leverages the strength of the angled tube bundle panels by providing a unique coupling at the top joint between upper tubesheets of the panels to hingedly couple the panels together which accommodates differential thermal expansion of the tube bundles. In embodiment, the hinge may be formed by an angled seal plate sealably attached to each tubesheet.

In addition, a unique lower support system for the tube bundles provides unfixed and slideable mounting of the condensate headers to which each tube bundle is coupled. This allows the headers (steam and condensate) and tube bundles to grow or contract in the longitudinal direction as a unit thereby negating any significant differential thermal expansion problems.

Each tube bundle is fluidly coupled to the steam header at top and one of the condensate headers at bottom. One or more fans arranged below the A-shaped tube bundles blow ambient cooling air through the tube bundles to condense steam flowing through the tube side of the tubes. The condensed steam (i.e. condensate) collects in the bottom condensate headers. In one implementation, the ACC may be fluidly connected to a Rankine cycle flow loop comprising a steam turbine and performs the duty of a surface condenser. The ACC receives exhaust steam from the steam turbine, which is cooled and condensed before being returned to the Rankine cycle flow loop.

In one embodiment, the ACC may further include a thermal restraint unit which is configured to provide both a longitudinal and vertical restraint feature to arrest growth of the steam header and tube bundles under thermal expansion when heated by steam. The thermal restraint unit may comprise an A-frame in one embodiment fixedly mounted to the fan support frame and spaced apart from the tube bundles. The A-frame is a standalone and self-supporting structure. The thermal restraint unit is configured to provide both longitudinal restraint of the steam header and vertically restraint of the tube bundles when each grow in length due to thermal expansion. In one configuration, the thermal restraint unit includes a longitudinally stationary fixation member fixedly attached to the pair of upper tubesheets (which in turn are structural coupled to the steam header). In one embodiment, the fixation member may be a vertically oriented fixation keel plate. The fixation member is operable to arrest longitudinal growth of the steam header when the steam header grows due to thermal expansion, thereby providing a longitudinal restraint feature. The fixation member may be slideably mounted to the thermal restraint unit via a sliding joint which is configured to allow limited vertical growth and movement of the tube bundles when heated by steam, thereby providing a vertical restraint feature. The fixation member thus moves and down with the upper tubesheets and tube bundles fluidly coupled thereto.

In one aspect, an air-cooled condenser includes: a longitudinal axis; a longitudinally-extending steam header configured for receiving steam from a source of steam; a pair of longitudinally-extending condensate headers positioned below the steam header and spaced laterally apart; a pair of inclined tube bundles each comprising a plurality of tubes connected to an upper tubesheet and a lower tubesheet, the tube bundles disposed at an acute angle to each other; each tube bundle extending between and fluidly coupled to the steam header at top and a different one of the condensate headers at bottom forming an A-shaped tube structure; a fan mounted to a fan support frame and positioned below the tube bundles; wherein the tube structure is self-supporting such that the tube bundles are unsupported by the fan support frame between the upper and lower tubesheets.

In one embodiment, the air-cooled condenser may further include: a top steam flow plenum fluidly coupled between the steam header and the tube bundles, the upper tubesheets of each tube bundle attached to the steam flow plenum which is configured to transfer steam from the steam header to the tube bundles; and a condensate flow plenum fluidly coupled between each condensate header and a respective one of the tube bundles, the lower tubesheet of each tube bundle attached to a respective one of the condensate flow plenums which is configured to transfer condensate from the tube bundles to the condensate headers.

In one embodiment, the upper tubesheets are hingedly connected together by a longitudinally-extending angled seal plate, the seal plate comprising a resiliently flexible metal body operable to expand and contract due to thermal expansion.

In one embodiment, a longitudinally-extending monorail for maintenance of the fan may be provided. The monorail may be suspended overhead from the seal plate in one construction.

In another aspect, an air-cooled condenser includes: a longitudinal axis; a longitudinally-extending steam header configured for receiving steam from a source of steam; a pair of longitudinally-extending condensate headers positioned below the steam header and spaced laterally apart, the steam and condensate headers oriented parallel to each other; a pair of inclined tube bundles each comprising a plurality of tubes connected to an upper tubesheet and a lower tubesheet, the tube bundles disposed at an acute angle to each other; the upper tubesheets being hingedly connected together by a longitudinally-extending angled seal plate, the seal plate comprising a resiliently flexible metal body operable to deform under thermal expansion or contraction; each tube bundle arranged between and in fluid communication with the steam header and a different one of the condensate headers at bottom; a fan arranged for blowing ambient cooling air upwards through the bundles; a fan platform configured to support and raise the fan above a support surface, the fan platform comprising a horizontal fan deck positioned below the tube bundles; wherein the tube bundles, steam header, and condensate headers form a self-supporting tube structure in which the tube bundles are not directly supported by any structural members above the fan deck.

In another aspect, an air-cooled condenser includes: a longitudinal axis; a longitudinally-extending steam header configured for receiving steam from a source of steam; a pair of longitudinally-extending condensate headers positioned below the steam header and spaced laterally apart; a pair of inclined tube bundles each comprising a plurality of tubes connected to an upper tubesheet and a lower tubesheet, the tube bundles disposed at an acute angle to each other; each tube bundle extending between and fluidly coupled to the steam header at top and a different one of the condensate headers at bottom forming an A-shaped tube structure; a fan support frame supporting a fan below the tube bundles; the condensate headers each axially slideably supported by a saddle support fixedly attached to the fan support frame, the saddle supports each comprising an upwardly open arcuately curved support surface which slideably engages the condensate headers; wherein the condensate headers are operable to expand or contract in length in a direction parallel to the longitudinal axis due to thermal expansion or contraction conditions.

An induced draft air-cooled condenser is also disclosed.

According to one aspect, an air-cooled condenser cell comprises: a structural frame defining a longitudinal axis; a pair of longitudinally-extending steam headers supported by the frame and configured for receiving steam from a source of steam; a pair of longitudinally-extending condensate headers positioned below the steam headers and spaced laterally apart; a pair of inclined tube bundles each comprising a plurality of tubes connected to an upper tubesheet and a lower tubesheet, the tube bundles disposed at an acute angle to each other; each tube bundle extending between and fluidly coupled to one of the steam headers at top and a different one of the condensate headers at bottom forming a V-shaped tube structure; a fan mounted to the cell and arranged to flow ambient cooling air through the tube bundles; and a deflection limiter beam rigidly mounted to the frame; wherein the deflection limiter beam is arranged between the tube bundles and coplanar therewith.

According to another aspect, an air-cooled condenser comprises: an array of cooling cells, each cooling cell comprising: a structural frame defining a longitudinal axis and comprising a main beam, a plurality of transversely elongated condensate header support beams affixed to the main beam, and plurality of deflection limiter beams affixed to the condensate header support beams which collectively form a V-shaped structure; a pair of longitudinally-extending steam headers mounted to a top of the frame which receive steam from a source of steam; a pair of longitudinally-extending condensate headers mounted to condensate header support beams, one condensate header being arranged on each side of the main beam; a pair of inclined tube bundles each comprising a plurality of tubes connected to an upper tubesheet and a lower tubesheet, the tube bundles disposed at an acute angle to each other; each tube bundle arranged coplanar with the deflection limiter beams and fluidly coupled to one of the steam headers at top and one of the condensate headers at bottom; a fan mounted at a top of the frame and operable to draw ambient cooling air through the tube bundles; and a floating end cap associated with each deflection limiter beam and rigidly affixed to the upper tubesheet, each deflection limiter beam having a top end slideably inserted in an open channel of the end cap; wherein the end caps are configured to prevent out of plane bowing of the tube bundles via engaging the deflection limiter beams when the tubes thermally expand.

BRIEF DESCRIPTION OF THE DRAWINGS

The features of the preferred embodiments will be described with reference to the following drawings where like elements are labeled similarly, and in which.

All drawings are schematic and not necessarily to scale. A reference herein to a figure number herein that may include multiple figures of the same number with different alphabetic suffixes shall be construed as a general reference to all those figures unless specifically noted otherwise.

DETAILED DESCRIPTION

Figure 1:
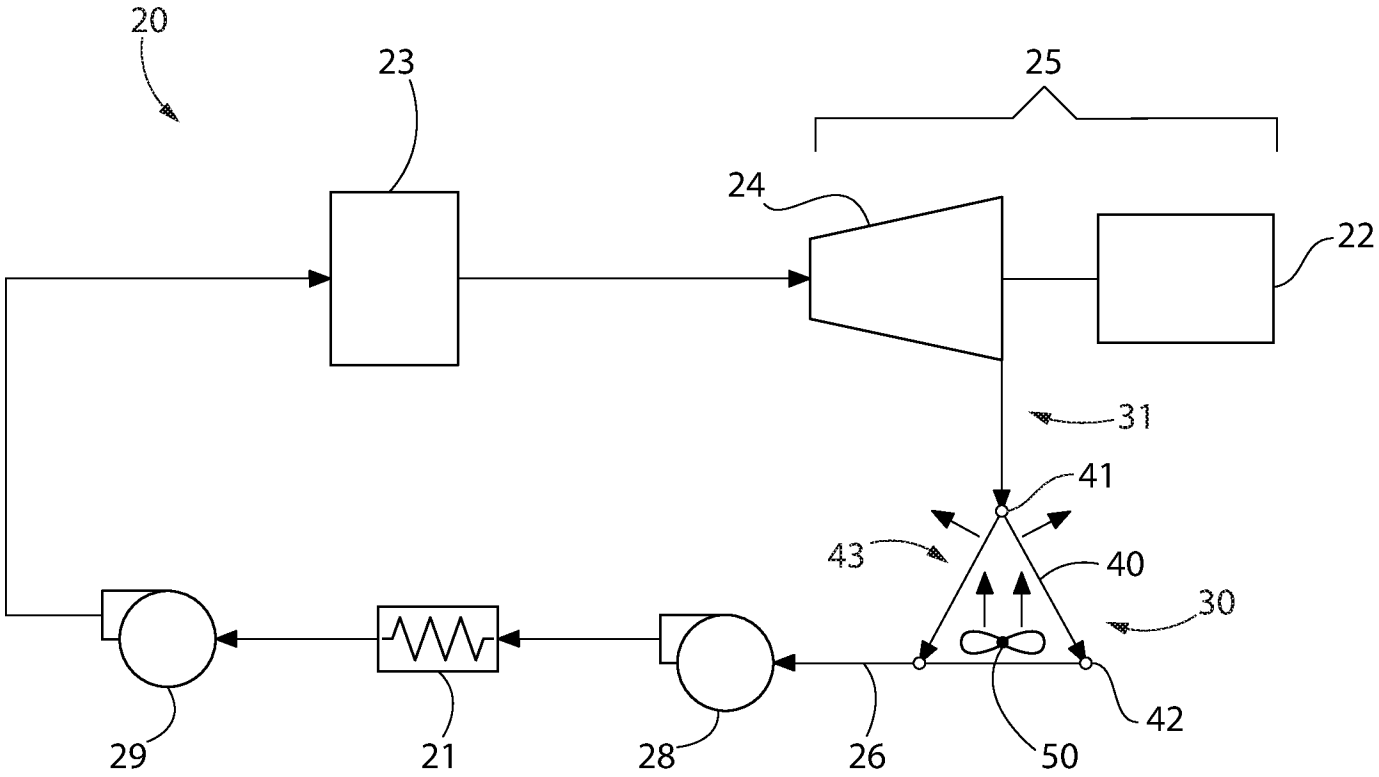
FIG. 1 is a schematic flow diagram of a power generation Rankine cycle comprising a forced draft air-cooled condenser (ACC) according to the present disclosure.

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

The present air-cooled condenser (ACC) is configured and operable to achieve goals of: (a) minimizing the required external support structure around the tube bundles by leveraging the structural strength of the bundle itself, and (b) providing an essentially unrestrained thermal expansion of the tube arrays while imputing the capacity to withstand wind loads and seismic excitation.

In one embodiment, these goals may be accomplished by an ACC design in which the bottom condensate headers (that collect and carry the condensed water cascading down the tubes) are supported in a longitudinally unrestrained manner on curved saddle supports, but are otherwise unconnected. There are no fixed support points associated with the support system for the condensate headers. This arrangement allows the condensate headers and tube bundles to advantageously grow or contract in the longitudinal direction without developing stresses from restraint of thermal expansion or contraction which may induce thermal stress cracking.

The present ACC design further provides a hinged flexible coupling at the junction between the two upper tubesheets of tube bundles at the vertex where they meet at the common steam header. This allows for limited transverse expansion/contraction and vertical growth/contraction of the structure. The flexible joint may comprise a curved or angled seal plate which fluidly and hermetically seals the open joint between the two tubesheets. The angled seal plate also provides ability to absorb lateral expansion to a limited degree. The thermal movement is typically much smaller in the transverse dimension than the vertical direction because of smaller lateral dimensions involved at the tubesheet juncture.

The foregoing aspects of the ACC system are further described below.

Forced Draft Air-Cooled Condenser System

FIG. 1 is a schematic flow diagram of a conventional Rankine cycle flow loop 20 of a thermal electric power generation plant. A forced draft air-cooled condenser system 30 according to the present disclosure comprising air-cooled condenser (ACC) 40 is fluidly coupled to the Rankine cycle flow loop 20 in a steam condensing application. With additional reference to FIG. 2, ACC 40 generally comprises a top common steam header 41, a pair of bottom condensate headers 42, and pair of inclined/angled tube panels or bundles 43 of generally planar configuration extending between the steam and condensate headers forming an A-frame structure. The power generation plant may be a nuclear plant, fossil fired plant, or utilize another other energy source such as renewables including biomass, trash, or solar in various embodiments. The electric power generating portion of the plant comprises a turbine-generator set 25 including an electric generator 22 and steam turbine 24 operably coupled to the generator for rotating a rotor to generate electricity via stationary stator windings in the generator. A steam generator 23 using a heat or energy source heats feedwater to produce the steam. In various embodiments, the source of heat for the steam generator may be a nuclear reactor, or a furnace which burns a fossil fuel (e.g. coal, oil, shale, natural gas, etc.) or other energy source such as biomass. The heat and fuel source do not limit the invention.

The condensate headers 42 are fluidly connected to condensate return piping 26 to route the liquid condensate back to a condensate return pump 28 which pumps the condensate in flow loop 20 to the steam generator. The condensate is generally pumped through one or more feedwater heaters 21 which uses steam extracted from various stages in the steam turbine 24 to pre-heat the condensate. The pre-heated condensate may be referred to as "feedwater" at this stage in cycle. Feedwater pumps 29 further pressurizes and pumps the feedwater to a steam generator 23) where the liquid feedwater is evaporated and converted into steam. The high pressure steam flows through the steam turbine 24 which in turn produces electricity in a known manner via electric generator 22. The pressure of the steam drops as it progressively flows through the turbine converting thermal and kinetic energy into electric energy. The low pressure steam at the outlet or exhaust of the turbine (i.e. "exhaust steam") is routed to the steam header 41 of the ACC 40 where it condenses and flows back to the Rankine cycle flow loop 20 to complete the flow path. A steam condensing closed flow loop 31 comprising the ACC 40 is thus formed and fluidly coupled to the Rankine cycle flow loop 20 between the steam turbine 24 and condensate pump 28 in this example.

Figure 2:
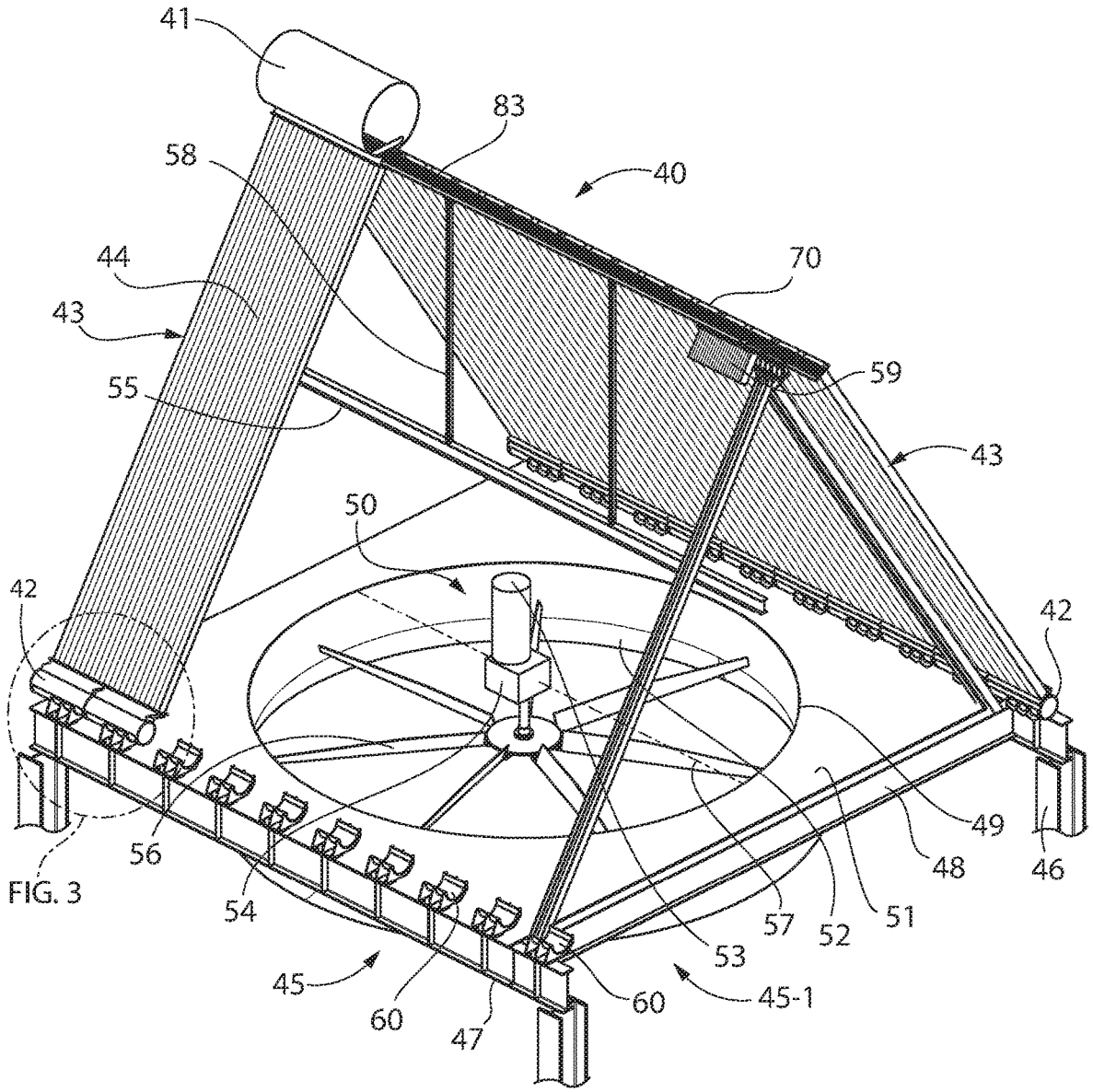
FIG. 2 is a perspective view of the ACC of FIG. 1 with some front tube bundles and structure removed to more clearly show the fan.
Figure 3:
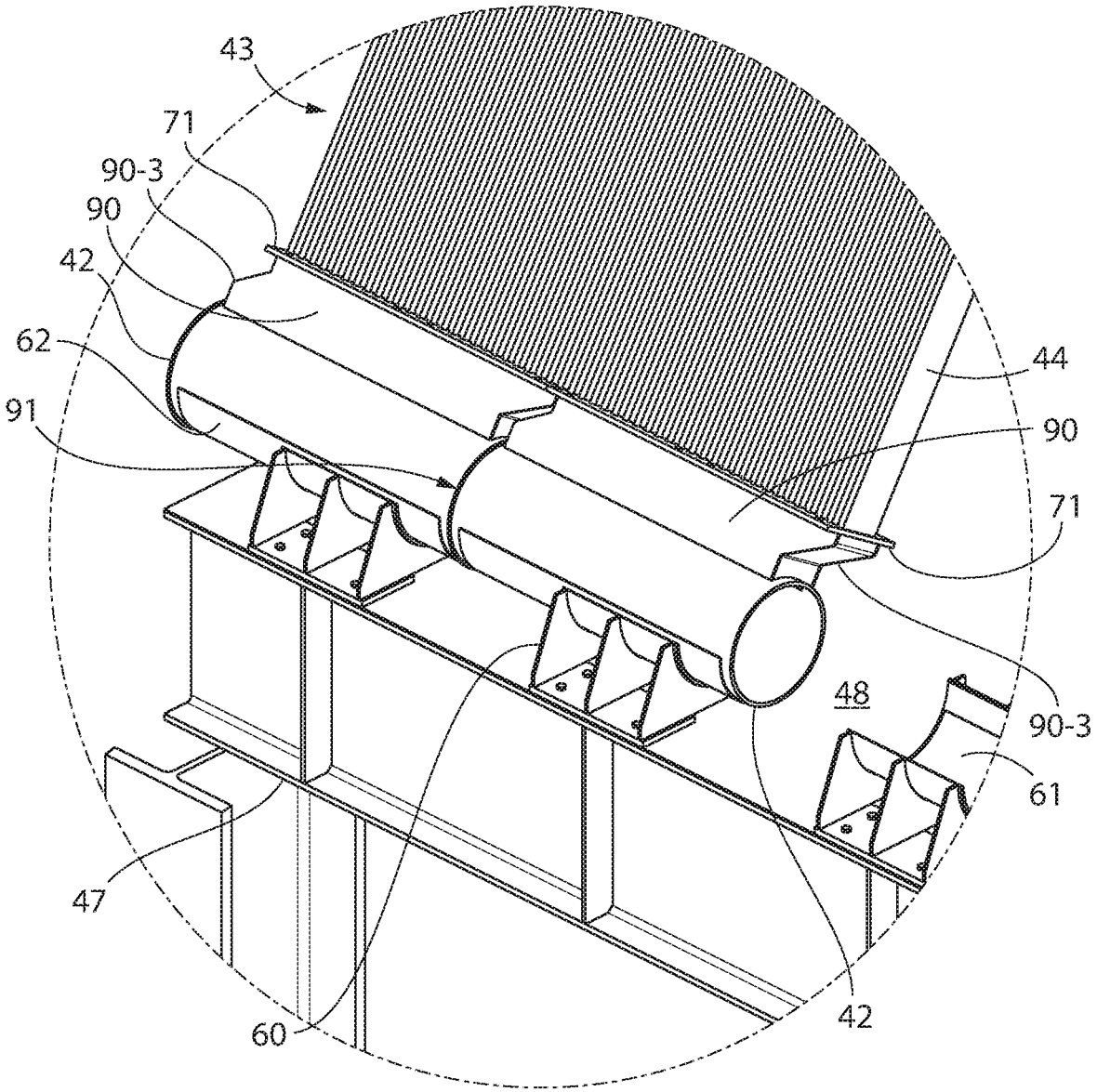
FIG. 3 is detail taken from FIG. 2 of the tube bundle to condensate header fluid connection showing the condensate flow plenums and header saddle supports.

FIG. 2 is a perspective view of a portion of ACC 40 according to the present disclosure showing the general construction and arrangement of the foregoing common steam header 41, condensate headers 42, and inclined tube bundles 43. Part of the front tube bundles are removed for clarity to show interior features of the ACC.

Referring to FIGS. 2-12, the ACC 40 may be a single row finned tube heat exchanger design comprising a plurality of inclined/angled tube bundles 43 arranged in an A-shaped construction in one configuration with an acute angle formed between opposing walls or panels of tube bundles. Each of the tube bundles 43 on the same side of the "A" are arranged in laterally adjoining side-by-side relationship as shown. The number of tube bundles will be dictated by the cooling requirements of the design. Each tube bundle is fluidly coupled to the common steam header 41 at top and one of the condensate headers 42 at bottom. One or more fans 50 arranged below the A-frame tube bundles blow ambient cooling air upwards through the tube bundles 43 to condense steam flowing downwards through the tube side of the tubes 44. Accordingly, each fan 50 has a bottom suction side for drawing ambient cooling air into the fan, and a top discharge side for discharging the air towards the tube bundles 43. The condensed steam now in liquid state (i.e. condensate) collects in the bottom condensate headers 42, as previously described herein.

It bears noting the ACC 40 shown in FIG. 2 is one of multiple ACCs which may be provided in a complete ACC system installation. Each ACC may be thought of as a cooling cell or unit which can be fluidly coupled together in a concatenated fashion in series at the steam and condensate header joints to provide the entire cooling duty required to condense the steam and return the condensate to the Rankine cycle flow loop. Each cooling cell shown in FIG. 2 may include multiple tube bundles 43 on each side (the left-most tube bundle in front showing a single tube bundle and the rear showing multiple tube bundles). The steam and condensate headers 41, 42 may be a single monolithic continuous flow conduit within each cell or be comprised of multiple header sections which are fluidly coupled together within each cell to form the continuous flow conduit.

ACC 40 includes a longitudinal axis LA which is defined by the axial centerline of common steam header 41 for convenience of reference. This also defines a corresponding axial direction which may be referred to herein. A vertical centerline Cv of the ACC is defined by the vertical centerline of the steam header which intersects the longitudinal axis LA (see, e.g. FIG. 4). The steam header further defines a horizontal reference plane Ph which intersects the vertical centerline Cv and longitudinal axis LA. The longitudinal axis, vertical centerline, and horizontal reference plane define a convenient reference system for describing various aspect of ACC 40 and their relationship to one another.

Referring generally to FIGS. 2-12, ACC 40 includes a fan platform 45-1 comprising a support frame 45 which supports the fan 50, condensate headers 42, and other appurtenances. The condensate headers 42 in turn support the tube bundles 43 and steam header 41. The fan support frame 45 may comprise a combination of vertical structural columns 46, longitudinal beams 47, and lateral beams 48 spanning between the longitudinal beams in a conventional manner. Columns 46 are arranged to engage a horizontal support surface typically at ground level (e.g. concrete foundation). The fan platform 45-1 comprises fan deck plate 51 which is supported by the beams 47, 48 to provide access to the fan and its ancillaries. The fan deck plate 51 includes a relatively large vertical opening 49 in which fan 50 is mounted. The fan assembly further comprises an annular fan ring 52 supported from the fan deck plate 51, electric motor 53, and gear box 54 coupled to the hub of the fan 50 from which the fan blades 56 project radially outwards as shown. The motor and gear box may be disposed on top of the fan in one non-limiting construction as shown. The fan 50 may be mounted and supported in the fan ring 52 by supporting the gear box 54 from the frame, such as in some arrangements via horizontally extending fan support beams 57 (represented schematically by a dashed line) tied into the support frame and/or fan deck plate 51. Other fan support structural arrangements may of course be used and does not limit the invention. The fan deck plate 51 is elevated above the ground by support frame 45 to allow cooling air to enter the fan 50 from below and be discharged upwards through the tube bundles 43.

Referring to FIGS. 2-5, the peripheral ends of the fan deck plate 51 may support the condensate headers 42, which in turn support the tube bundles 43 and steam header 41 at the vertex between the bundles. The condensate headers 42 are supported from the fan deck plate 51 by a plurality of axially spaced apart saddle supports 60. Supports 60 may be fixedly attached to the fan deck plate 51 and/or longitudinal beams 47 such as via bolting (shown) or other suitable methods (e.g. welding). A horizontal base plate 63 may be provided on each support 60 which is configured for direct attachment to beams 47 in a fixed and rigid manner. The support thus remains stationary and fixed to the ACC support frame 45 irrespective of an thermal expansion of the fluid pressure boundary components. The fan deck plate 51 may be cut out around the saddle supports 60 (shown) or may extend beneath support base plates 63 in other embodiments contemplated.

Figure 5:
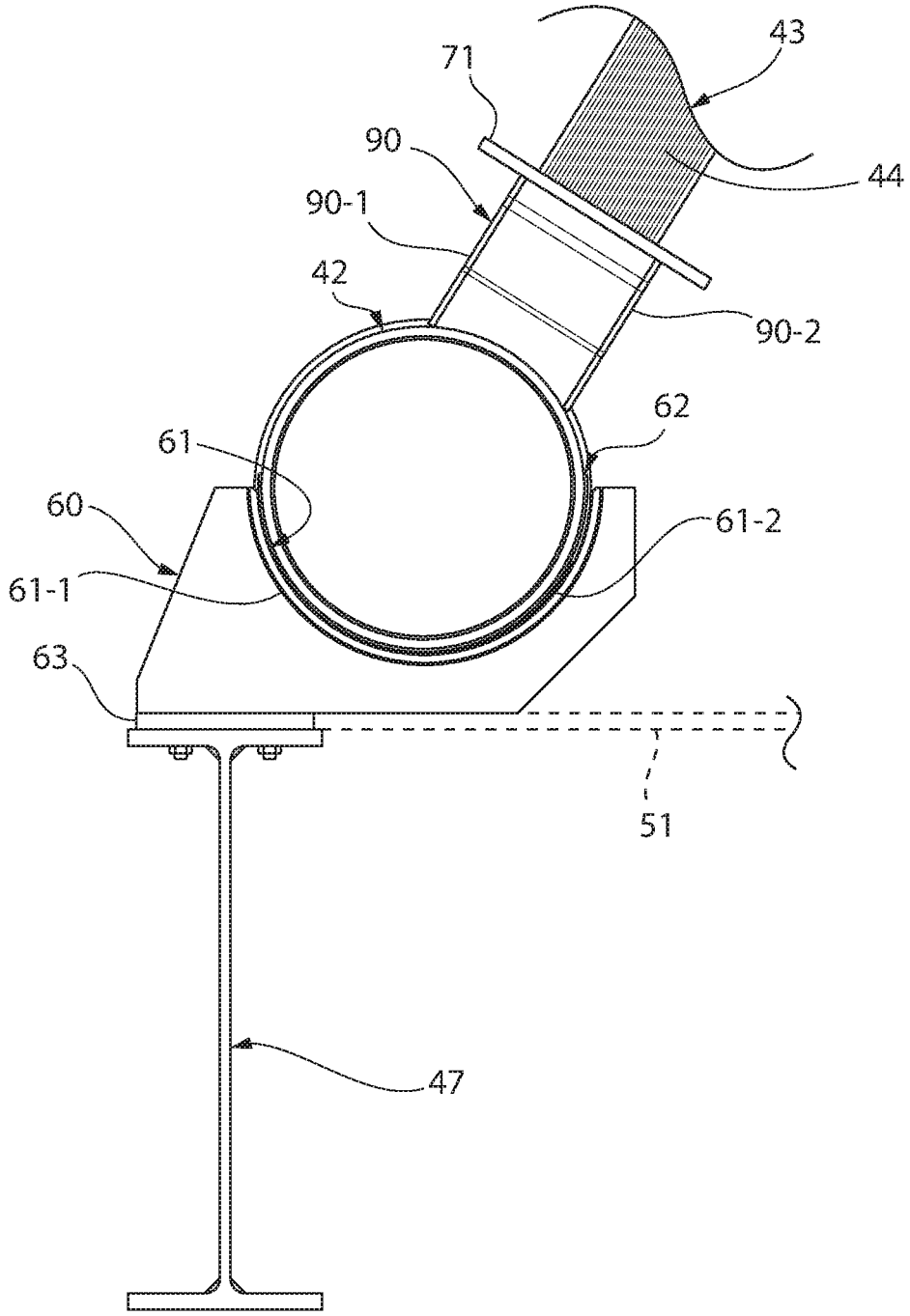
FIG. 5 is an enlarged detail taken from FIG. 4 showing the saddles supports.

Each saddle support 60 includes an upwardly open arcuately curved cradle plate 61-1 defining a concave support surface 61 configured to engage the lower portion of the condensate headers 42 (best shown in FIG. 5). Support surface 61 may be semi-circular in transverse cross section as shown having a complementary configuration to and diameter just slightly larger than the circular condensate headers 42 to produce conformal contact with the header when positioned thereon. The condensate headers 42 are not fixedly attached to the support saddles 60 or any other supports in one embodiment. This supports the condensate headers 42 (and weight of the tube bundles 43 and steam header 41) vertically, but the condensate headers are otherwise longitudinally unrestrained on the curved saddle supports. This arrangement advantageously allows the condensate headers (and tube bundles and steam header) to advantageously grow or contract in the longitudinal direction by sliding on the saddle supports 60 without developing stresses from restraint of thermal expansion or contraction which may induce thermal stress cracking. The headers 42 thus are slideable in the longitudinal direction in relation to the saddle supports.

In one embodiment, the curved support surface 61 may include an anti-friction coating 61-2 such as Teflon® or similar material to allow for smooth sliding engagement at the interface between the condensate headers 42 and saddle supports 60. In one embodiment, an arcuately curved and semi-circular wear plate 62 may be rigidly attached to the bottom half of the headers 42 to facilitate engagement with the saddle support surface 61 and prevent direct wear on the outer pressure boundary of the header. The wear plate 62 may be made of a suitable metal preferably welded to the headers 42, such as stainless steel in one embodiment. Other suitable metals for this application may be used.

Preferably, the saddle supports 60 are configured and constructed to be structurally robust enough to support the entire weight of the condensate headers 42, tube bundles 43 and steam header 41 without reliance upon any direct attachment to or direct support of the tube bundles 43 from the fan support frame 45 or other structural members tied into the support frame unlike prior A-frame ACC designs described in the Background. by contrast, tube bundles in these prior designs are affixed to and directly supported by the structural A-frame. In the present design, the weight of the tube bundles 43 may thus be supported only by the condensate headers 42, which in turn are supported by the saddle supports 60 affixed to the fan support frame 45. Because of the stiffness of the panels of rectangular tubes 44 and the robust saddle supports 60 which allow longitudinal expansion/contraction of the condensate headers 42, the A-shaped geometry of the tube bundles 43 is sufficiently self-supporting and rigid to meet the governing structural requirements (snow, wind & earthquake) at most installation sites. However, in certain installation sites subject to extreme weather-related or seismic conditions, braces and/or guy wires, frequently used to strengthen tall columns against winds and earthquakes, may be used to suitably brace the A-shaped tube bundles if necessary.

The fluid pressure boundary components of ACC 40 will now be further described with general reference to FIGS. 2-12. These components generally include the longitudinally-extending common steam header 41 at top, pair of longitudinally-extending condensate headers 42 at bottom, and tube bundles 43 each extending at an acute angle to vertical centerline Cv of ACC 40 between the steam header and a respective one of the condensate headers. Each tube bundle 43 defines a tube bundle axis Ta (see, e.g. FIG. 6). In the triangular or A-shaped arrangement of the tube bundles 43, the tube bundle axis TA of a first tube bundle on one side of ACC 40 is arranged angularly at an acute angle A1 to the tube bundle axis TA of the second tube bundle. In one embodiment, angle A1 may be between 0 and 90 degrees, and in one representative non-limiting example may be about 60 degrees. Other angles may be used. The tube bundles 43 converge towards each other but the upper tubesheets 70 do not meet. The tube bundle axes TA intersect at a vertex V which is located inside the steam header 41 proximate to the bottom opening 84 of the header in one embodiment (see, e.g. FIG. 6). The tube converging tube bundles form the A-shaped tube bundle configuration.

The tube bundles 43 in one embodiment may be shop-manufactured straight and generally planar/flat tube bundles each comprised of closely spaced apart parallel tubes 44 aligned in a single linear row and arranged in a single plane. Tubes 44 may have an obround or rectangular cross section (see, e.g. FIGS. 8 and 9). Each straight tube is fluidly connected at opposite ends to and supported by an upper tubesheet 70 and lower tubesheet 71. The tubesheets 70, 71 contain a plurality of tube holes or penetrations 1070A for allowing steam or condensate to flow into and out of the tubes 44 on the open interior tube side of the tubes which define flow passageways. The tube ends may fixedly coupled to the tubesheets in a leak-proof manner by being seal welded, brazed, or expanded (e.g. hydraulically or explosively) to the tubesheets to form fluidly sealed connections. The tubesheets 70, 71 may flat in one embodiment and formed of straight metallic plates.

Figure 9:
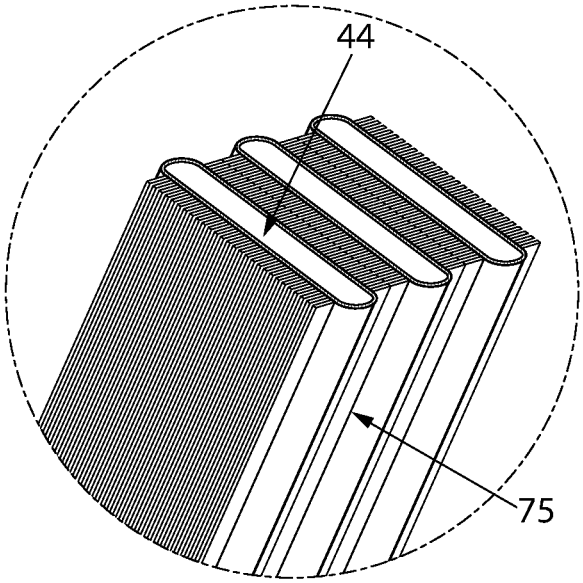
FIG. 9 is a perspective view of the ends of some tubes before sealably joined to an upper tubesheet.
Figure 8:
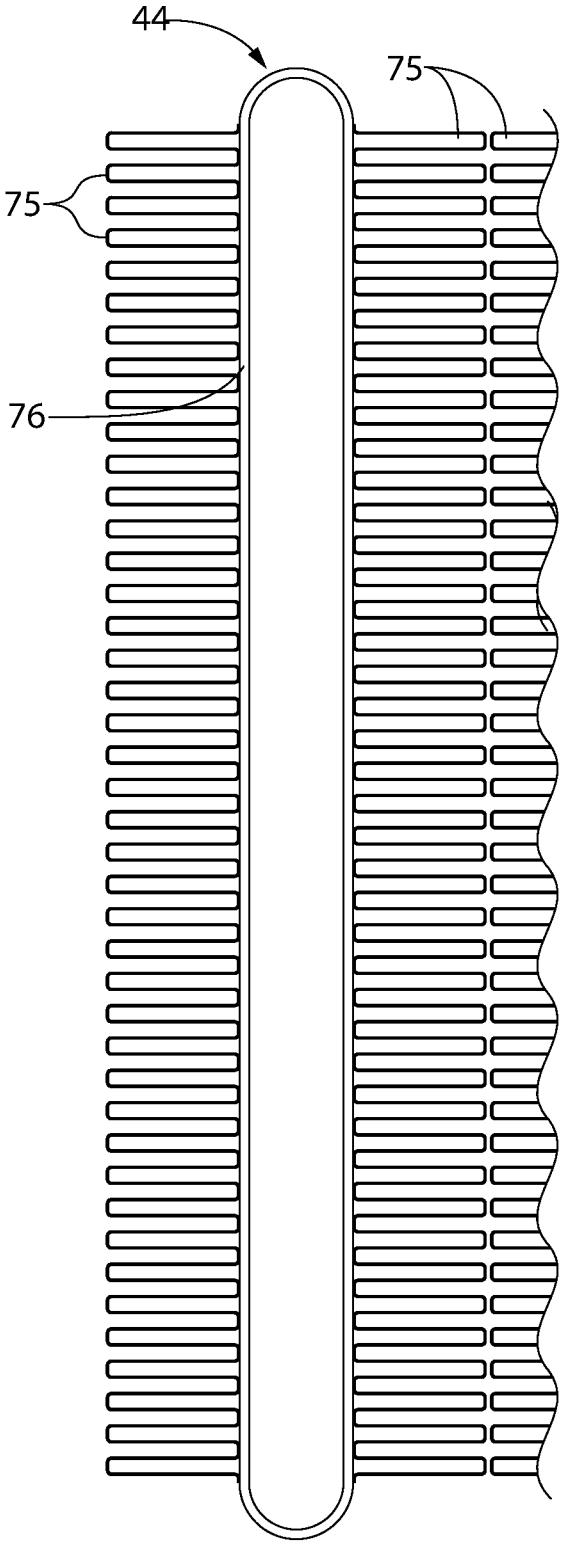
FIG. 8 is a side cross-sectional view of a finned tube of a tube bundle.
Figure 10:
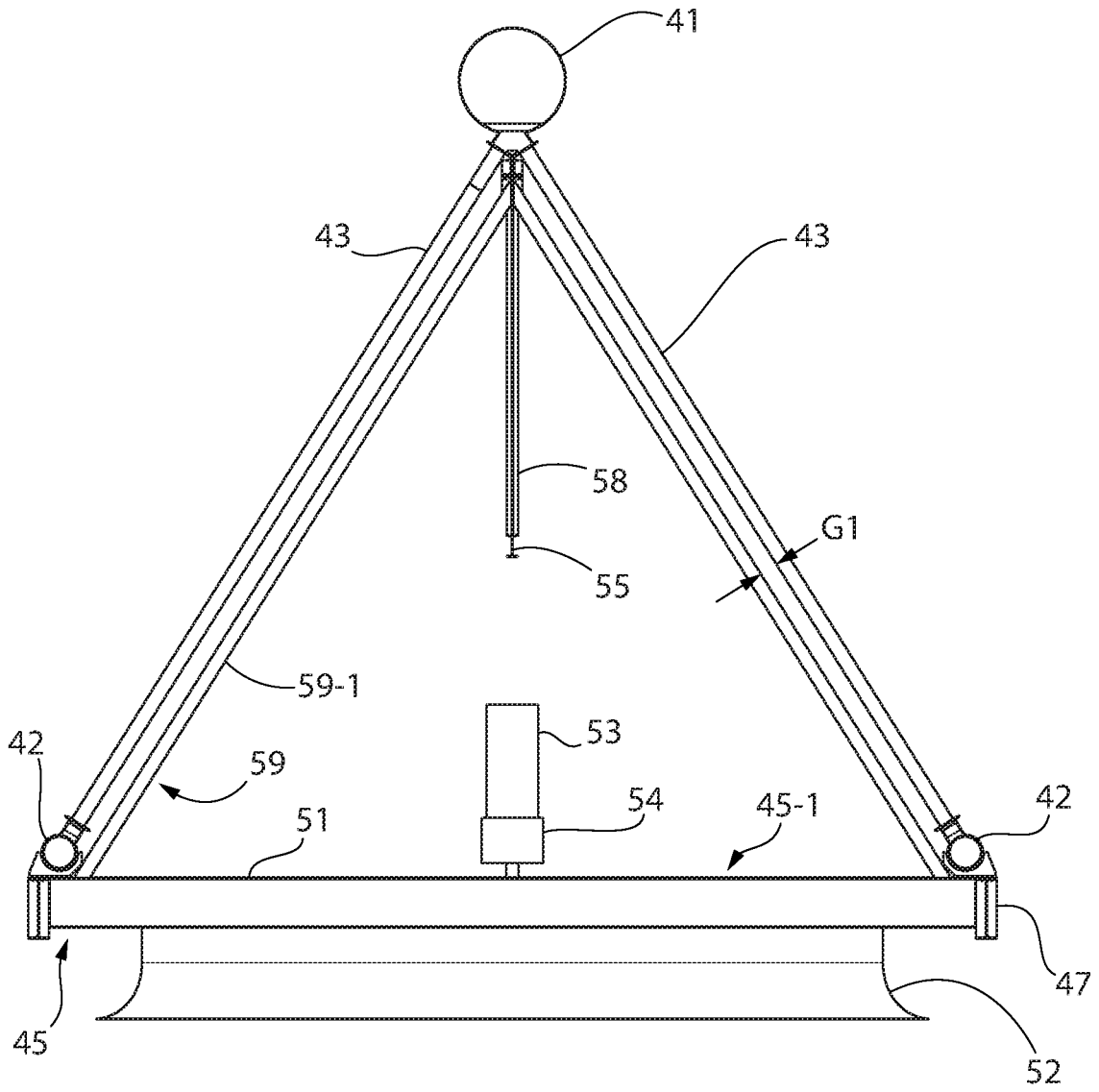
FIG. 10 is an end view of the ACC of FIG. 2.
Figure 11:
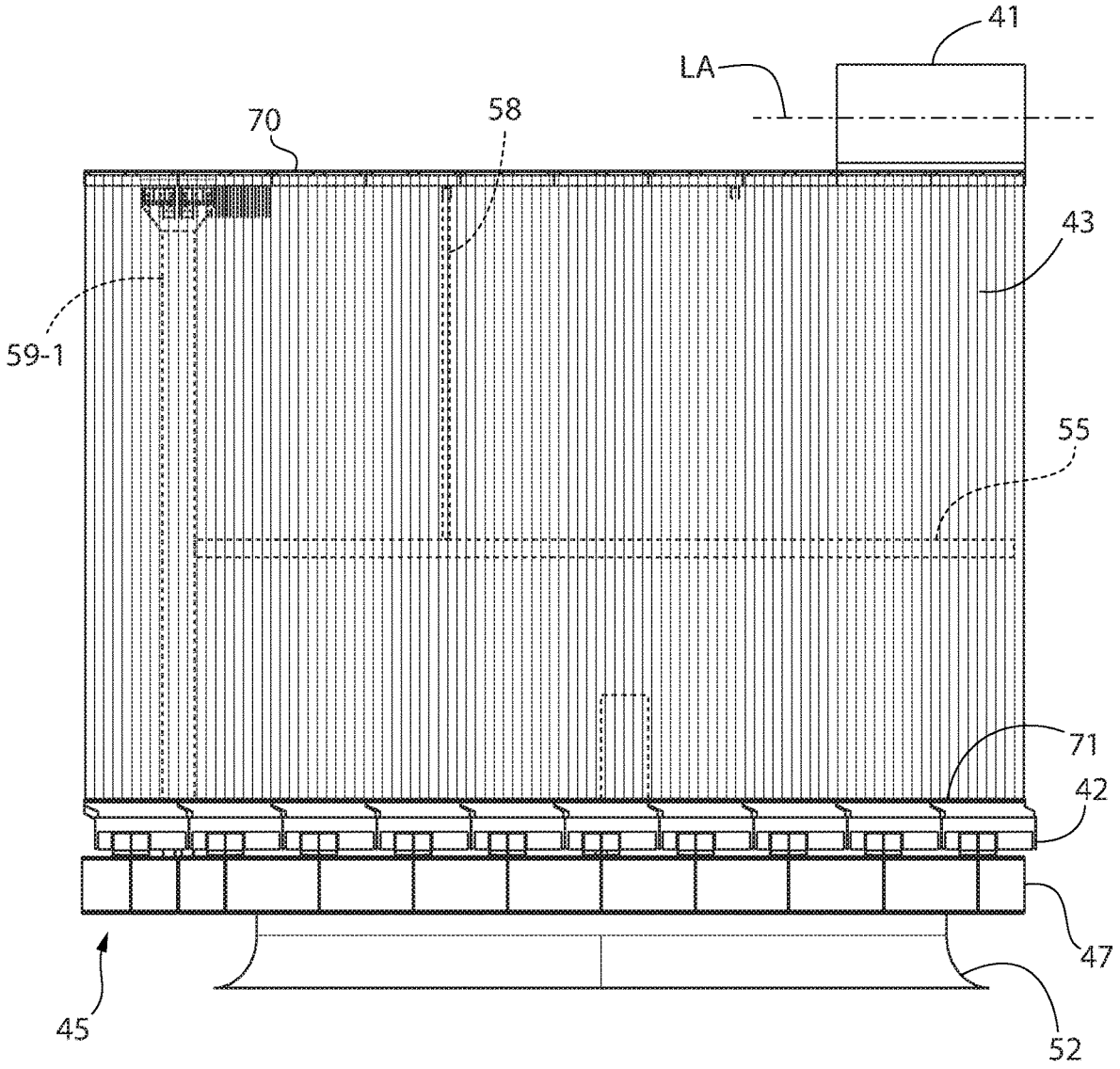
FIG. 11 is a side view of the ACC.
Figure 12:
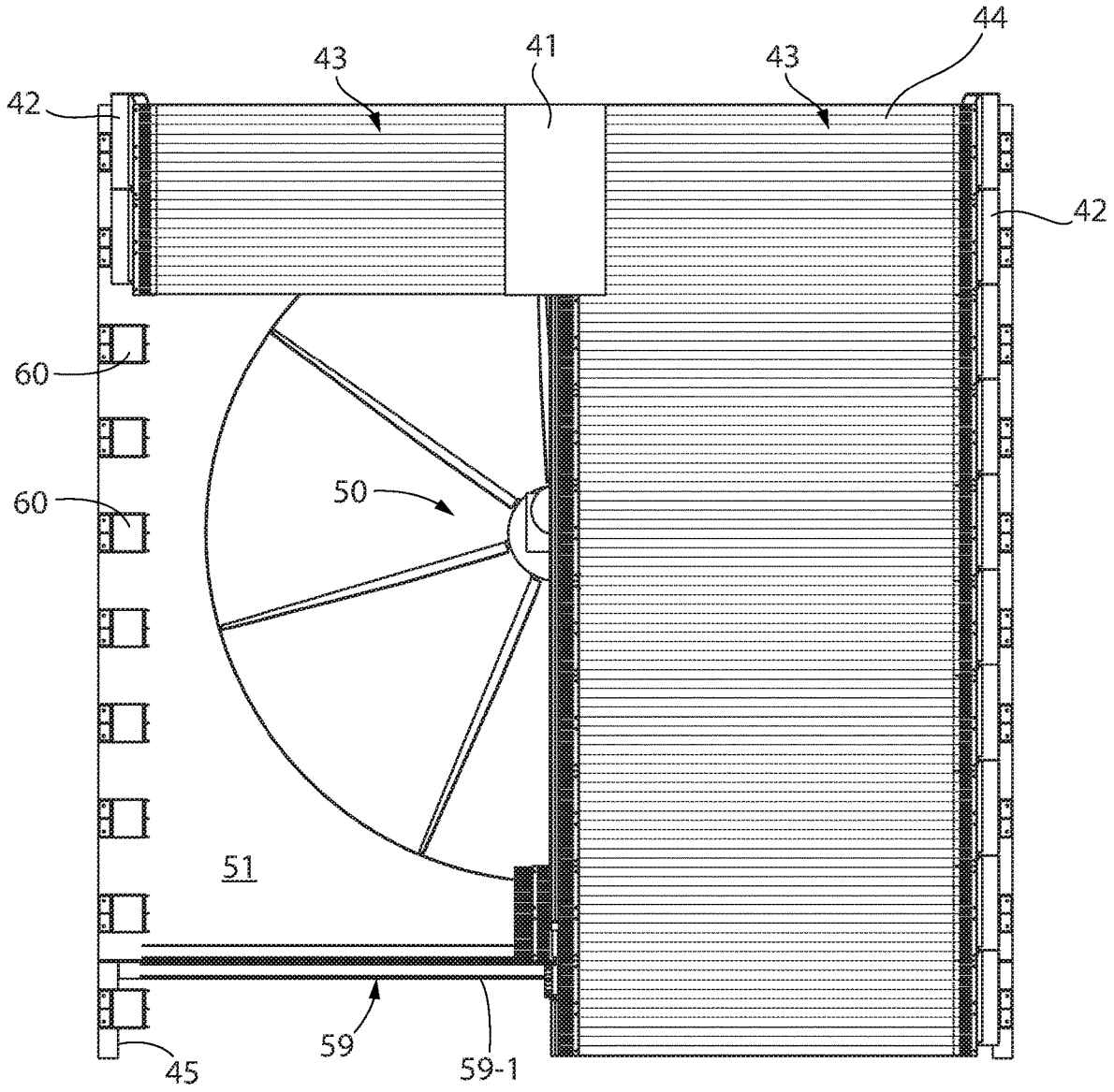
FIG. 12 is a top view of the ACC.
Figure 13:
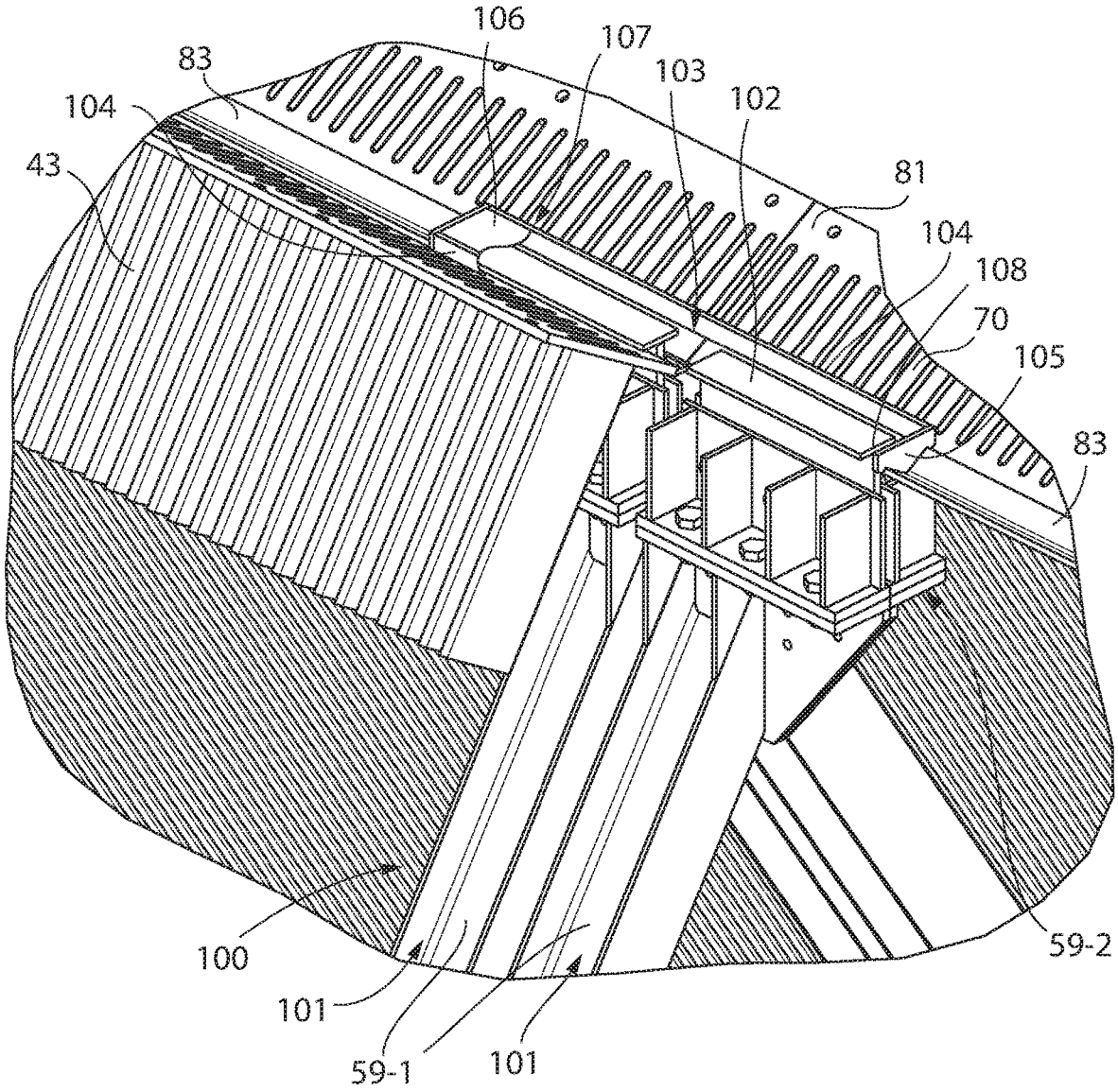
FIG. 13 is a perspective view of the tube bundle upper tubesheets area with steam flow plenum removed to better show a thermal expansion restraint system and upper coupling portion of a thermal restraint unit.
Figure 14:
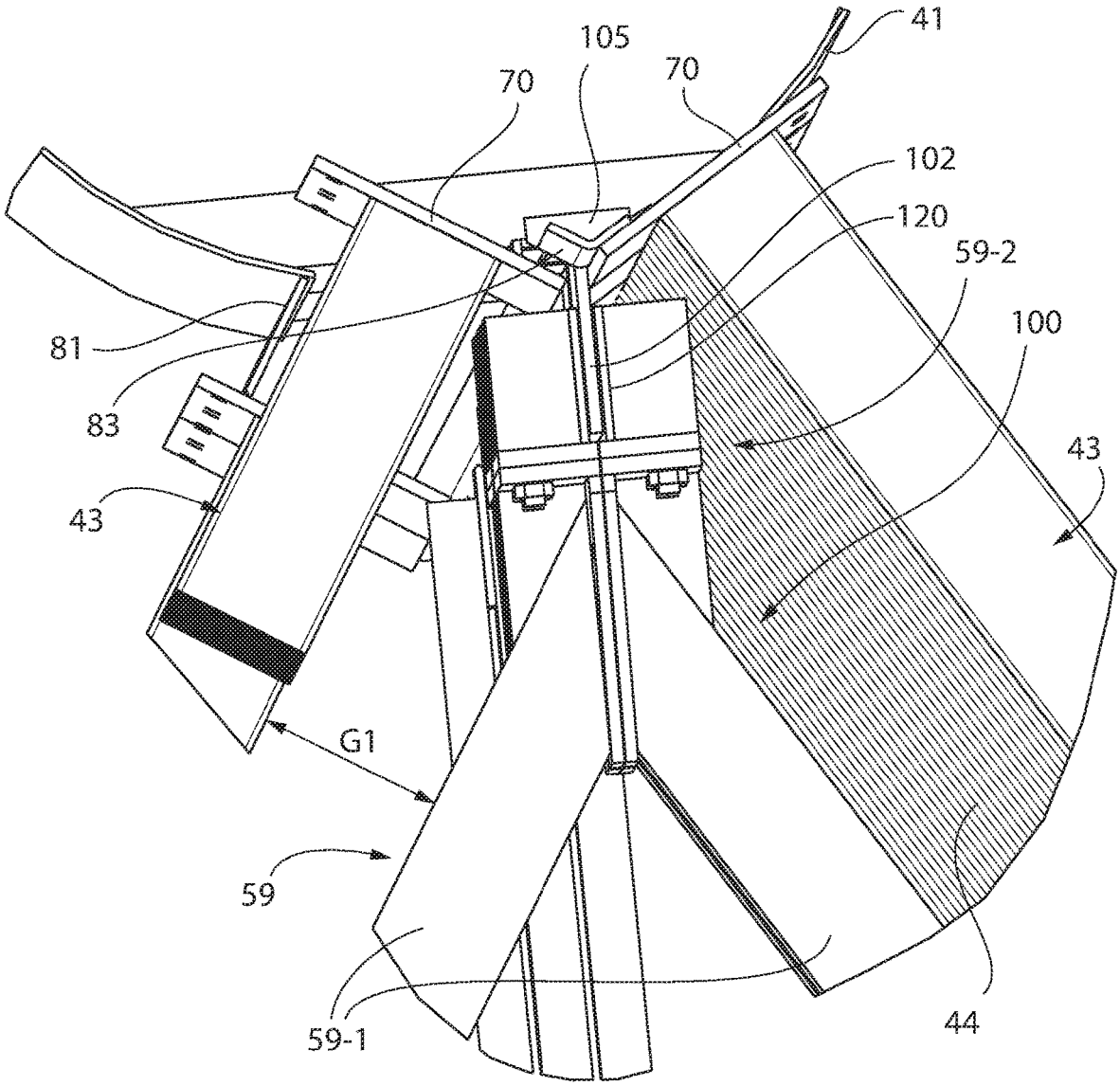
FIG. 14 is an end perspective view thereof.
Figure 15:
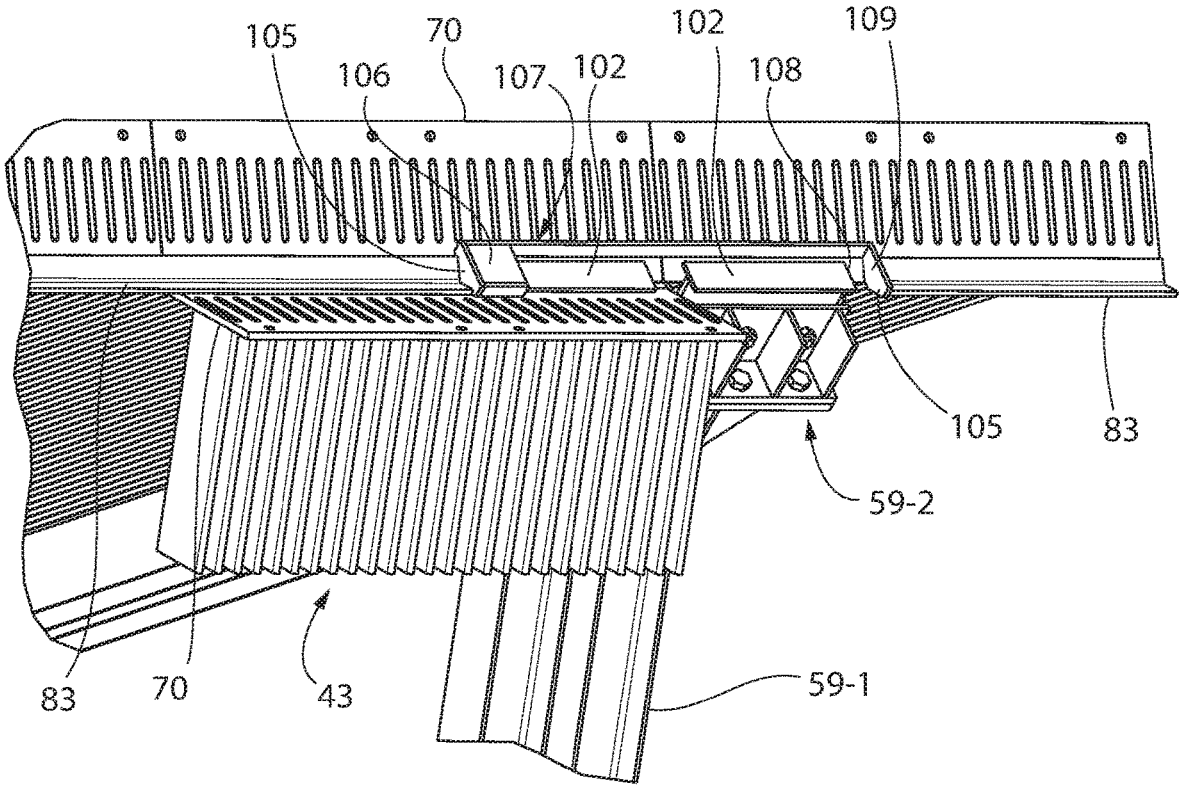
FIG. 15 is a top perspective view thereof.
Figure 16:
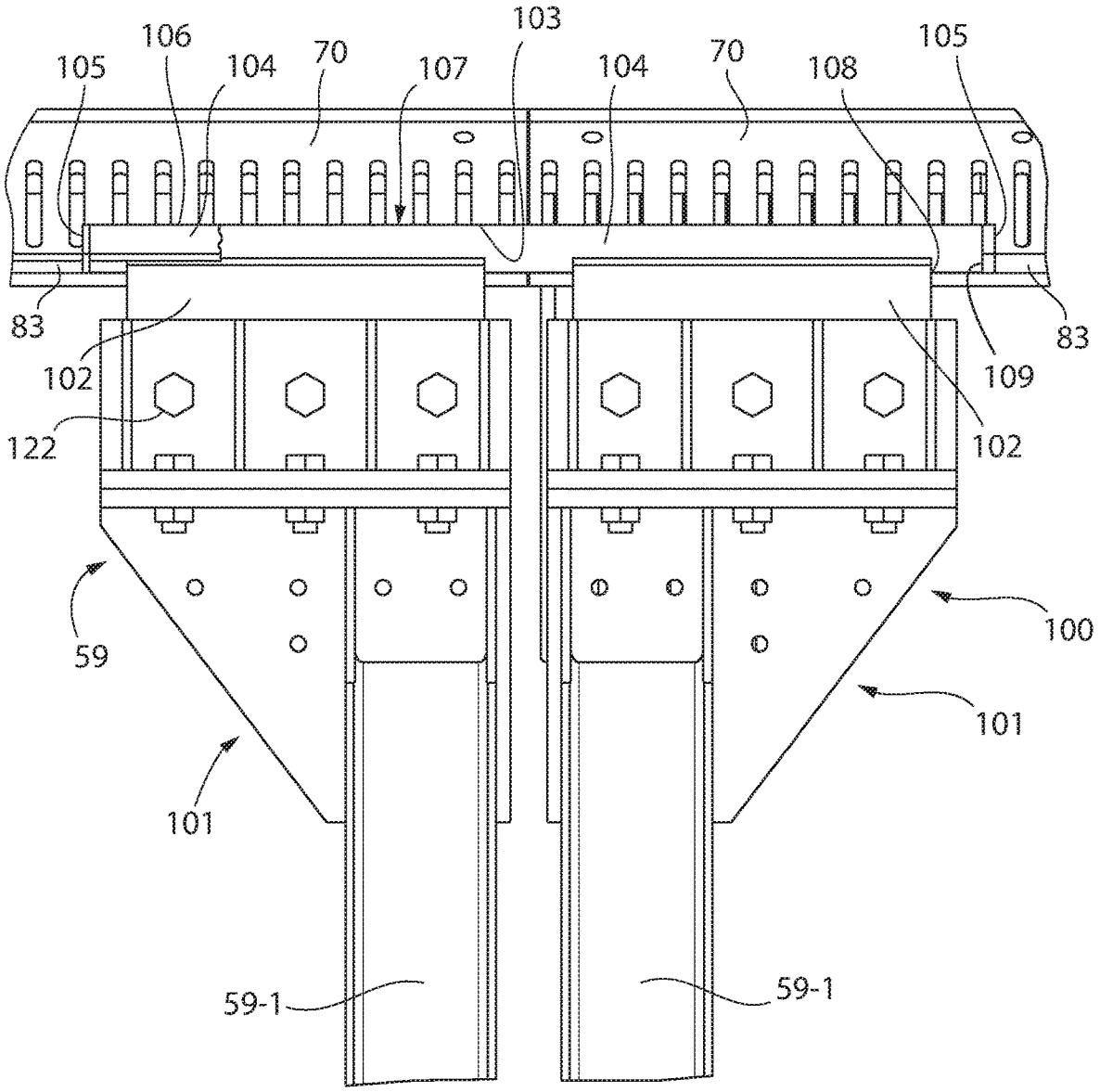
FIG. 16 is a side view thereof.
Figure 17:
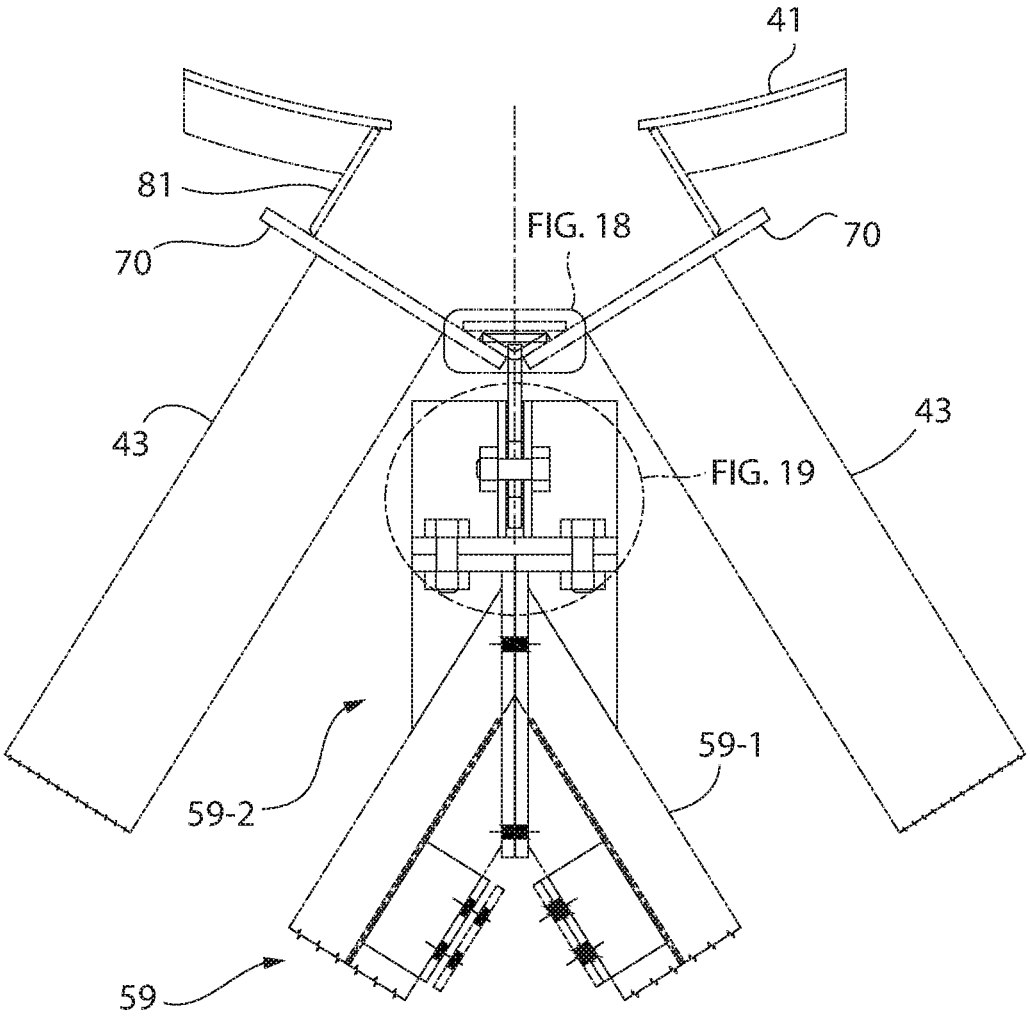
FIG. 17 is an end view of the coupling portion of the thermal restraint unit showing the sliding expansion joint assembly.
Figure 18:
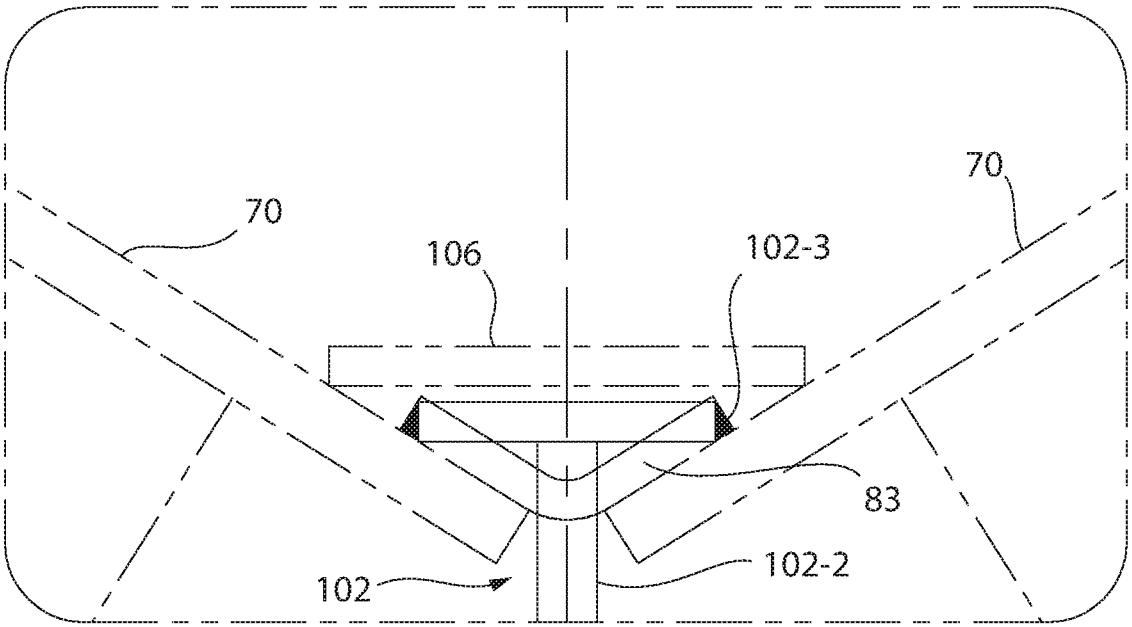
FIG. 18 is an enlarged detail taken from FIG. 17.
Figure 19:
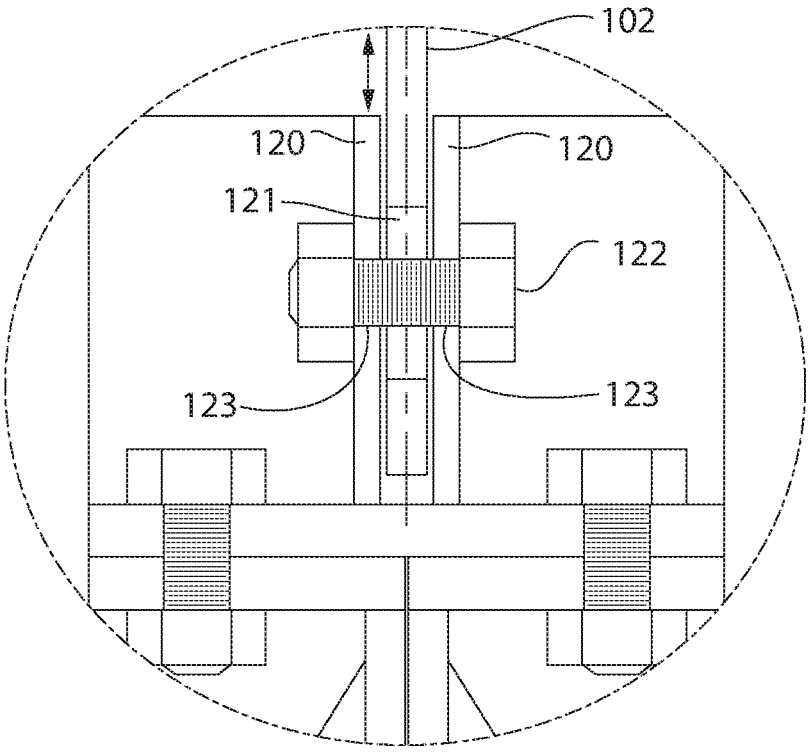
FIG. 19 is another enlarged detail taken from FIG. 17.
Figure 20:
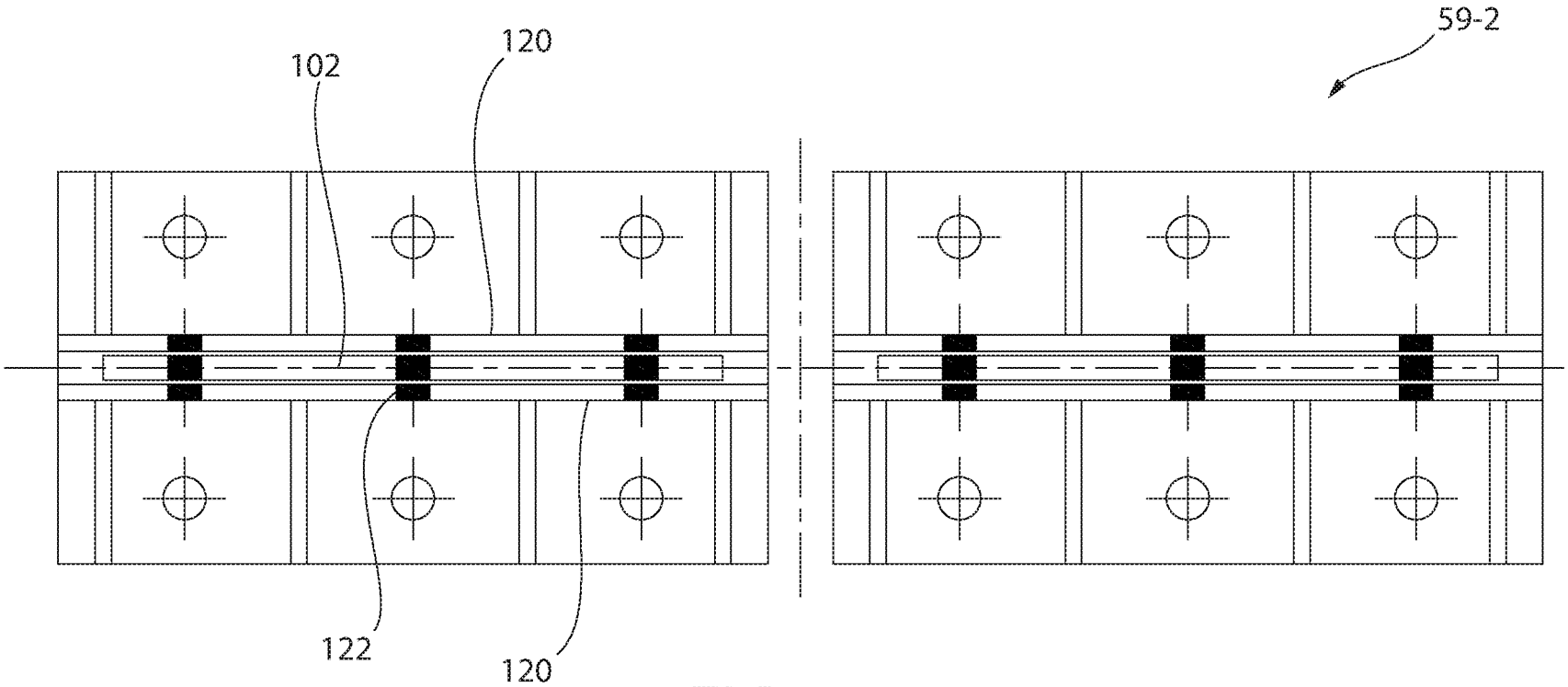
FIG. 20 is a top view of the sliding expansion joint assembly of FIG. 17.
Figure 21:
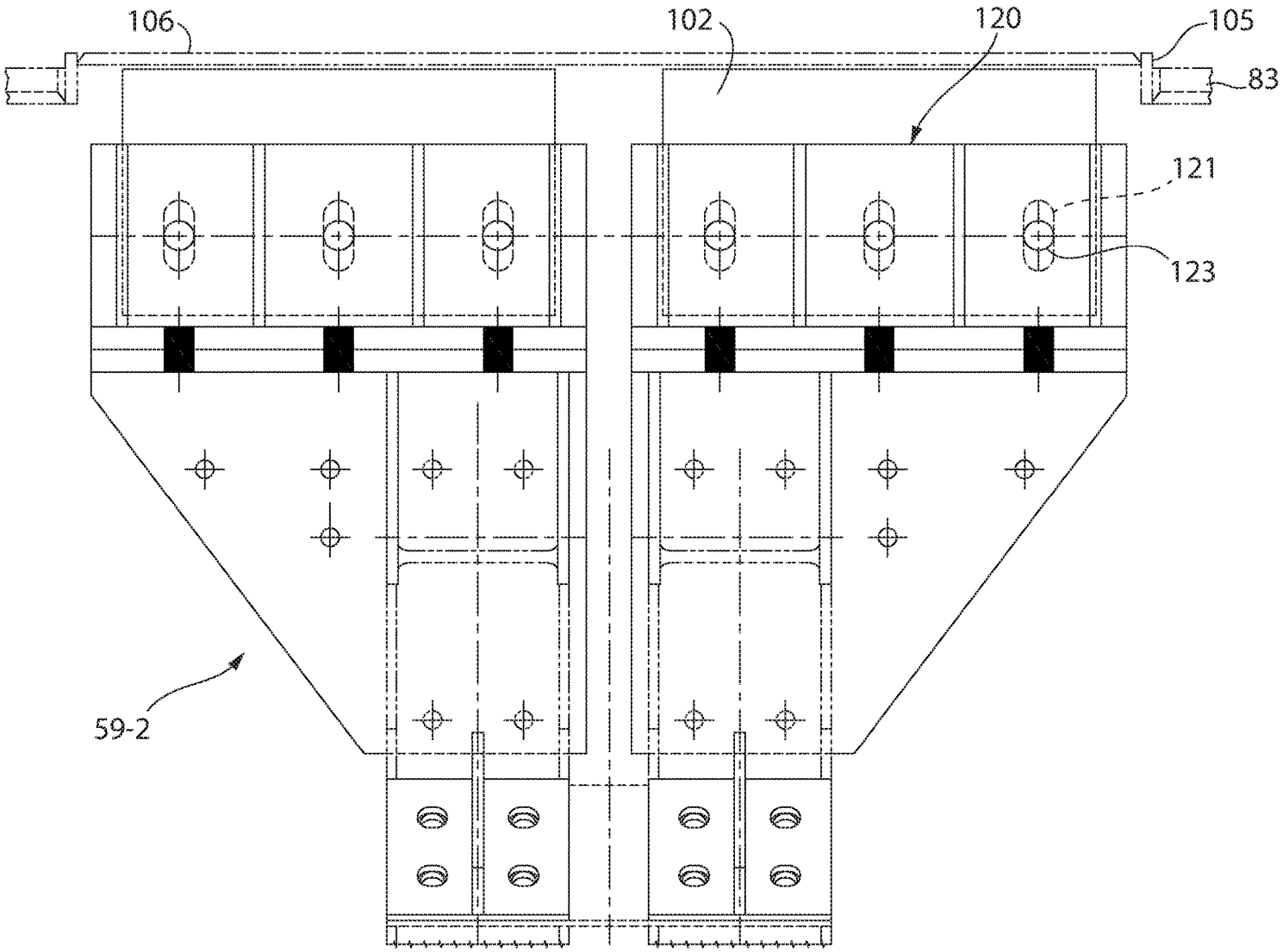
FIG. 21 is a side view thereof.

In one embodiment, the tubes 44 may include heat transfer fins 75 attached to opposing flat sides 76 of the tubes and projecting perpendicularly outwards therefrom in opposing directions, as shown in FIGS. 8 and 9. When the tube bundles 43 are assembled, the fins of one tube 44 preferably are very closely spaced in relation to the fins of an adjoining tube to ensure cooling airflow generated by fan 50 through the tube bundle comes into maximum surface contact with the fins for optimum heat exchange and steam condensing. In other implementations, the tubes may be finless.

Referring generally to FIGS. 2-12, each tube bundle 43 is fluidly coupled to a longitudinally-extending steam flow plenum 80 at top and a respective longitudinally-extending condensate flow plenum 90 at bottom. The steam and condensate flow plenums each forms a transition from the flat upper and lower tubesheets 70, 71 to the arcuately curved sidewalls of the steam and condensate headers 41, 42.

Condensate flow plenum 90 may be generally a rectilinear box-like structure in one embodiment arranged to fluidly couple each tube bundle 43 to a respective condensate header 42 (see, e.g. FIGS. 2-5) on each side of ACC 40. The lower tubesheets 71 are sealably attached or joined (e.g. seal welded) to the condensate flow plenums 90, and form an integral top end portion of the flow plenums 90. Each tube 44 is in fluid communication with the condensate flow plenum interior volume. The bottom end portion of flow plenums 90 penetrate are sealably joined (e.g. seal welded) to condensate headers 42 forming a fluid passageway between the tube bundles and condensate headers. The four sidewalls of the condensate flow plenums are solid and closed to complete the pressure retention boundary of the condensate flow plenums 90. The opposing front and rear lateral sidewalls 90-1, 90-2 may be flat and parallel to each other. In one embodiment best seen in FIG. 3, the top ends of each condensate flow plenum 90 may be laterally offset from the bottom end. Accordingly, the zig-zag shape of the flow plenums 90 (e.g. lateral sidewalls 90-3) create laterally open recesses between the plenums which allow one plenum 90 to at least partially nest within the adjacent condensate flow plenum 90 to facilitate assembling the tube bundles 43 in the field.

Figure 4:
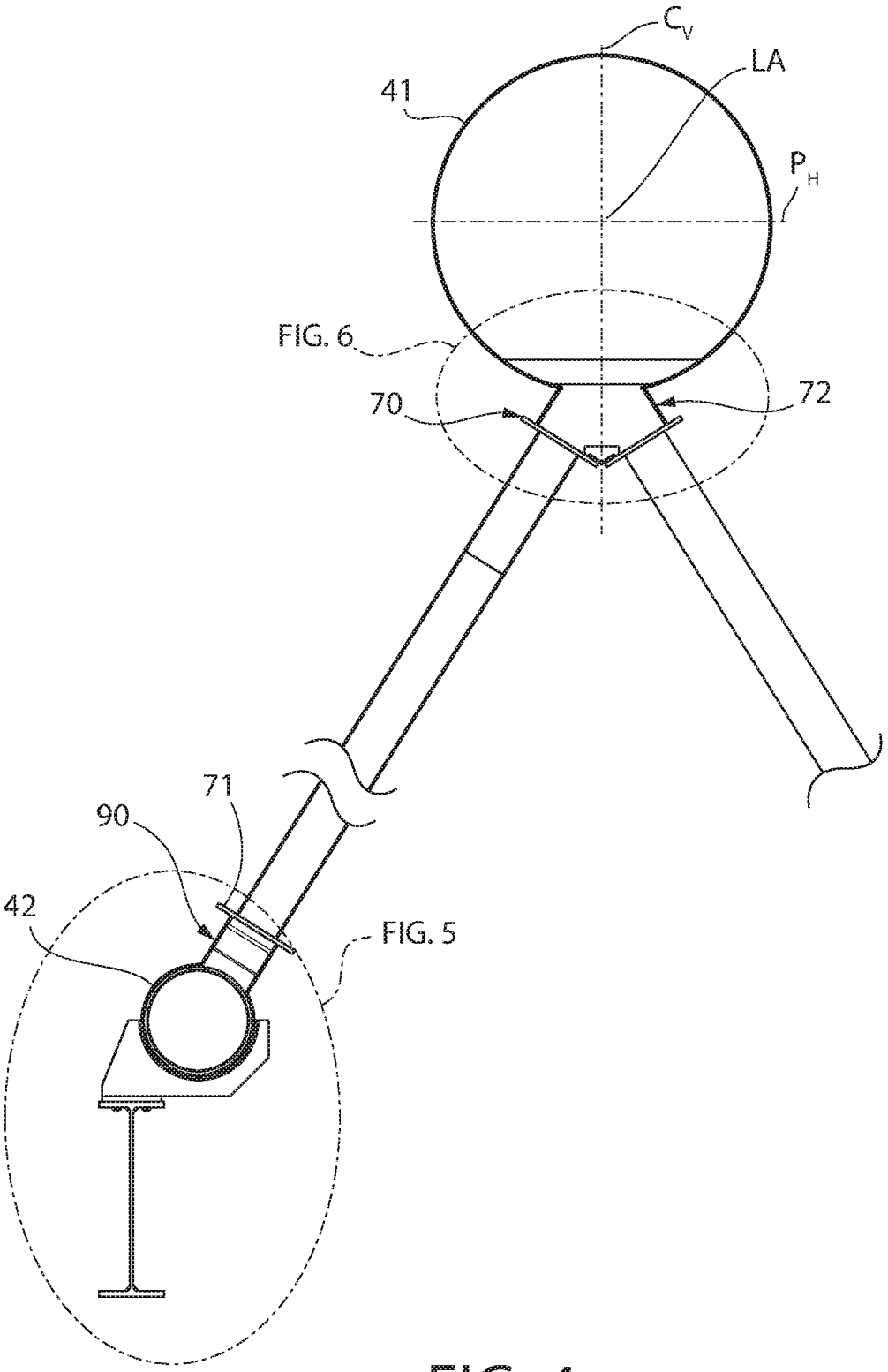
FIG. 4 is a partial end view of the ACC showing the steam and condensate header arrangement.
Figure 6:
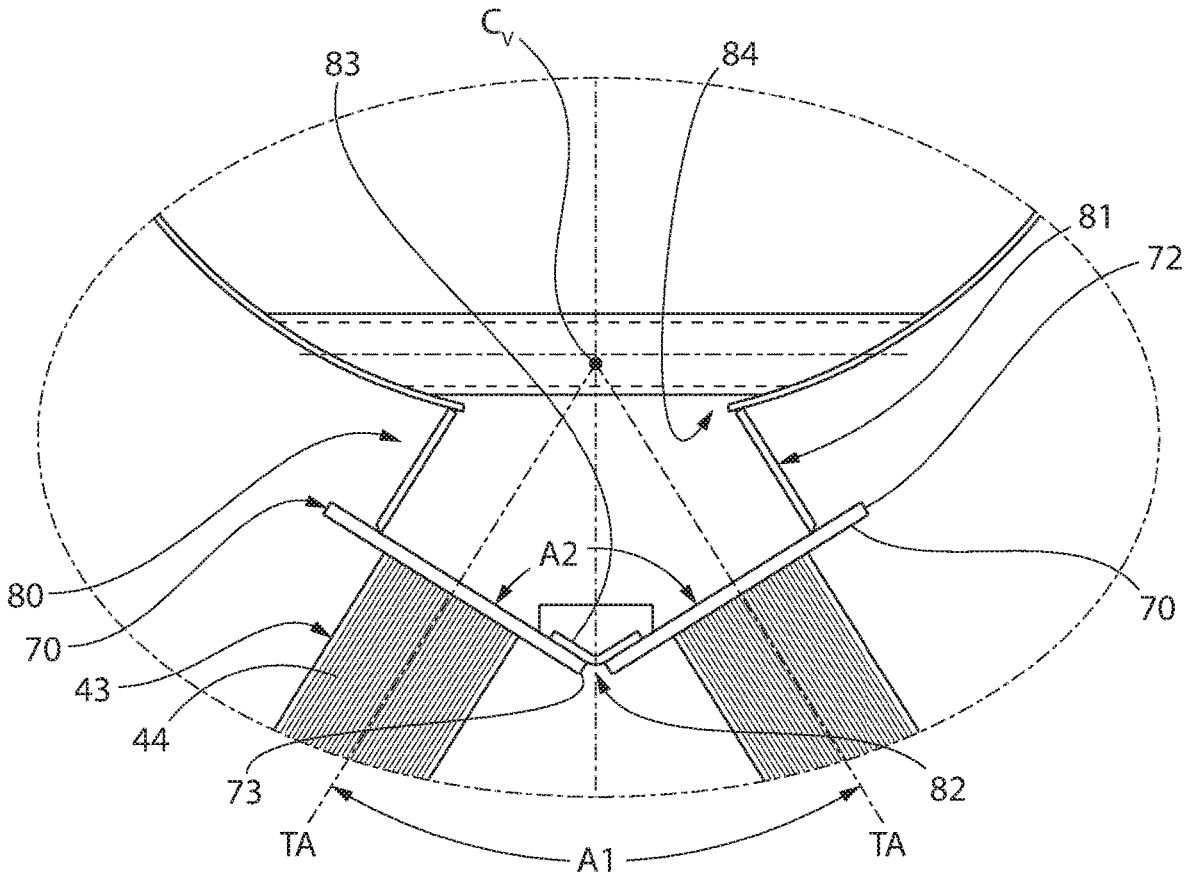
FIG. 6 is an enlarged detail taken from FIG. 4 showing the steam header and its associated plenum.
Figure 7:
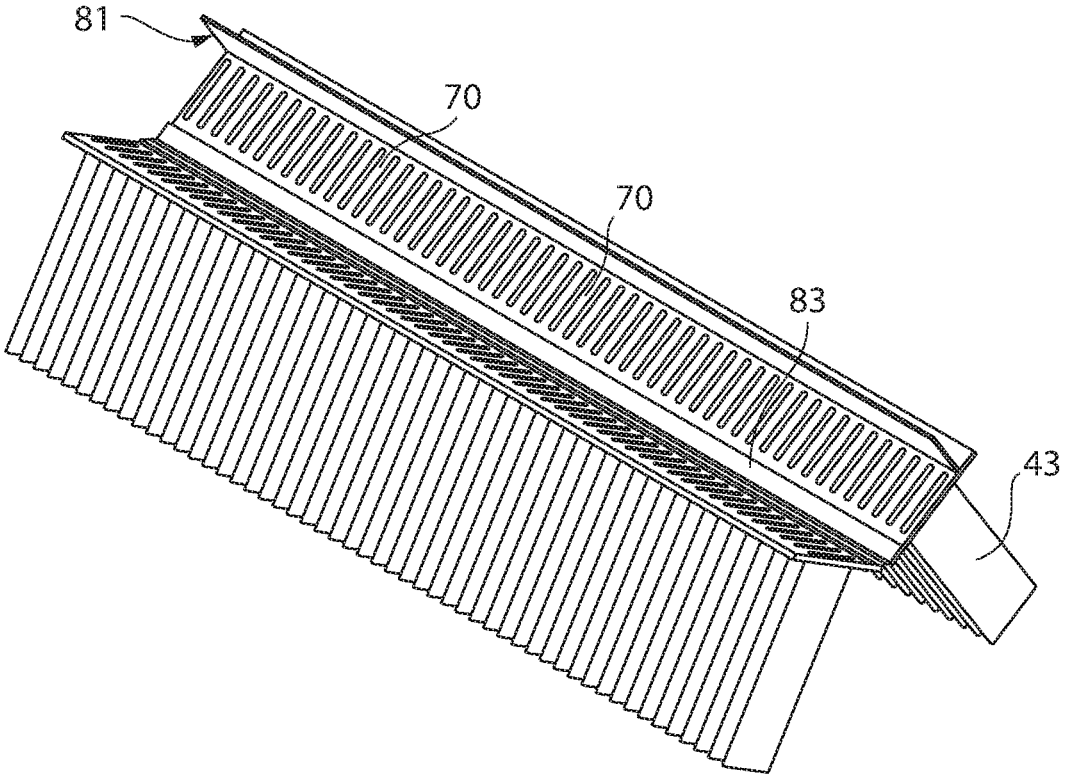
FIG. 7 is a perspective view of the upper portion of the tube bundles showing the upper tubesheet arrangement between the pair of the acutely angled tube bundles and seal plate therebetween.

Referring to FIGS. 2, 4, and 6, steam flow plenum 80 may be a generally rectilinear box-like configuration in one embodiment as illustrated. Plenum 80 is arranged to fluidly couple each tube bundle 43 to the steam header 41. The steam flow plenum comprises an opposing pair of longitudinally-extending side skirt plates 81 seal welded to the steam header 41. Skirt plates 81 extend downwards from the steam header. In one configuration, skirt plates 81 may each be disposed at an acute angle to the vertical centerline Cv of the ACC defined by centerline of the steam header 41. In other possible configurations, the skirt plates 81 may instead be oriented parallel to centerline Cv. The upper tubesheets 70 of each tube bundle are each sealably attached or joined to one of the skirt plates 81 such as via seal welding, thereby forming a longitudinally-extending integral and angled bottom wall at the bottom end of the fluidly sealed steam flow plenum. Each tube 44 is in fluid communication with the steam flow plenum interior volume. The top end portion of flow plenum 80 penetrates and is sealably joined or welded to steam header 41 forming a fluid passageway between the tube bundles and header for introducing steam into the tubes 44.

In one embodiment, steam flow plenum 80 may be a pentagon-shaped in transverse cross section as best shown in FIG. 6. Each upper tubesheet 70 is acutely angled to each other at angle A2 (previously described herein) to define a V-shaped bottom wall of the flow plenum 80. Skirt plates 81 are be oriented perpendicularly to each of their respective tubesheet 70 to which they are seal welded to form the pressure retention boundary. The skirt plates 81 may be attached to each upper tubesheet 70 proximate to the outboard longitudinal edges 72 of the tubesheets.

A longitudinally-extending bottom opening 84 in steam header 41 allows steam entering the header to turn and flow downwards through the opening into the plenum 80. Bottom opening may be continuous along the length of the header 41 or be comprised of intermittent openings spaced axially apart on the bottom of the header.

The inner longitudinal edges 73 of the upper tubesheets 71 may be spaced apart forming a longitudinally-extending open joint 82 between the adjacent tubesheets. In one embodiment, the joint is closed and fluidly sealed by a hinged flexible coupling comprising a resiliently deformable curved or angled metallic seal plate 83 which extends longitudinally along the tubesheets. The angled seal plate 83 has a resiliently flexible monolithic metal body with an elastic memory which provides limited deformation capabilities thus allowing for some degree of transverse expansion/contraction and vertical growth/contraction of the tube bundles 43. The seal plate fluidly and hermetically seals the open joint 82 between the two upper tubesheets 70. Accordingly, seal plate 83 includes opposing and parallel longitudinal edges each of which are sealed welded to one of the upper tubesheets to form a fluidly sealed interface with the steam plenum 80, thereby closing the plenum. Seal plate 83 is a continuous structure having a length coextensive with the longitudinal lengths of the upper tubesheets 70 and joint 82 therebetween to fluidly seal the steam flow plenum 80 at the bottom between the tubesheets. In one embodiment, the seal plate may be a metal structural angle having an obtusely angled configuration in transverse cross section (best shown in FIG. 6). The bottom peripheral edge surface of the seal plate abuts and rests flatly on the tubesheets 70 as shown. The two angled sides of the seal plate are disposed at the same angle A2 to each other as formed between the two tubesheets 70.

Each of the steam and condensate headers 41, 42 may be formed from discrete sections of preferably circular piping for hoop stress resistance in one embodiment having adjoining ends which are abutted together at joints 91. The steam header will be larger than either of the condensate headers. The bottom condensate and the steam headers 42, 41 may be oriented parallel to each other in the illustrated embodiment. The condensate headers 42 in one configuration may be laterally spaced apart on opposite sides of ACC 40.

Each pair of condensate header 42 sections with associate condensate flow plenum 90, steam header section 41 with associated steam flow plenum 80, a first tube bundle 43, and an opposing second tube bundle 43 forming an A-shaped tube bundle structure may be considered to be a discrete cooling cell for condensing steam which may be shop fabricated to allow for tight control of tolerances and fit-up. This construction forms a self-supporting tube bundle structure. The cooling cells may be arrayed and fluidly interconnected in a series forming a linear row of cooling cells. Multiple parallel, perpendicular, or other arrangements of cooling cells may be provided to achieve the required heat transfer surface area of tubes necessary for the cooling duty of the ACC. The joints 91 between headers 41, 42 of adjoining cooling cells are fluidly and sealably coupled together to form contiguous header flow passageways between cells for both steam and condensate flow. The ends of the headers may be coupled together at joints 91 therebetween by any suitable means such as bolted piping flanges, welded piping connections, or combinations thereof. In one embodiment, bolted and gasketed flanges may be used to minimize piping field welds.

In operation on the pressure boundary side of the ACC, steam enters the steam header 41 from the turbine exhaust flowing in a longitudinal direction along axis LA within the header. The steam may enter on end of the contiguous steam header formed from the multiple cooling cells fluidly coupled together at by the steam and condensate headers. The steam cascades along the steam header 41 and flows downwards into the steam flow plenum 80 beneath the header. From the plenum 80, the steam then enters to open top end of each tube 44 in each opposing pair of first and second tube bundles 43 in each cooling cell. The steam condenses and transitions from the vaporous water state to the liquid state ("condensate") as it progressively flows downward inside the tubes. The condensing steam actually may create a partial vacuum region within the tubes, which helps draw steam into the tubes. The heat liberated from the steam is rejected to ambient cooling air blown through the tube bundles 43 by fan 50, which forms the heat sink. The condensate flows into the condensate flow plenums 90 exiting the open bottom ends of the tubes in each bundle. The condensate is collected from the plenums 90 by the condensate headers 42 at the bottom and flows back to the Rankine cycle flow loop 20 previously described herein with respect to FIG. 1.

In one aspect of the invention, a thermal expansion lock or restraint system 100 is provided which both: (1) limits the longitudinal/horizontal growth of the steam header 41 (and in turn associated angularly opposed upper tubesheets 70 and steam flow plenum 80); and (2) limits the vertical growth of the tube bundles 43. The restraint system thus provides a fixed point or expansion stop in the support structure for the pressure retaining components which is referred to herein as a dual purpose "Lock Point" design. The Lock Point design thus limits longitudinal movement or growth of the steam header initially at ambient temperatures in the direction of and parallel to longitudinal axis LA due to thermal expansion when heated by the inflow of higher temperature turbine exhaust steam. The Lock Point design further limits the vertical growth and movement of the tube bundles 43 under thermal expansion when initially heated by the steam flow. The thermal expansion restraint system is designed to allow a controlled degree of growth in the longitudinal direction and vertical direction, then stops the growth at stress levels in the component materials which will avoid cracking or mechanical failure.

In one embodiment, with reference to FIGS. 2, 10, and 13-20, the thermal expansion restraint system 100 with Lock Point design may comprise one or more thermal restraint units 101 each comprising a standalone structural A-frame 59 comprising mating pairs of angled beams 59-1. Beams 59-1 may be I-beams which extend from the vicinity of the upper tubesheets 70/steam flow plenum 80 down to the fan platform 45-1. The angled beams 59-1 may be rigidly and fixedly mounted at bottom to the fan platform 45-1 (e.g. deck plate 51 and/or longitudinal beams 47) via welded and/or bolted connections. The angled beams 59-1 are laterally spaced apart from the tube bundles and may be oriented generally parallel thereto in one embodiment (recognizing slight field installation tolerances).

At top, the beams 59-1 may be coupled together by a structural coupling assembly 59-2 defining an apex of the thermal restraint unit 101. The coupling assembly 59-2 may comprise a plurality of plates, stiffener plates, and gusset plates as shown welded and/or bolted together in a suitable configuration which rigidly secures the top ends of the beams 59-1 to the coupling assembly via bolted and/or welded connections. Any suitable arrangement of the structural elements in the coupling assembly 59-2 may be used to structurally lock and tie the angled beams 59-1 together in a manner which will resist a bending moment in the thermal restraint unit 101 created by the longitudinal growth of the steam header 41. The steam header generally produces the largest longitudinally acting thermal expansion forces which must be counteracted by the thermal restraint unit 101.

In one embodiment, both the vertical and longitudinal restraint features of the thermal expansion restraint system 100 are provided by a vertically oriented fixation member such as fixation keel plate 102 in one embodiment which serves both purposes. The dual duty keel plate 102 is slideably mounted to the top coupling assembly 59-1 of A-frame 59 for limited unidirectional sliding movement in the vertical direction only. However, keel plate 102 is fixed axially in position (horizontal direction) along the longitudinal axis LA to restrain the thermal growth of the steam header 41. This arrangement and dual functionality may be achieved as explained below in one embodiment.

Referring to FIGS. 13-20, keel plate 102 is coupled to and protrudes upwards from and above the structural coupling assembly 59-2. Keel plate 102 may be T-shaped plate in one non-limiting design comprising a horizontal flange 102-1 and vertical flange 102-2 in one embodiment. In one embodiment, keel plate 102 may be a short section of a T-shaped structural beam oriented horizontally. Other shape and types of conventional structural members may be used for keel plate 102 in other embodiments. Vertical flange 102-2 is received between a pair of vertical upstanding guide plates 120 fixedly attached to the coupling assembly 59-2 of the rigid stationary A-frame 59. Guide plates 120 thus also remain stationary when the ACC 40 is heated by steam and do not undergo an substantial thermal expansion caused by direct with the flowing steam.

The combination and sandwiched arrangement of the vertically slideable keel plate 102 and stationary guide plates 120 are configured to provide a vertical expansion joint operable to arrest upwards expansion/growth of the tube bundles 43 affixed to the angled pair of upper tubesheets 70 after providing limited vertical movement. The guide plates 120 include a plurality of guide holes 123 each of which are aligned with a respective mating vertical guide slot 121 formed in the vertical flange 102-2 of keel plate 102. A guide bolt 122 is inserted through each of the mating slots and holes and secured thereto. In one non-limiting example as illustrated, keel plate 102 may include three guide slots 121 recognizing that more or less guide slots may be provided. The purpose of the vertical slots 121 in the keel plate is to allow the tube bundles 43 to grow a limited degree in the vertically direction. The slots 121 provide the vertical expansion stop of the thermal expansion restraint system 100 to limit further vertical tube bundle 43 expansion (noting that the bundles are actually angled in orientation).

Keel plate 102 is seal welded on each side to the angled upper tubesheets 70 for the entire length of the keel plate. In one construction, each opposite longitudinal edge of the horizontal flange 102-1 of the keel plate may be welded to the upper tubesheets 70 via fillet seal welds 102-3 (see, e.g. FIG. 18). This maintains the leak proof construction of the steam flow plenum 80. Notably, this physically locks the keel plate 102 to the upper tubesheets 70 such that the keel plate will move vertically upwards in unison with the tubesheets when the tube bundles 43 grow in length vertically upwards when heated by steam.

The slideable coupling assembly described above between the fixed/stationary guide plates 120 on the A-frame 59 and the keel plate provided by vertical slots 121 in the keel plate allows limited vertical movement of both the keel plate and tube bundles commensurate with the length of the slots. As the tube bundles 43 grow and the rigidly joined assembly of the upper tubesheets 70 and keel plate 102 move upward under thermal expansion, the keel plate will slide upwards along the guide bolts 122 until the bolts bottom out in the slots. Further vertically movement of tube bundles, tubesheets, and keel plate is thus arrested. This represents the vertical restraint feature or expansion stop.

The longitudinal restraint feature or expansion stop also involves the keel plate 102 as well, as alluded to above. Keel plate 102 represents a longitudinally stationary part of the thermal restraint unit 101 which is fixed in longitudinal/horizontal position along the longitudinal axis LA via the guide assembly of vertical guide slots 121, guide bolts 122, and guide holes 123 in the guide plates 120. The vertical slots of course do not permit longitudinal/horizontal movement of the keel plate 102 relative to the stationary guide plates 120 on the structural coupling assembly 59-2 of the A-frame 59, thereby fixedly mounting the keel plate to the structural A-frame 59 of thermal restraint unit 101 in axial position along the longitudinal axis. Because the upper tubesheets 70 are fixedly coupled to the steam flow plenum 80, which in turn is fixedly coupled to the steam header 41, the fixation keel plate 102 which is fixedly welded to upper tubesheets 70 locks the steam header in axial position along the longitudinal axis LA. Since the thermal restraint unit 101 is unaffected by whether the ACC is in the hot operating condition receiving steam or cold shutdown condition, the keel beam 102 will always maintain the same axial (longitudinal) position as the A-frame 59 which is rigidly mounted to the fan platform.

To prevent interaction of the fixation keel plate 102 with the steam flow plenum 80, the keel plate protrudes upwards from coupling assembly 59-2 into a downwardly open receptacle 103 formed in a boxed-out portion at the bottom of steam flow plenum. The top keel plate horizontal flange 102-1 may be disposed inside the receptacle along with the upper portion of vertical flange 102-2. The boxed-out portion of the steam flow plenum 80 may be formed by a polygonal shaped seal box 107 comprising a pair of laterally/transversely spaced apart longitudinal sidewalls 104, an opposing pair of end walls 105, and a top wall 106 extending between the sidewalls and end walls which closes the top of the box. The sidewalls, end walls, and top wall of seal box 107 are sealed welded together, and in turn the seal box is seal welded to the seal plate 83 and each of the upper tubesheets 70 forming a fluid-tight sealed receptacle 103. The seal plate 83, in specific, may be welded to the exterior surface of each end wall 105 of the seal box.

The end walls 105 of seal box 107 define a pair of opposing interior surfaces 109 vertically oriented and facing inwards towards the receptacle 103. The ends of the keel plates 102 define corresponding end surfaces 108 which remain spaced apart from the interior surfaces 108 of end walls 105 which the seal box 107 moves longitudinally with the steam header 41 under thermal expansion when the ACC 40 is heated by receiving steam.

In operation of the thermal expansion restraint system 100 with respect to longitudinal growth of the steam header 41, the fixation keel plate 102 does not come into any or at least substantial contact with the seal box 107 (i.e. sidewalls, end walls, or top wall) within the receptacle 103 when the pressure retention components described above are in their cold condition in the absence of steam flow to the ACC (i.e. not subjected to thermal expansion). In the cold condition, the seal box end walls 105 are longitudinally spaced apart from the keel plate end surfaces 108 (see, e.g. FIG. 16). When steam flow is initiated through and heats the steam header 41, steam flow plenum 80, and upper tubesheets 70 during normal operation of the ACC, these flow components will grow longitudinally due to thermal expansion of these metal components. This causes the tube structure to grow and expand longitudinally in length. This expansion causes the seal box 107 with end walls 105 to move and shift in longitudinal axial position relative to the keel plate 102 of the thermal restraint. However, the keel plate 102 restrains and locks the upper tubesheet 70 and steam header 41 coupled thereto in axial position along the longitudinal axis LA. This prevents the stationary keel plate end surface 108 from engaging the interior surfaces 109 of the seal box end walls 105, thereby maintaining a spaced apart relationship. Seal box 107 has a sufficient length to prevent engagement with the fixation keel plate 102 when the steam header 41 is either in a linear contracted cold or expanded hot position.

In a preferred embodiment, it is significant to note that the A-frame 59 of thermal restraint unit 101 is a self-supporting and free-standing structure which does not engage any structure or pressure retention component above the fan deck plate 5 lwhere the A-frame is fixedly mounted to the fan support frame 45. Accordingly, the A-frame 59 comprising the angled beams 59-1 and coupling assembly 59-2 of each thermal restraint unit 101 are unconnected to and do not engage any portion of the tube bundles 43, upper and lower tubesheets 70, 71, steam and condensate headers 41, 42, or steam and condensate flow plenums 80, 90 either directly or indirectly via intermediate structural elements. Particularly, it bears noting that tube bundles 43 receive no support whatsoever from the angled beams 59-1 and are spatially separated therefrom by a physical gap G1 (see, e.g. FIGS. 10 and 14). Each thermal restraint unit 101 is therefore structurally a standalone and independent structure for thermal expansion restraint purposes only in the preferred embodiment which is nested inside and beneath the tube bundles 43 and headers 41, 42 as shown. Accordingly, the tube bundles 43 and headers 41, 42 form parts of an A-shaped "tube structure" which is independently self-supporting from the thermal restraint A-frame 59 such that the tube bundles are unsupported by the angled beams 59-1, or any portion of the fan support frame 45 between the upper and lower tubesheets 70, 71 above the fan deck plate 51.

A plurality of thermal restraint units 101 may be provided for each cooling cell (which comprises the components shown in FIG. 2 et al.). For example, in the non-limiting illustrated embodiment, a pair of thermal restraint units 101 may be provided. The units may be closely spaced apart and proximate to each other and share a common axially elongated receptacle 103 into which keel plates 102 from each thermal restraint unit 101 is received (best shown in FIG. 16). For a series of cooling cells or units each comprising an assembly of steam headers 41, condensate header 42, and tube bundles 43 generally shown in FIG. 2, a single Lock Point thermal expansion restraint system 100 may be provided preferably towards the center of the longitudinally-extending trains of cooling cells with axially and fluidly interconnected steam headers 41 joined together in a contiguous concatenated or series fashion. This causes the steam headers to grow in two opposing directions from the Lock Point once the longitudinal growth of the steam header has been arrested by the thermal expansion restraint system 100. This type of bi-directional thermal expansion control arrangement is preferred over allowing a completely unrestrained and long steam contiguous header assembly to simply grow in a single direction over a significantly greater length at the free end.

Other arrangements and spacings of thermal restraint units may be provided in other implementations.

According to another aspect, the ACC 40 may also include a longitudinally-extending overhead trolley monorail 55 which provides support for a wheeled trolley hoist (not shown) to facilitate maintenance on the fan for lifting and maneuvering the motor and gear box. Monorail 55 is spaced and mounted above the fan 50 as shown. In one embodiment, the monorail 55 may be suspended overhead and supported by a plurality of vertical support hangers 58 spaced intermittently along the monorail. In one embodiment, the hangers 58 may comprises structural angles attached to the angle seal plate 83 at top and monorail 55 at bottom such as via welding or bolted connections.

Induced Draft Air-Cooled Condenser System

FIGS. 22-46 depict an embodiment of an induced draft air-cooled condenser system which may be used in the Rankine cycle flow loop 20 of the thermal electric power generation plant shown in FIG. 1 lieu of the forced draft air-cooled condenser system previously described herein. In this arrangement, ambient cooling air is drawn through the tube bundles as opposed to be forced and blown through by the fan 50.

A conventional induced draft air-cooled condenser draws the ambient cooling air from across the planform of the inclined tube bundles. The fan/motor assembly is positioned above the elevated V-shaped tube bundles such that the incoming air is distributed as uniformly across the finned tube bundles' surfaces as possible. The V-shaped structures, formed by the tube bundles, which are made up of an array of slender obround tubes, have limited in-plane structural strength and as such, have not been historically relied on to render a structural function. In addition to the self-weight of the bundles themselves, the dead weight of the fan/motor/gearbox assembly, the steam distribution header, decks/walkways and the like are additional overhead commodities that need to be supported under normal, abnormal, and accident event conditions (such as the power generation plant site's Design Basis Earthquake, high wind, and other extreme environmental phenomena. To contend with these loads, the traditional design used heretofore requires a network of beams and trusses to support the tube bundles, which tend to interfere with air flow thereby reducing heat exchange efficiency and requiring extensive on-site construction work. A typical induced draft air-cooled condenser system is so rich in structural members that the cost of erecting the system often outweighs the hardware cost.

The induced draft air-cooled condenser design disclosed herein seeks to minimize the turnkey cost of the ACC system while also overcoming the above shortcomings of convention designs. The unique structural support arrangement and features disclosed herein advantageously reduces the amount of superstructure beams/trusses required and contributes to enhanced heat exchange efficiency by not substantially blocking the cooling air flow through the inclined tube bundles. The present air-cooled condenser design permits assembly methods disclosed herein which allow the heavy components to be efficiently and conveniently assembled at ground level, and then simply lifted into position by construction vehicles/equipment on site (e.g. cranes, hoists, etc.). This minimizes the need for workers to assembly many structural components at elevated levels or heights, thereby reducing in installation costs and enhancing safety.

A number of components of the present induced draft air-cooled condenser are similar to those already described herein for the forced draft air-cooled condenser 40. The arrangement within the cooling cell may be different however. For the sake of brevity, the components of the induced draft air-cooled condenser will therefore be designated with "1000" series numerical references in the drawings and written description recognizing that the component design is similar to those previously described herein unless differences are specifically noted. New and/or different components added will be designated with "1100" series numerical references.

Referring generally to FIGS. 22-46, the present induced draft air-cooled condenser system 1030 according to the present disclosure comprising air-cooled condenser (ACC) 1040 is fluidly coupled to the Rankine cycle flow loop 20 of FIG. 1 in a steam condensing application in one embodiment. The ACC disclosed herein however may be used in other heat transfer applications. Similarly to the force draft ACC 40 previously described herein, the induced draft ACC 1040 shown in FIG. 22 comprises a plurality or array of discrete cooling cells 1040A which may be fluidly and physically coupled together in a similar manner to the cooling cells of the force draft ACC 40 previously described herein. The number of cooling cells required in the array will be dependent upon the steam condensing heat load requirements and ambient site conditions with respect to available cooling air and its temperature. The steam condensing closed flow loop 31 (see also FIG. 1) provides steam to ACC 1040 from the low pressure section of the steam turbine 24 via steam piping 1131A which may include branched sections or manifolds.

Figure 23:
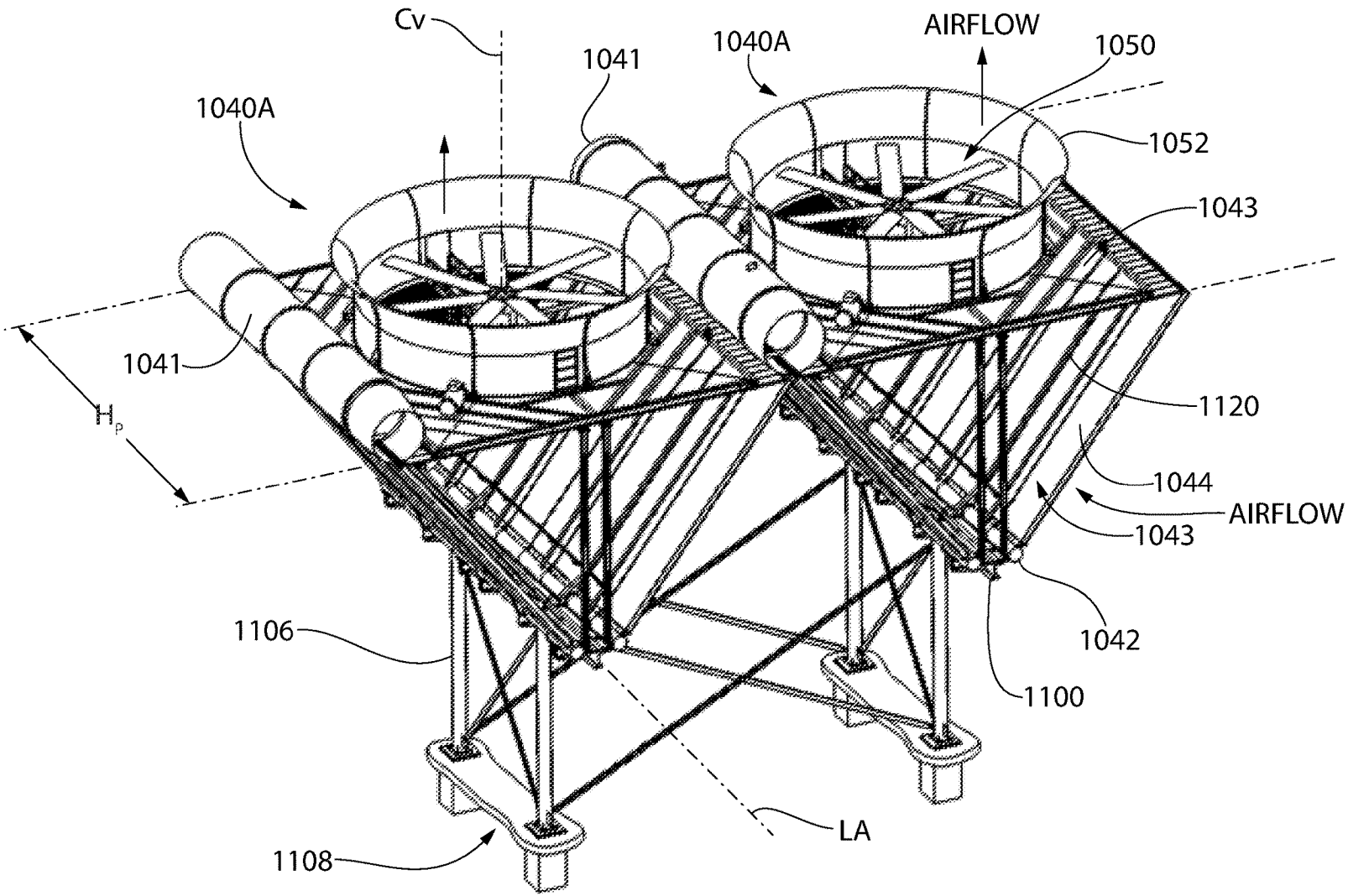
FIG. 23 is a perspective view of a pair of coupled cooling cells thereof.

FIG. 23 shows a structurally coupled pair of lateral adjacent cooling cells 1040A. Each cooling cell 1040A of the ACC 1040 generally comprises a pair of laterally spaced substantially parallel steam headers 1041 at the top of the cooling cell 1040A, a pair of laterally spaced parallel bottom condensate headers 1042 at the bottom of the cooling cell, and at least one pair of inclined/angled tube panels or bundles 1043 of generally planar configuration extending between the steam and condensate headers and forming a V-shaped frame structure. Each tube bundle comprises a plurality of obround or rectangular tubes 1044 similar to tubes 44 previously described herein. A plurality of longitudinally arranged tube bundles may be provided on each side of the "V" as shown in the figures.

The steam and condensate headers may be cylindrical and are arranged substantially parallel to each other. The term "substantially" used in this context and within this disclose recognizes that slight installation variations/deviations in alignment and position naturally occurs in the final assembled ACC during field erection of the superstructure and foregoing flow components. One steam header 1041 may be larger than the other and forms a common steam header shared with the laterally adjacent cooling cell 1040A (see, e.g. FIG. 22). The larger diameter shared common steam header 1041 between adjacent cells provides enough flow capacity to deliver steam from the generating plant to one tube bundle 1043 of each adjacent cell. This provided an efficient arranged and reduced capital component costs. In other possible embodiments, however, each cooling cell may have its own pair of steam headers fluidly isolated from those of an adjacent cell.

Figure 22:
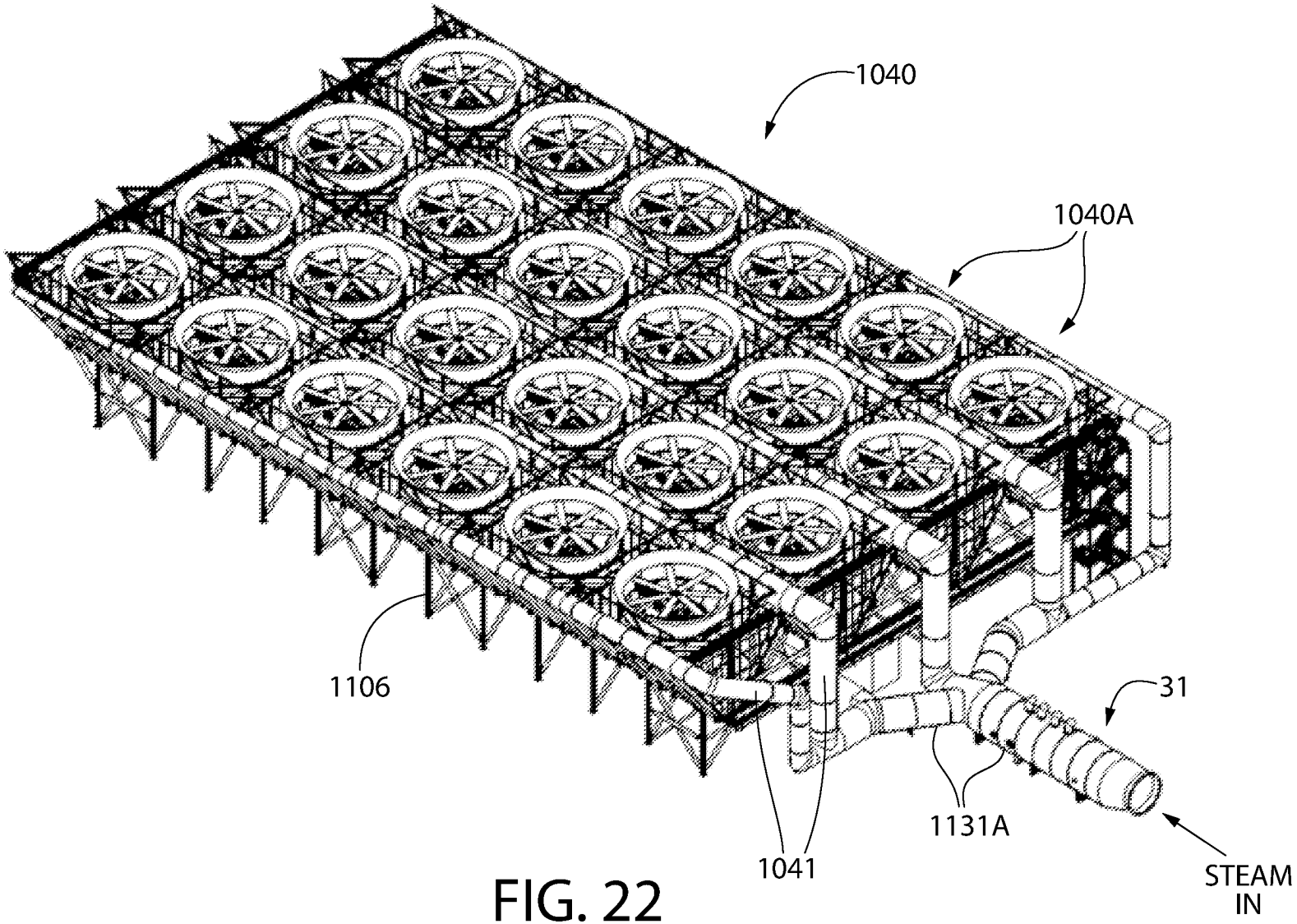
FIG. 22 is a perspective view of an induced draft air-cooled condenser (ACC) comprising an array of cooling cells according to the present disclosure.

It bear noting that each of the laterally cooling cells 1040A shown in FIG. 22 would be fluidly coupled to a longitudinally adjacent cell such that the steam and condensate headers would be fluidly coupled together in the longitudinal direction to form continuous linear flow passageways or conduits, in a manner similar to forced draft ACC 40 described above.

For convenience of description and reference, each ACC cooling cell 1040A of ACC 1040 includes a longitudinal axis LA which may be defined as passing through the vertical geometric centerline of the main beam 1100 of the ACC (see, e.g. FIGS. 23-24 and further described below) and parallel to the steam headers 1041 and condensate headers 1042. This also defines a corresponding axial direction which may be referred to herein. The term "lateral" as used herein indicates a direction or position transverse to one side or the other of the longitudinal axis in a horizontal direction. However, "transverse" broadly means a direction perpendicular to the longitudinal axis in any direction horizontal, vertical, or at an angle therebetween. A vertical centerline Cv of the ACC 1040 may be is defined by the vertical centerline of the fan shaft and intersects the longitudinal axis LA in one arrangement (see, e.g. FIG. 23). The fan deck 1051 defines a horizontal reference plane Hp which intersects the vertical centerline Cv and longitudinal axis LA. The longitudinal axis, vertical centerline, and horizontal reference plane define a convenient reference system for describing various aspect of ACC 1040 and their relationship to one another.

The support structure of each ACC cooling cell 1040A which comprises an assembly of structural elements that support the foregoing fluid components (e.g. steam headers, condensate headers, and tube bundles) includes longitudinally-extending main beam 1100 which forms the structural spine of the cell, a plurality of transversely orientated and laterally elongated condensate header support beams 1102, and a longitudinally-extending bottom walkway platform 1104 supported by the main beam and/or header support beams. The condensate header support beams 1102 are longitudinally spaced apart as shown which structurally may be viewed as forming the ribs coupled to the main beam spine. The main beam 1100 may be vertically aligned with and intersects the vertical centerline Cv of cell. Each main beam of the cells rests on and is supported in turn by a plurality of longitudinally spaced apart structural columns 1106. In some embodiments, the columns may comprise a steel outer pipe 1106A filled with an inner core 1106B of concrete. In other embodiments, a variety of commercially available structural steel shapes (e.g. wide flange I-beams, etc.) may be used. The main beam 1100 may be mounted to the tops of the columns on site via bolting or welding. In one non-limiting embodiment, two columns 1106 may be used to support the main beam 1100; however, more than two columns may be used as needed depending on the longitudinal length of the cooling cell and main beam, and dead weight loads imposed on the main beam by the fan, headers, tube bundles, structural members, various other appurtenances, etc. above which may be provided. The main beam transfers all these loads to the columns which are supported on concrete foundation 1108 of suitable design and configuration. The columns 1106 may be laterally braced by diagonal cross-bracing struts 1110 as shown in FIG. 22.

Figure 24:
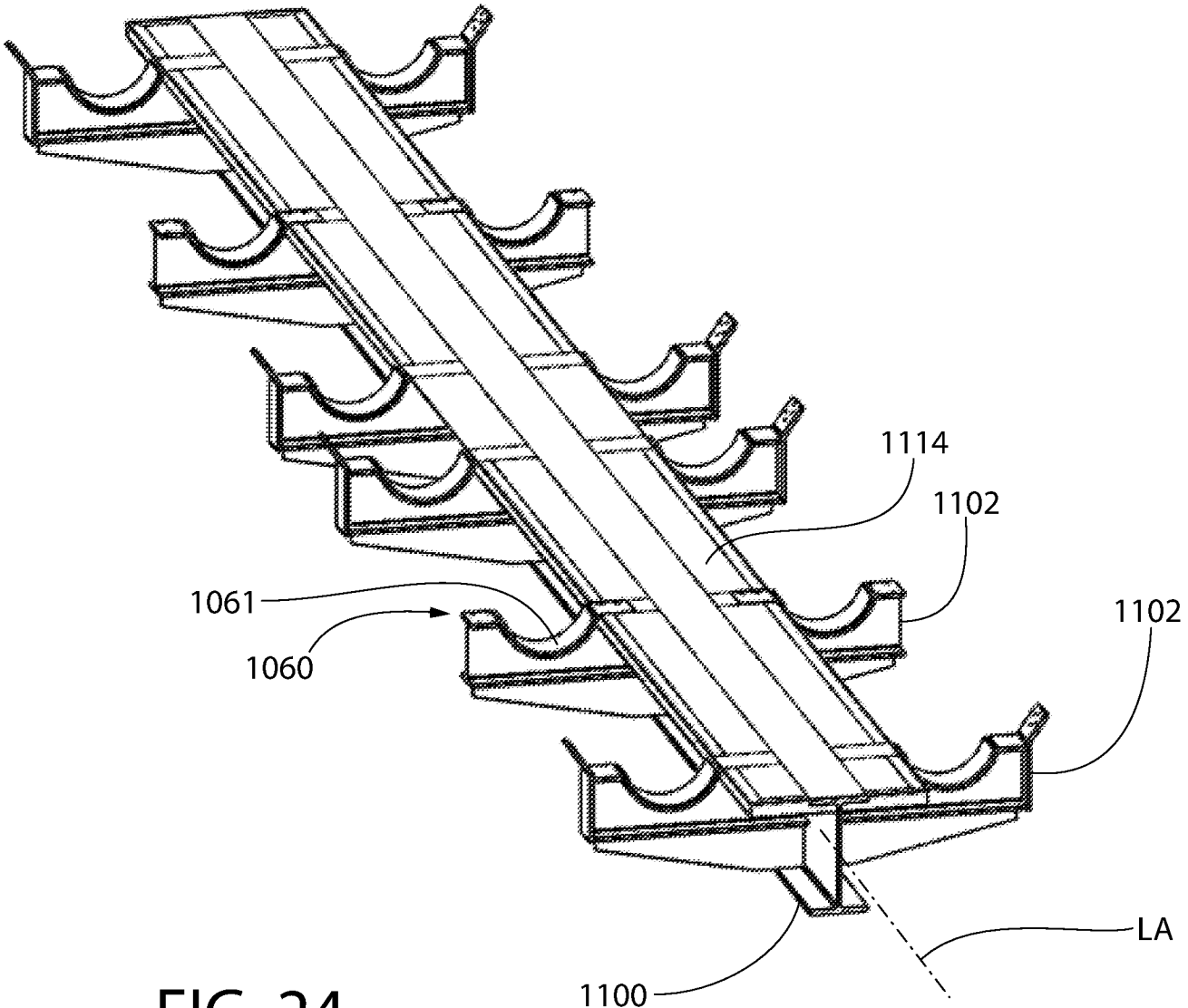
FIG. 24 is a perspective view of a main beam and condensate header support beams assembly of the ACC.

The condensate header support beams 1102 effectively create a continuous beam that straddles the structural main beam 1100 of the cooling cell 1040A to facilitate separate manufacturing, galvanizing, and bolt up assembly of the condensate support saddle structures at the plant site. Each condensate header support beam 1102 may be transversely centered on and welded/bolted to the main beam 1100 as best shown in FIG. 24. The condensate header support beam 1102 may be considered to have a generally pentagon shape (see, e.g. FIGS. 24 and 26). Main beam 1100 may be a wide flange I-beam in one embodiment; however, other suitable structural shapes may be used. The condensate header support beams 1102 at each location may include mirror image right and left lateral sections which are welded/bolted to the main beam therebetween as shown.

Condensate header support beam 1102 includes a pair of integral saddle supports 1060 of slightly different configuration than saddle supports 60 previously described herein. One saddle support is located on each side of main beam 1100 and spaced laterally apart therefrom by a distance. Each saddle support 1060 has a radius which defines an generally upward facing concave support surface 1061 configured to complement the diameter of the condensate headers 1042 such that the headers are seated on and abuttingly engaged with the support surfaces. The saddle supports 1060 may be formed of steel plate of suitable thickness and longitudinal width rolled to match the diameter of the condensate headers. In one non-limiting example, the saddle support plates may be about 1 inch thick and 12 inches in longitudinal width to support the headers. Condensate headers 1042 may optionally include semi-circular wear plates 62 previously described herein (see, e.g. FIG. 5). The saddle supports 1060 function in the same manner as saddle supports 60 to allow the condensate headers to thermally grow or shrink longitudinally by sliding along the supports without being axially restrained. This prevents thermal expansion stress-induced cracking of the headers. The main beam 1100 and condensate header support beams 1102 support a longitudinally-extending flat walkway 1114 which may be formed by one or more sections of steel plating. This provides access to the condensate header support beams 1102 and inside surfaces of the tube bundles and tubes for use during erection of ACC 1040 and for maintenance and inspection.

As noted above, the fluid pressure boundary components of ACC 1040 (headers and tubes) are similar to ACC 40 previously described herein albeit arranged differently and will therefore not be discussed in great detail for sake of brevity. Referring with general initial reference to FIGS. 32-39, the straight tubes 1044 of each tube bundle 1043 are fluidly coupled to a flat longitudinally-extending upper tubesheet 1070 at top and a respective flat longitudinally-extending lower tubesheet 1071 at bottom forming part of the condensate flow plenum 1090 coupled directly to each condensate header 1042. The tube bundles 43 in one embodiment may be shop-manufactured straight and generally planar/flat tube bundles each comprised of closely spaced apart parallel tubes 1044 aligned in a single linear row and arranged in a single plane. Tubes 1044 may have an obround or rectangular cross section (see, e.g. FIGS. 8 and 9). The tubesheets 1070, 1071 contain a plurality of tube penetrations or openings for allowing steam or condensate to flow into and out of the tubes 1044 on the open interior tube side of the tubes which define flow passageways. The tube ends may similarly be fixedly coupled to the tubesheets in a leak-proof manner by being seal welded, brazed, or expanded (e.g. hydraulically or explosively) to the tubesheets to form fluidly sealed connections. The tubesheets 1070, 1071 may flat in one embodiment and formed of straight metallic plates.

Figure 30:
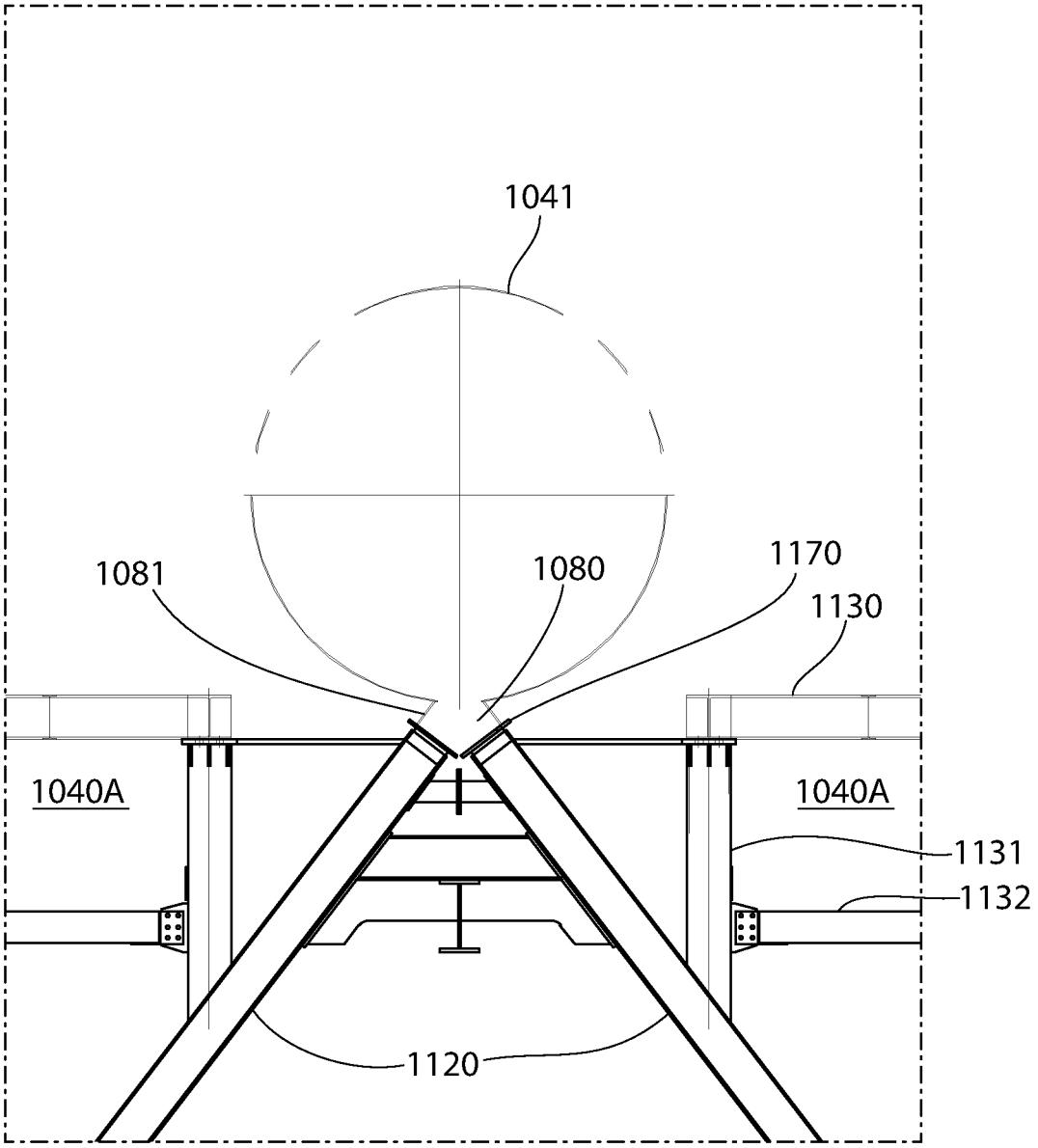
FIG. 30 is a front view of a steam header and deflection limiter beams.
Figure 31:
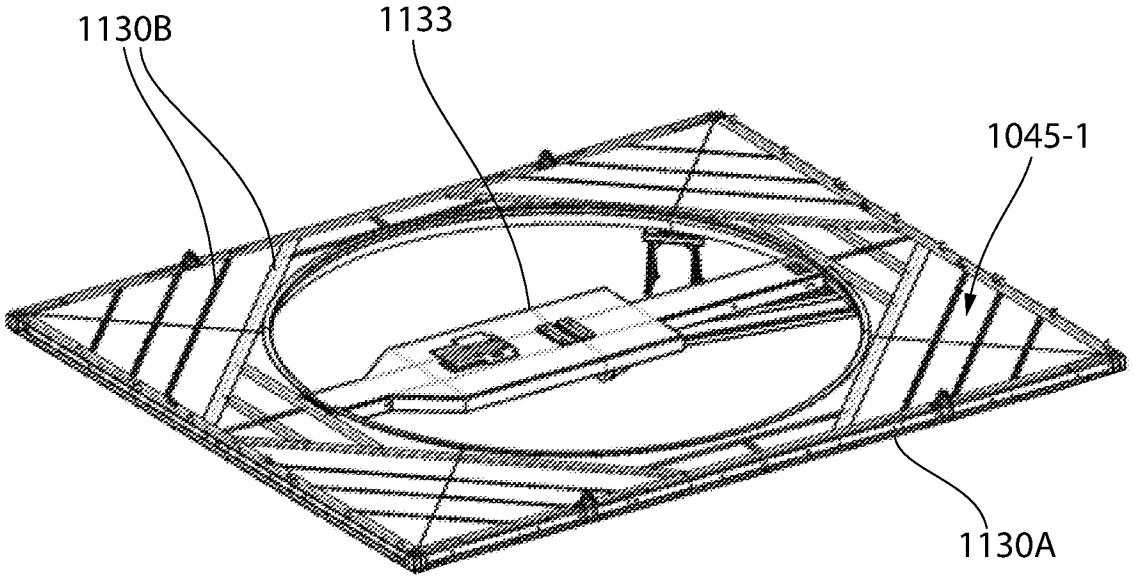
FIG. 31 is a perspective view of the fan deck and fan support bridge of the ACC.
Figure 32:
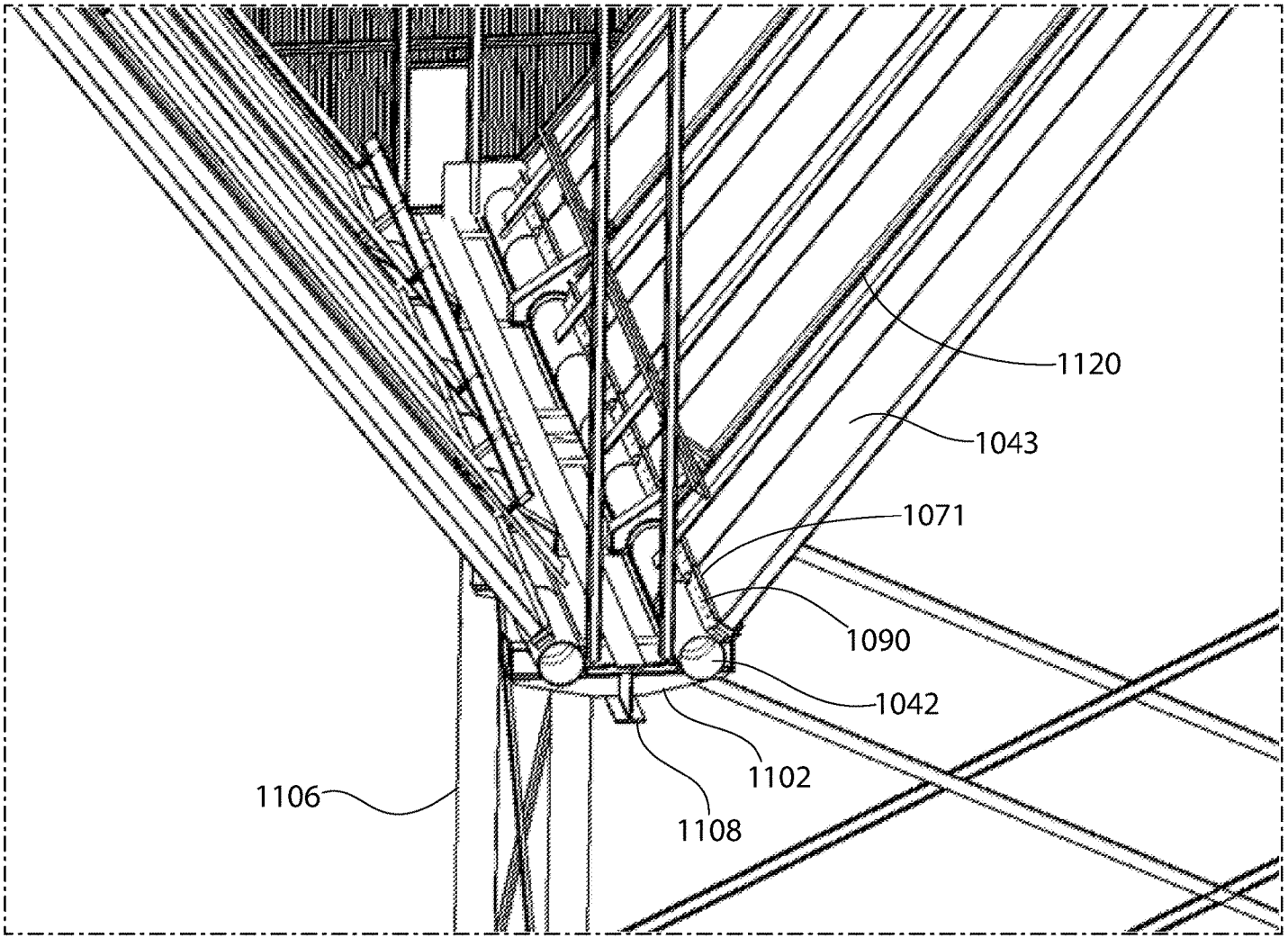
FIG. 32 is a perspective view of the lower portion of the tube bundles and condensate headers.
Figure 33:
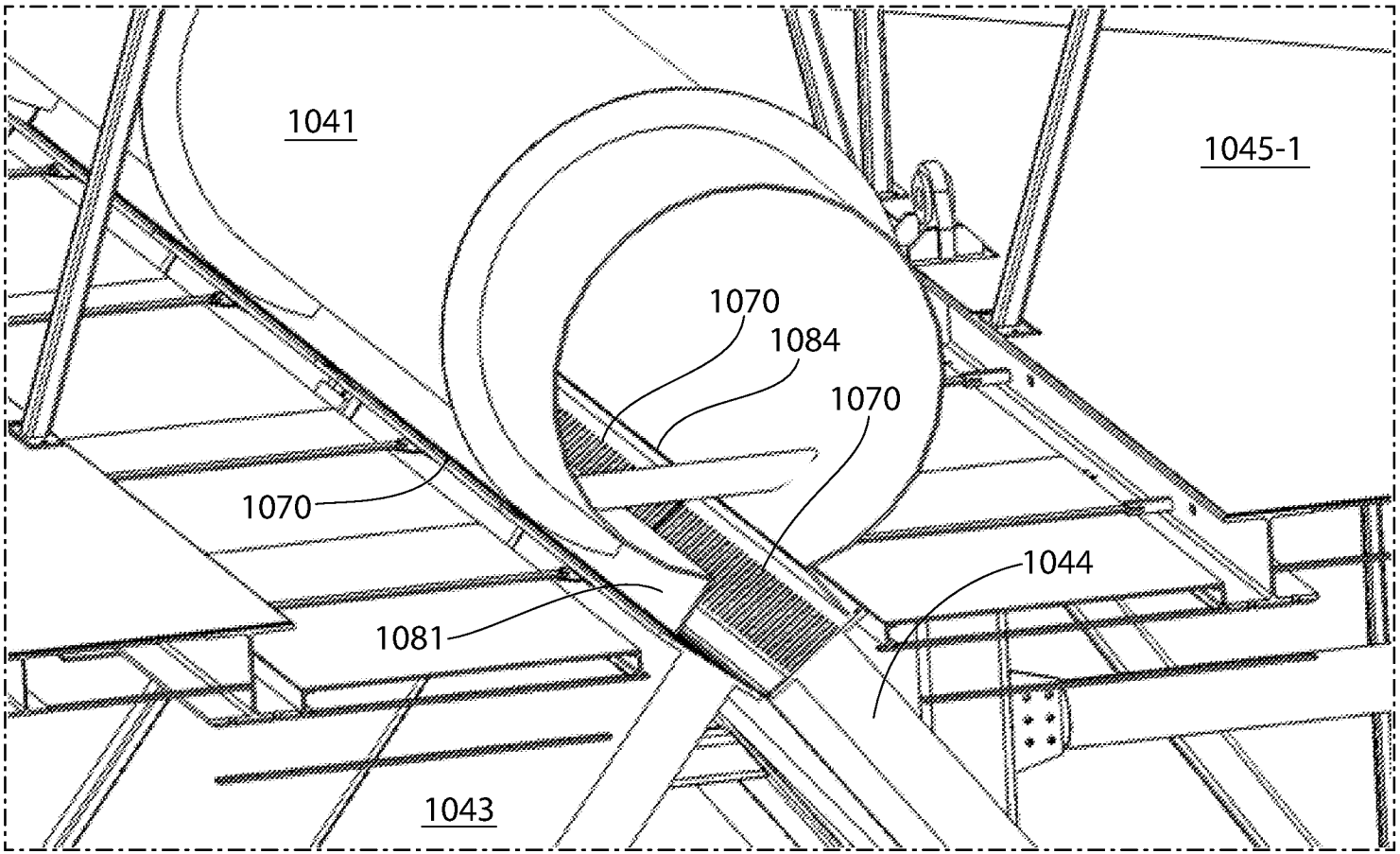
FIG. 33 is a perspective view of the upper portion of the tube bundles and one of the pair of steam headers.
Figure 34:
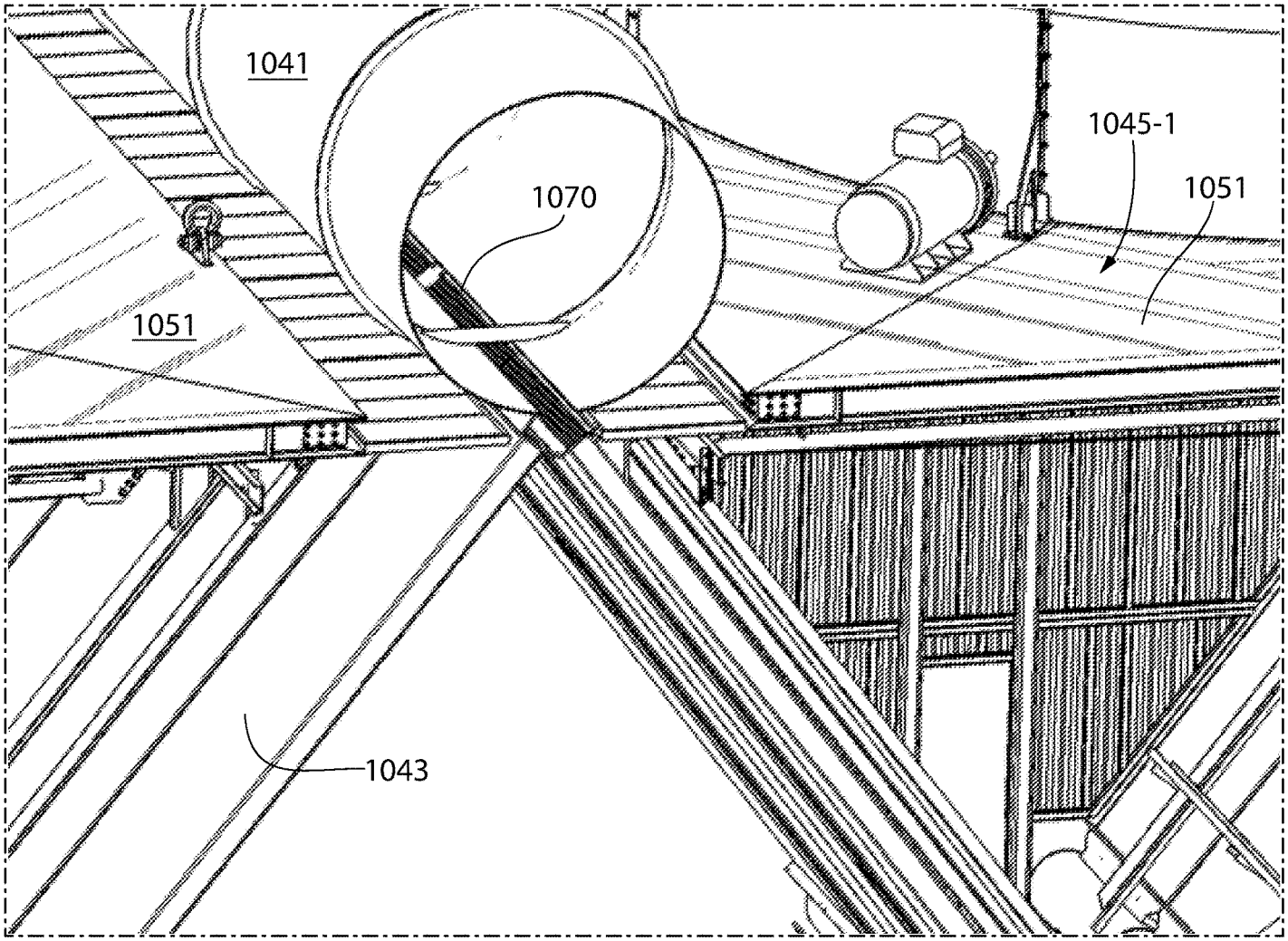
FIG. 34 is another perspective view thereof.

In one embodiment, the tubes 1044 may include heat transfer fins 75 attached to opposing flat sides 76 of the tubes and projecting perpendicularly outwards therefrom in opposing directions, as shown in FIGS. 8 and 9. When the tube bundles 1043 are assembled, the fins of one tube 1044 preferably are very closely spaced in relation to the fins of an adjoining tube to ensure cooling airflow generated by fan 1050 through the tube bundle comes into maximum surface contact with the fins for optimum heat exchange and steam condensing. In other implementations, the tubes may be finless.

Where a common steam header 1041 is shared between two laterally adjacent cooling cells 1040A (see, e.g. FIGS. 30 and 33-34, the upper tubesheets 1070 are arranged in a converging V-pattern. The common steam header 1041 has a corresponding pair of laterally spaced and longitudinally-extending skirt plates 1081 arranged in a converging inverted V-pattern similarly to steam header 41 previously described herein (see also FIG. 17). This forms a perpendicular interface between the skirt plates and tubesheets which are seal welded or brazed to form a leak resistant seal. The mating lower longitudinal edges between the adjoining upper tubesheets 1070 of each cell may be sealed via seal welding or brazing, or the use of sealing members of suitable design. Where the outermost side cooling cells 1040A are located, the skirt plates 1081 may be oriented parallel to each other and sealed to the single upper tubesheet 1070 (see, e.g. FIG. 29) in a similar manner. Each steam header 1041 includes longitudinally-extending bottom opening 1084 which allow the steam to enter the upper flow plenum and enter the tube openings in a manner similar to steam header 41 previously described herein (see also FIG. 6).

ACC 1040 further includes a plurality of Deflection Limiter Beams (DLBs) 1120. In one embodiment, the DLB s may each be wide flange I-beams; however, other structural beam shape may be used. Each DLB is a beam that is essentially coplanar with the plane of the tube bundles 1043 and located between longitudinally adjacent bundles on each side of the "V". The DLB s are intentionally designed to be slightly shorter than the bundles such that it will not actively engage and carry any load unless the bundles deflects. It is known from the theory of buckling of columns that because of the long aspect ratio of the tube bundles, they will elastically buckle before reaching the material compressive strength. Elastic buckling means the tube bundle will revert to its planar (undeformed) configuration when the axial load is withdrawn. Thus, when subjected to excessive axial loads, the tube bundles will bow and deflect out-of-plane slightly at which point the DLB s will be engaged, thereby advantageously preventing further deflection which might structurally damage the tube bundles. Each DLB is sized to carry the axial load in the bundles without excessive compressive stress levels. Because the DLB is axially uncoupled from the tube bundle, there is no risk of restraint of thermal expansion of the tube bundle as it receives hot steam from the steam turbine.

In order to permit thermal expansion or shrinkage of the tube bundles 1043 formed by grouped tubes 1044 as previously described herein, a sliding interface is formed between the tube bundles and longitudinally adjacent DLB s interspersed periodically therebetween. Referring particularly to FIGS. 36-39, in one embodiment each DLB 1120 includes an associated floating cap 1145. The caps may be rigidly welded on opposing sides to the upper tubesheet 1170 via a weld joint 1146. The floating caps may be rectilinear (e.g. square or rectangular) in configuration and the weld joints may be linear (see, e.g. FIG. 36). Each floating cap 1145 defines a downward open channel 1145B defined by a pair of structurally robust and downwardly depending tenons or protrusions 1145A. The web 1120B of each DLB is slideably received in the channel. Each protrusion 1145A in turn is slideably received between the opposing flanges 1120A of the DLB. The DLBs 1120 are the fixed/stationary rigid component being coupled at bottom to the condensate header support beams 1102. The DLB floating caps 1145 move upwards/downwards with the upper tubesheet as the tube bundles 1143 thermally grow when heated by the steam entering the tubes through the upper tubesheet.

Figure 37:
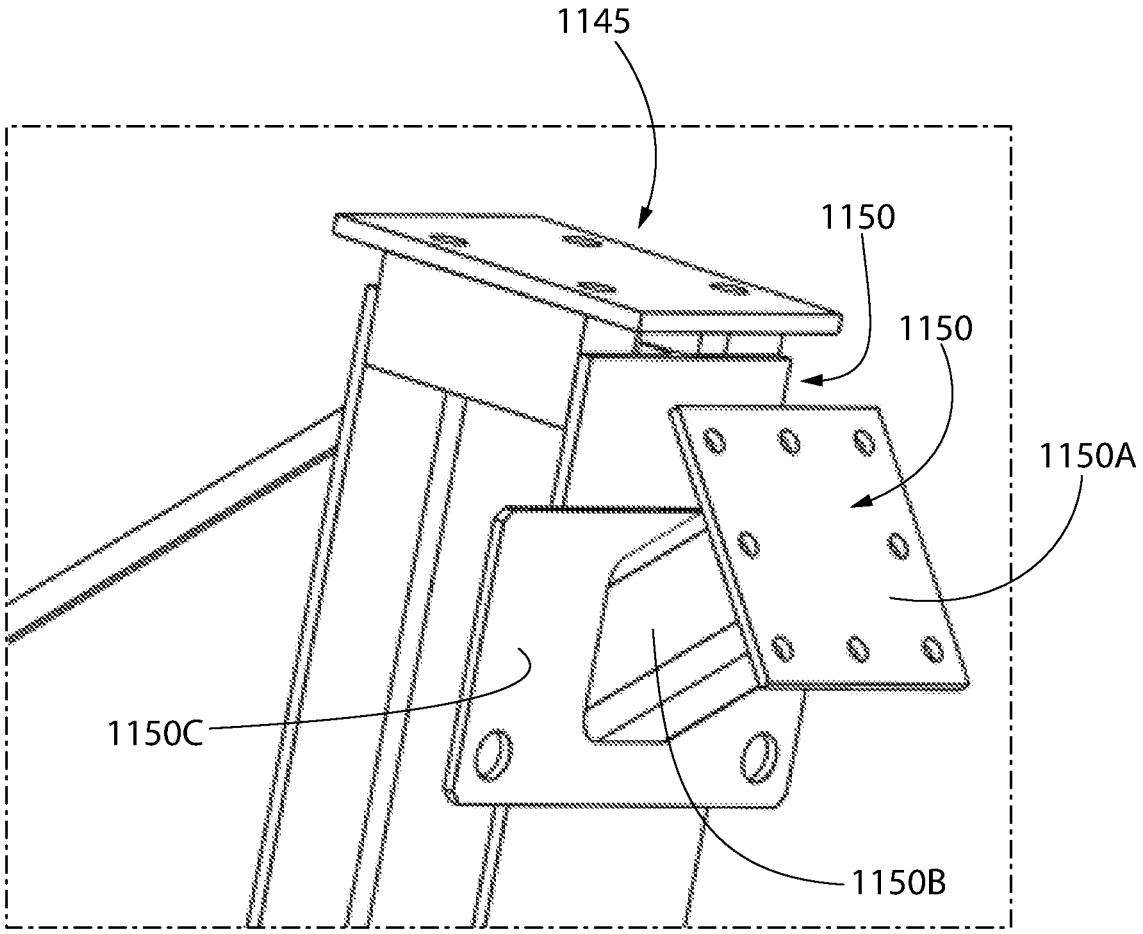
FIG. 37 is an alternate perspective view thereof without the tubesheet shown.
Figure 38:
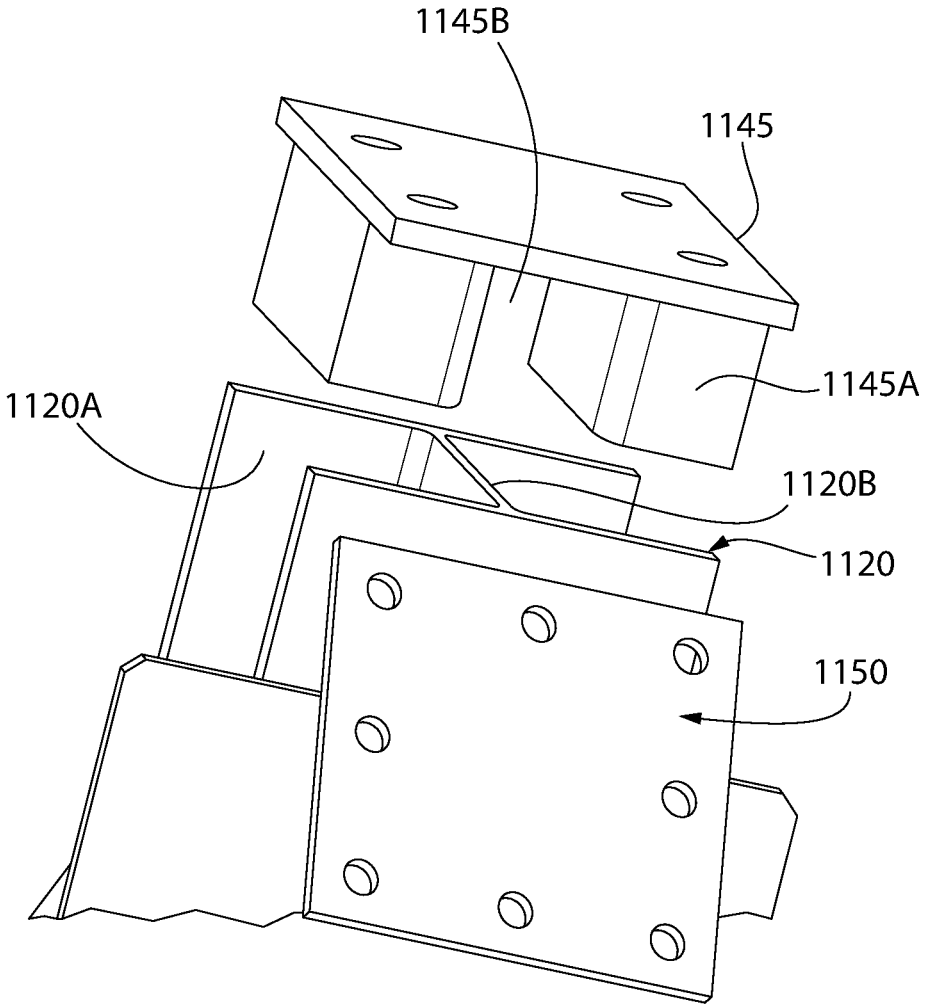
FIG. 38 is an exploded view thereof.
Figure 39:
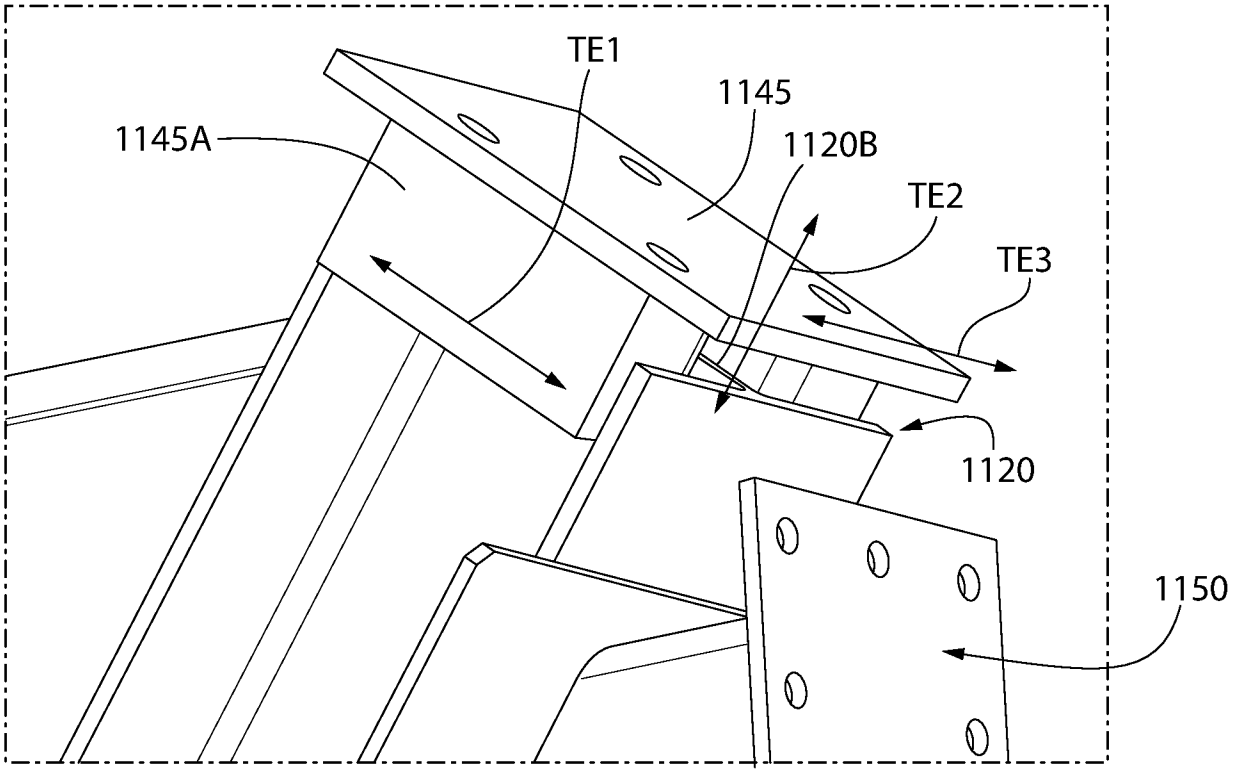
FIG. 39 is a perspective view thereof including directional arrows.

The DLB floating cap 1145 is loosely fitted on the end of the DLB in a non-fixed manner. As seen in FIG. 37, the protrusions 1145A tenons are spaced apart far enough to allow for in-plane thermal expansion of the tube bundles along the street direction (arrow TE2—note longitudinal width of channel 1145B is greater than width of web 1120B) and in-plane thermal expansion along the length of the tube bundle (arrow TE3), but restrict movement in the out-of-plane direction (arrow TE1) perpendicular to the street direction thermal expansion TE2. The terms "in" and "out of" plane refer to the plane defined by the angle tube bundles 1043. If the tube bundles attempt to bow out of plane due to thermal expansion when heated, floating caps 1145 will engage the DLBs and prevent out of plan bowing. The tube bundles are not shown in FIGS. 36-39 for purposes of clarity. The longitudinal width of channel 1145B (along the street direction TE2) can be adjusted to restrict a certain degree of movement along that direction.

Figure 25:
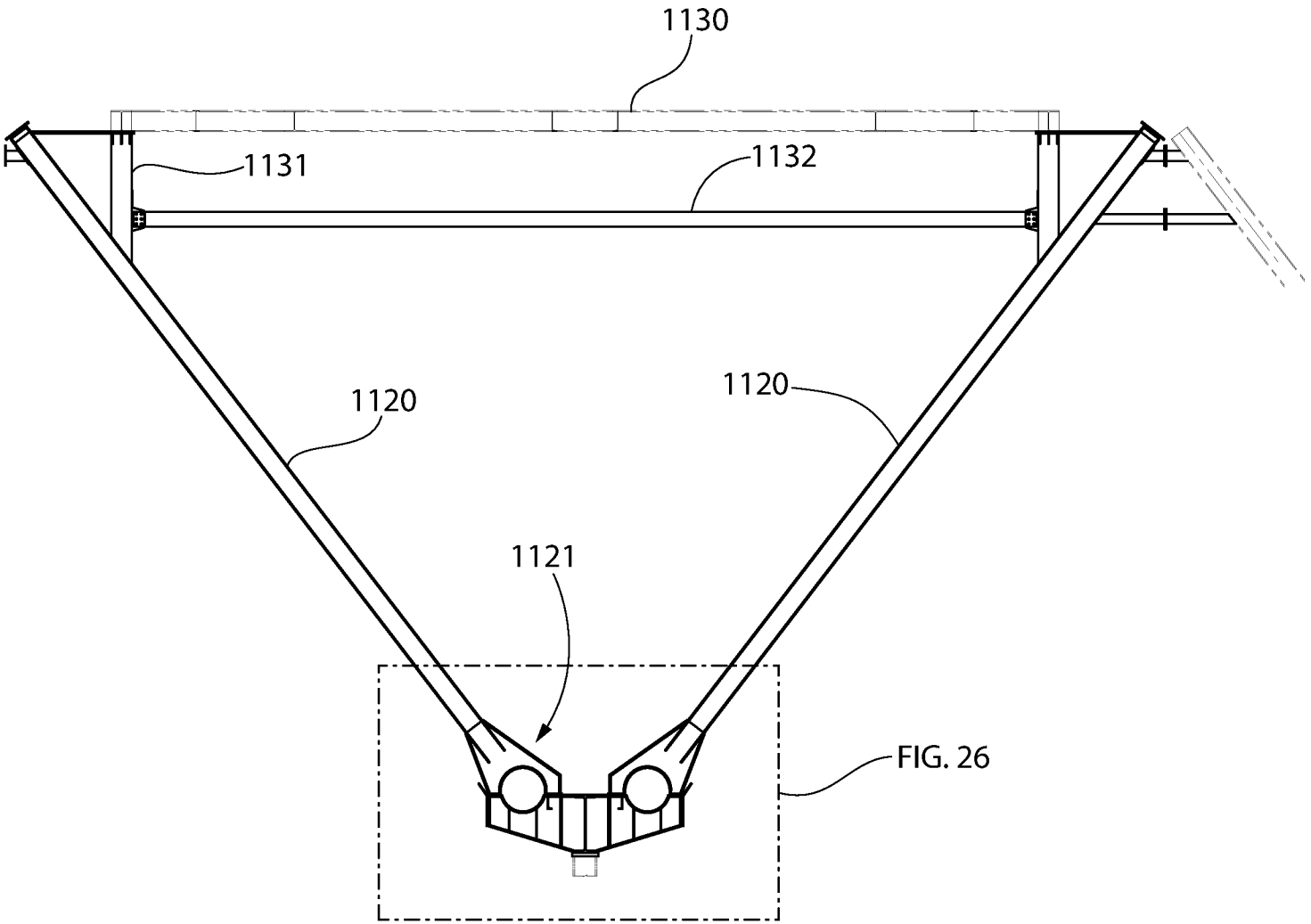
FIG. 25 is a side view of a deflection limiter beam assembly of the support frame of the ACC.
Figure 26:
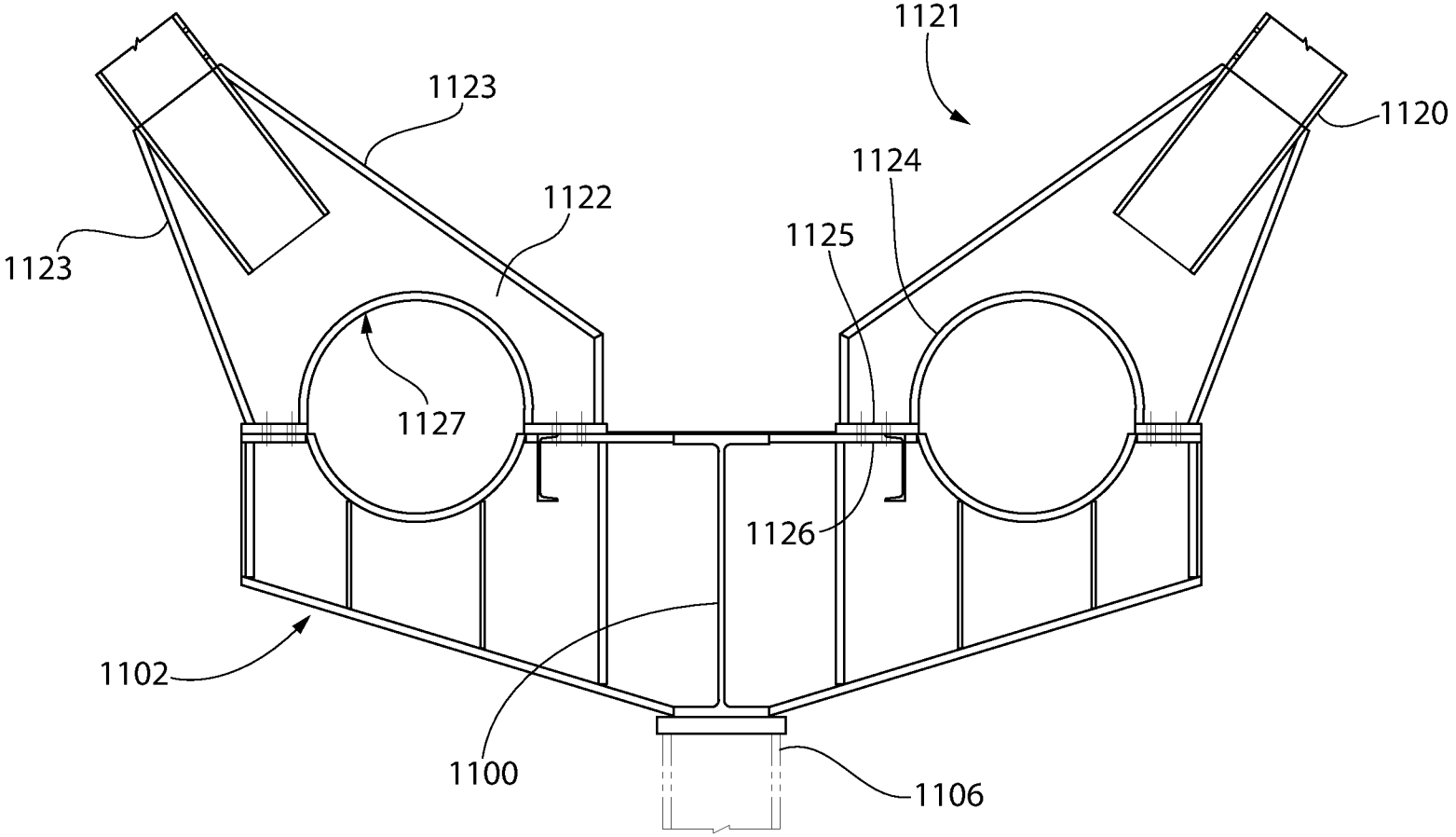
FIG. 26 is a front view of a condensate header support beam of FIG. 24.
Figure 27:
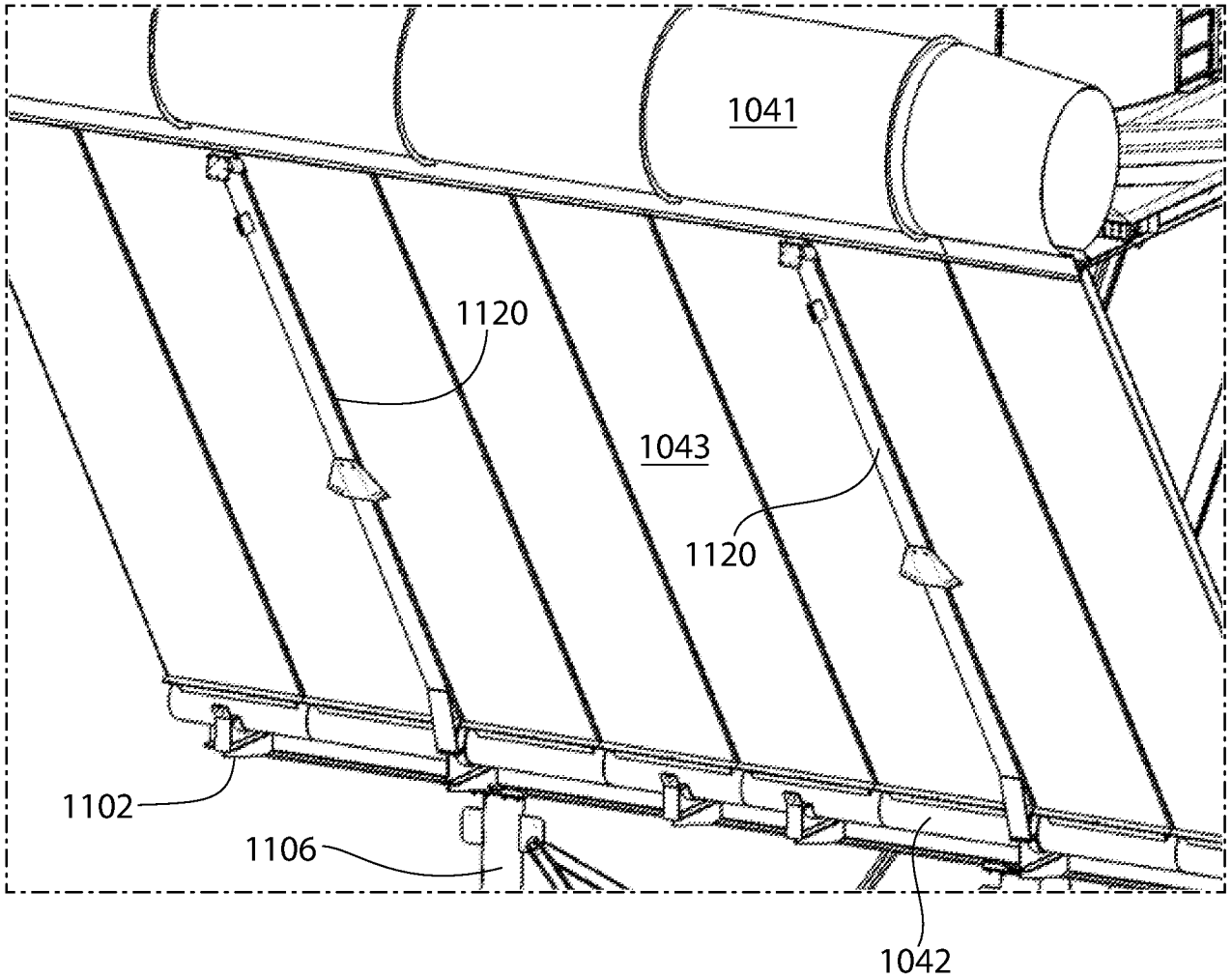
FIG. 27 is a side perspective view of a portion of the ACC showing the inclined tube bundles and deflection limiter beams.
Figure 28:
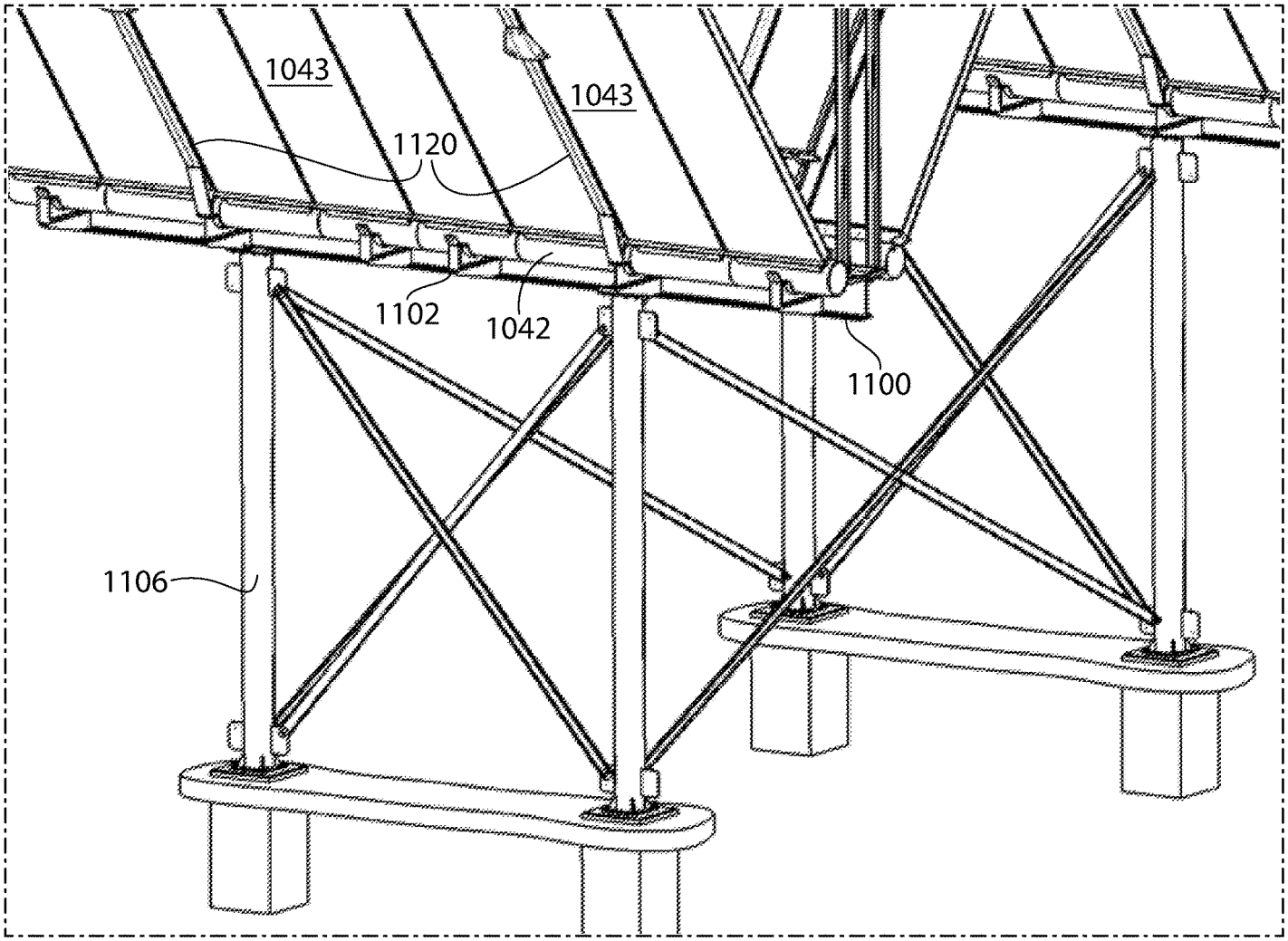
FIG. 28 is a perspective view thereof showing the support columns.
Figure 29:
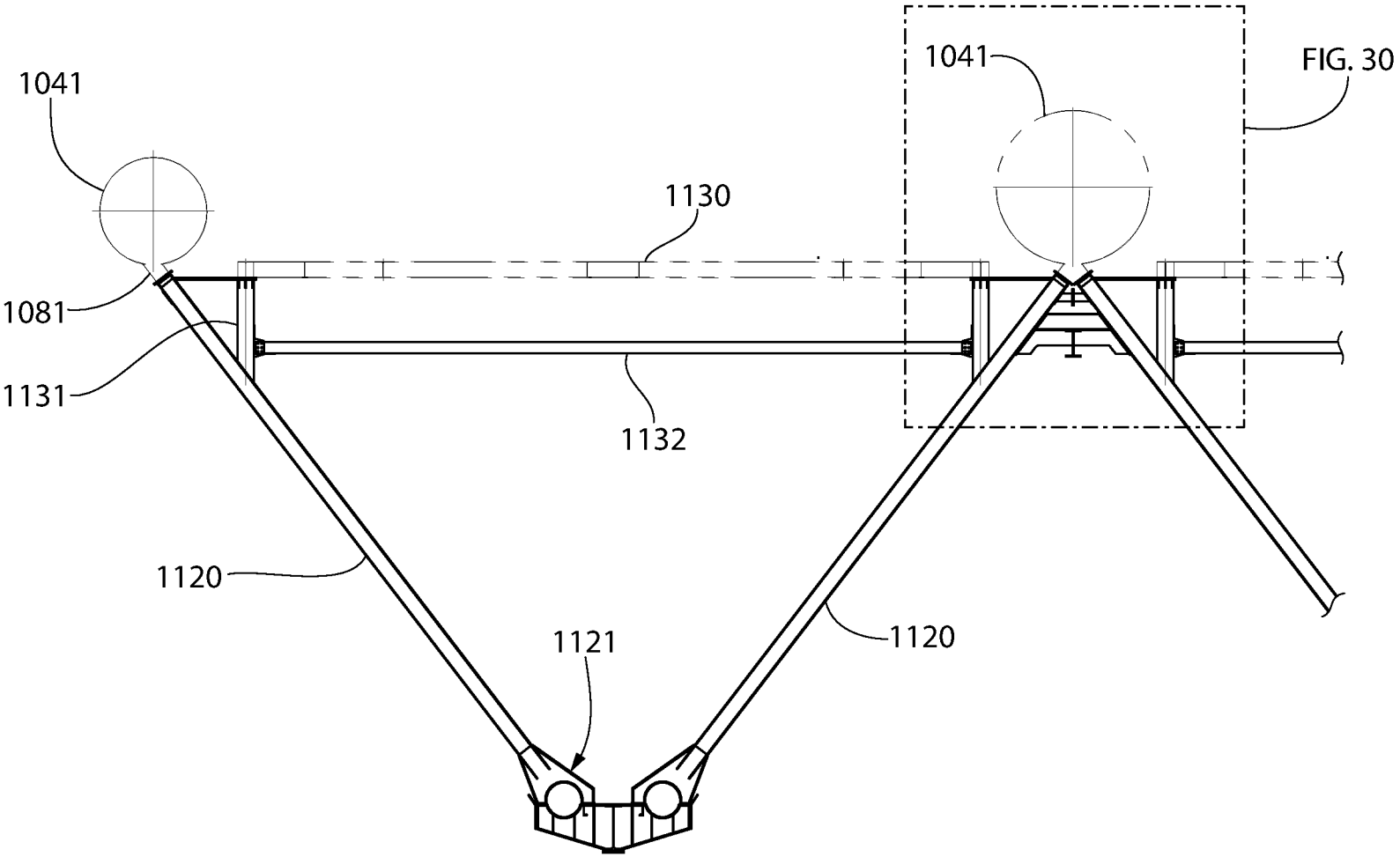
FIG. 29 is a side view of a deflection limiter beam assembly of the support frame of the ACC also showing the top steam headers.

Referring particularly to FIGS. 24-26, the bottom ends of each DLB 1120 comprise a physically robust and enlarged structural mounting end assembly 1121 configured for mounting directly to the condensate header support beams 1102. The mounting end assemblies 1121 may be considered to have a generally trapezoidal shape with a narrow upper portion and wider lower portion as best shown in FIG. 26. Each mounting end assembly may comprise a generally trapezoid shaped flat face plate 1122 surrounded on the top and lateral sides by a perpendicularly oriented peripheral flange plates 1123 which extend perimetrically around the face plate. The bottom of the face plate may include a perpendicularly oriented bottom mounting flange 1125 which mates with a corresponding top mounting flange 1126 on each condensate header support beam 1102 forming a flat-to-flat interface and abutting engagement. The mounting flanges 1125, 1126 may be preferably be bolted together to provide a detachable coupling. In other embodiments, however, the flanges may be welded together.

Each structural mounting end assembly 1121 further comprises a generally downward facing upper concave entrapment surface 1127 which is complementary configured to the lower support surfaces 1061 of saddle supports 1060 (best shown in FIG. 26). Accordingly, the entrapment surface 1127 of the mounting end assemblies are also configured to complement the diameter of the condensate headers 1042 such that the headers are trapped beneath and abuttingly engaged with the support surfaces 1127 when the mounting end assemblies are mounted to the condensate header support beams 1102. The structural mounting end assemblies 1121 of the DLBs 1120 therefore locking each condensate header 1042 to the ACC in a manner which resists and prevents movement in the vertical and lateral directions perpendicular to longitudinal axis LA. The condensate headers 1042 however are not longitudinally restrained by the mating concave support and entrapment surfaces 1061, 1127 and thus are free to slide and grow/contract in the longitudinal direction parallel to longitudinal axis LA. The concave entrapment surfaces 1127 of each structural coupling assembly 1121 may be formed of steel plate of suitable thickness and longitudinal width rolled to match the diameter of the condensate headers similarly to the saddle support surfaces 1061. Since the weight of the condensate headers 1042 rests on the lower support surface 1061 instead of the upper entrapment surface 1127, the plate for the entrapment surfaces 1127 may have a shorter longitudinal width than the lower support surfaces. In one non-limiting example, the saddle support plates may be about 1 inch thick and 3 inches in longitudinal width sufficient to entrap the condensate headers 1042. It bear noting that when the structural mounting end assemblies 1121 are mounted to the condensate header support beams 1102, the opposing concave support and entrapment surfaces 1061, 1127 form a complete circumferentially-extending continuous circle which encircles the condensate headers 1042.

It bears noting that each condensate header support beam 1102 is not coupled to a DLB 1120. The number of DLB s required on each side of the "V" of each ACC cooling cell 1040A will depend on the weight of the fan assembly/motor/gear box, steam headers 1041, and other structural components which might transfer load to the fan deck 1051. Accordingly, there may be a few number of DLBs provided for each cooling cell than condensate header support beams 1102 (see, e.g. FIGS. 27-28).

Referring generally to FIGS. 22-46, ACC 1040 also includes fan platform 1045-1 which supports the fan 1050. Fan 1050 may be similar to fan 50 and includes electric motor 53, and gear box 54 coupled to the hub of the fan from which the fan blades 56 project radially outwards (see, e.g. FIG. 3). The fan 1050 in this embodiment is mounted at the top of the cooling cell 1040A such that the motor and gear box (not shown in FIGS. 22-46) may be mounted below the fan blades 1056 instead of above. The DLB s 1120 create a support structure for the fan/motor/gear box assembly such that their weight is transferred to the main beam 1100, columns 1106, and to the foundation 1108 via the DLB s without passing loads through the tube bundles 1043; albeit the DLBs are arranged coplanar with and interspersed between selected tube bundles. The fan platform may be formed by a plurality of abutted flat fan deck plates 1051 similarly to fan platform 45-1 previously described herein. Fan 1050 is supported by a structural fan bridge 1133 of suitable construction to support the weight of the fan and related appurtenances such as the gear box and motor. The bridge and fan deck plate are mounted to and supported by a deck structure comprising plurality of horizontal support beams 1130 including some exterior support beams 1130A which extend perimetrically to form a rectilinear peripheral frame, and some interior support beams 1130B which extend through the interior between the peripheral frame (see, e.g. FIGS. 29-31). Exterior support beams 1130A are supported directly to the DLB s 1120 by vertical structural members 1131 which transfer the load directly to the DLBs. Horizontal bracing 1132 may be provided between laterally opposed pairs of vertical structural members. The foregoing deck structure ensures that no weight load is transmitted to the tube bundles 1043 or headers 1041, 1042. The fan platform 1045-1 is also supported in part by pairs of vertical posts mounted at their bottom ends to the lower walkway 1114 and condensate header support beams 1102 and at top to the horizontal exterior support beams 1130A.

Figure 35:
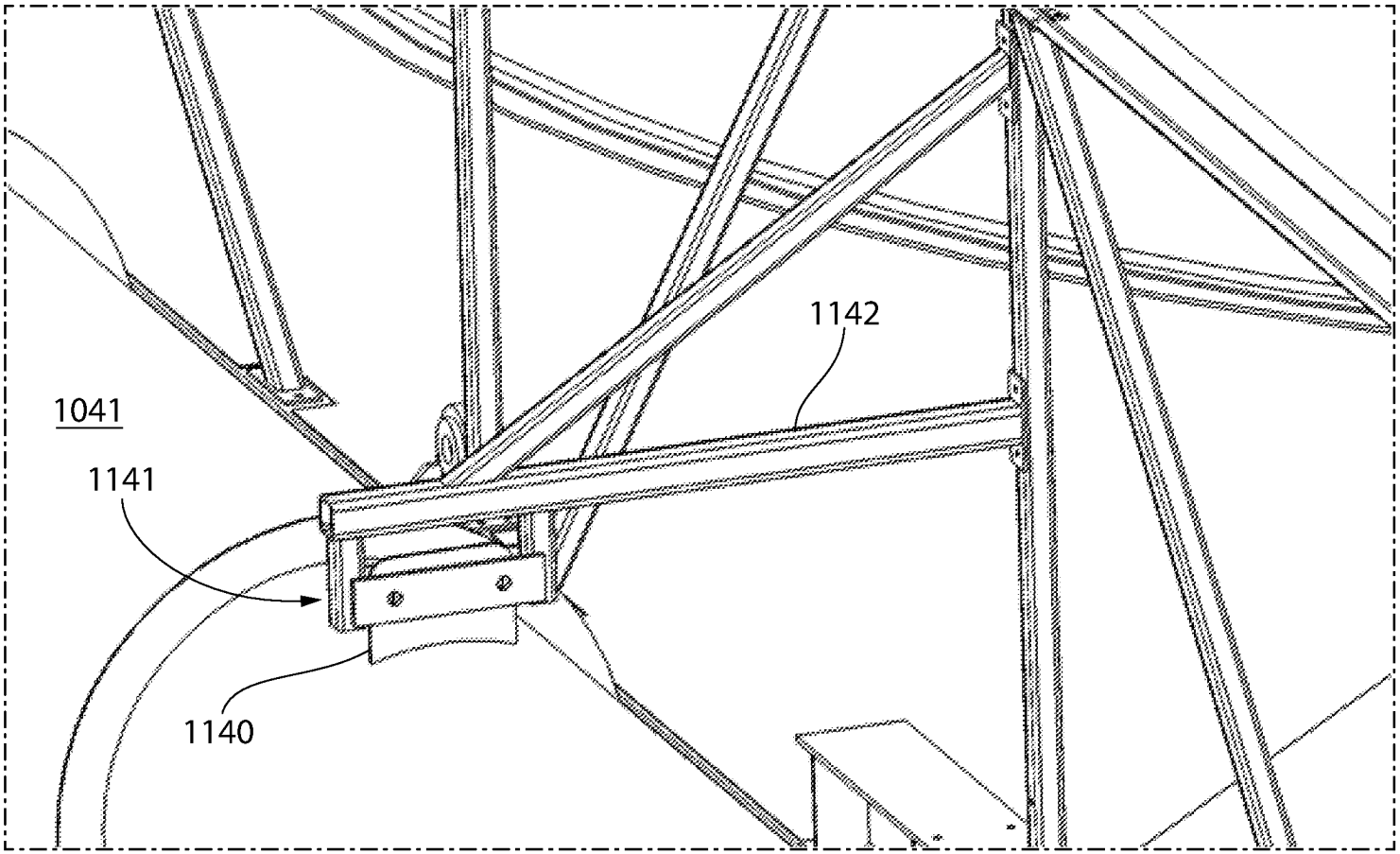
FIG. 35 is a perspective view of a guide tab system of the steam headers.
Figure 36:
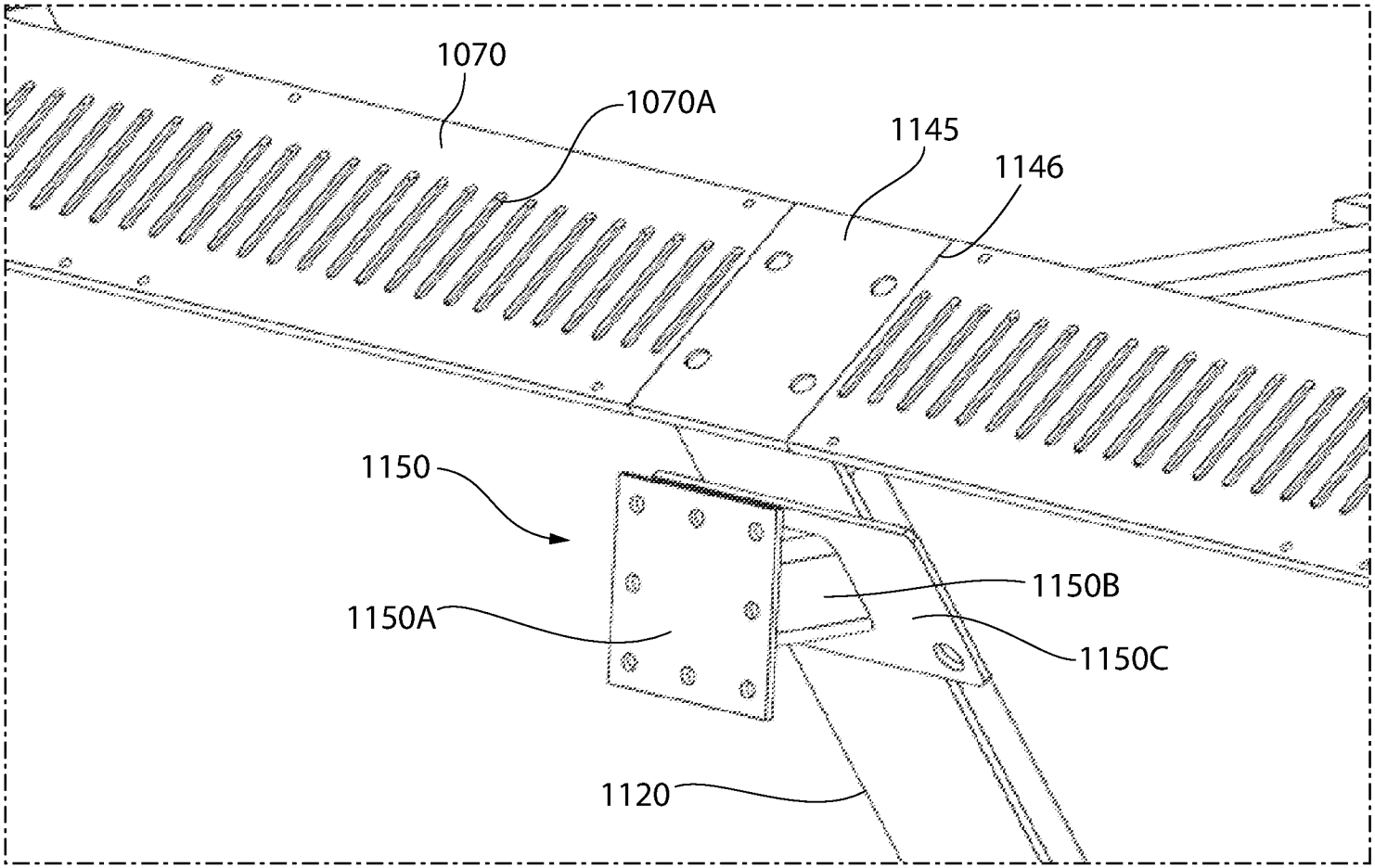
FIG. 36 is a perspective view of the upper end of a deflection limiter beam and associated floating end cap affixed to the upper tubesheet.

Referring to FIG. 35, in some embodiments the steam headers may include upward projecting restraint tabs 1140 which are slideably received in a guide structure 1141. The tabs limit the longitudinal growth of the steam headers 1041, but the guide structure is configured to allow diametrical growth and expansion of the headers as steam is introduced.

Figure 40:
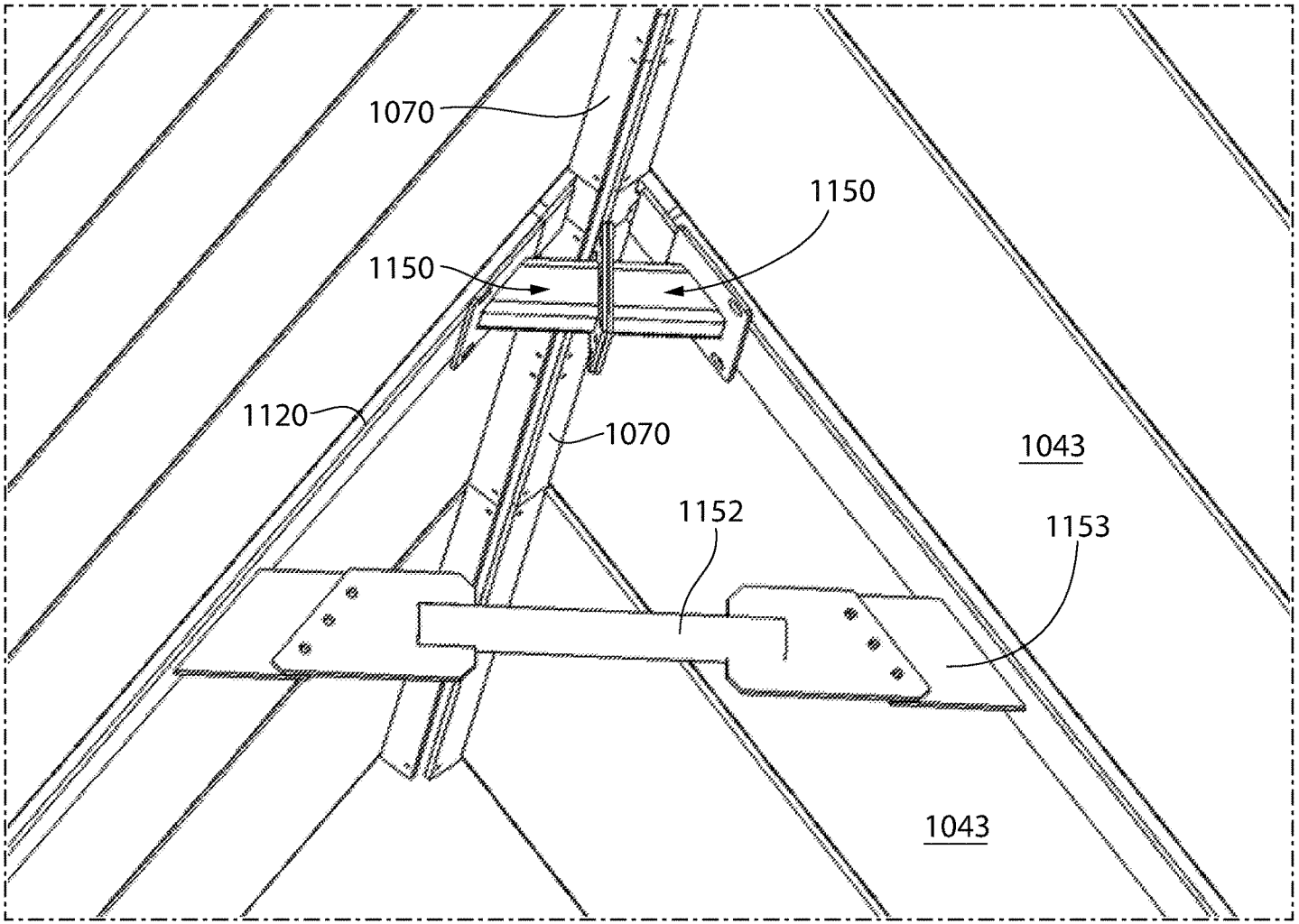
FIG. 40 is a perspective view of a cooling cell coupling or joining system.
Figure 41:
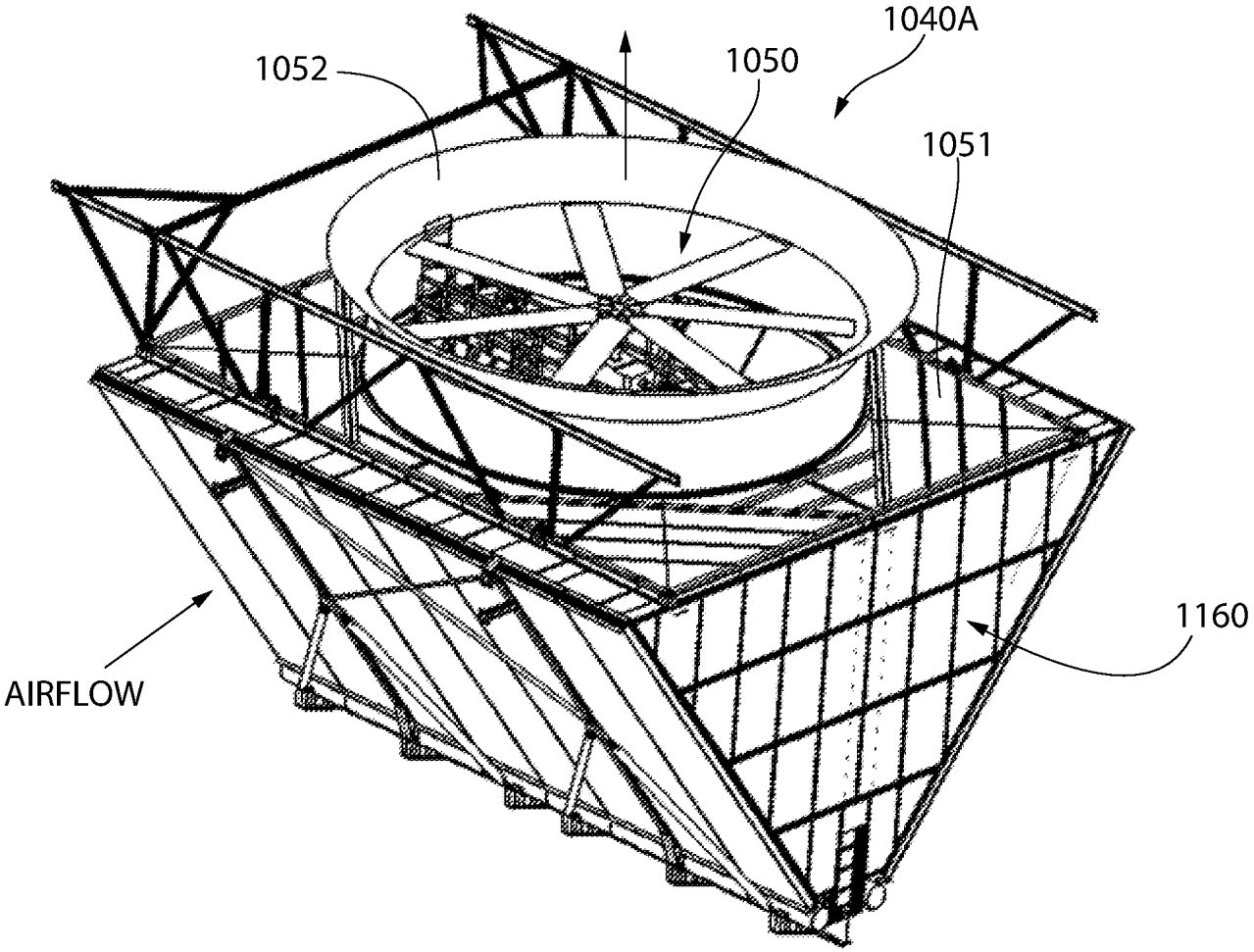
FIG. 41 is a perspective view of a single V-shaped cooling cell.
Figure 42:
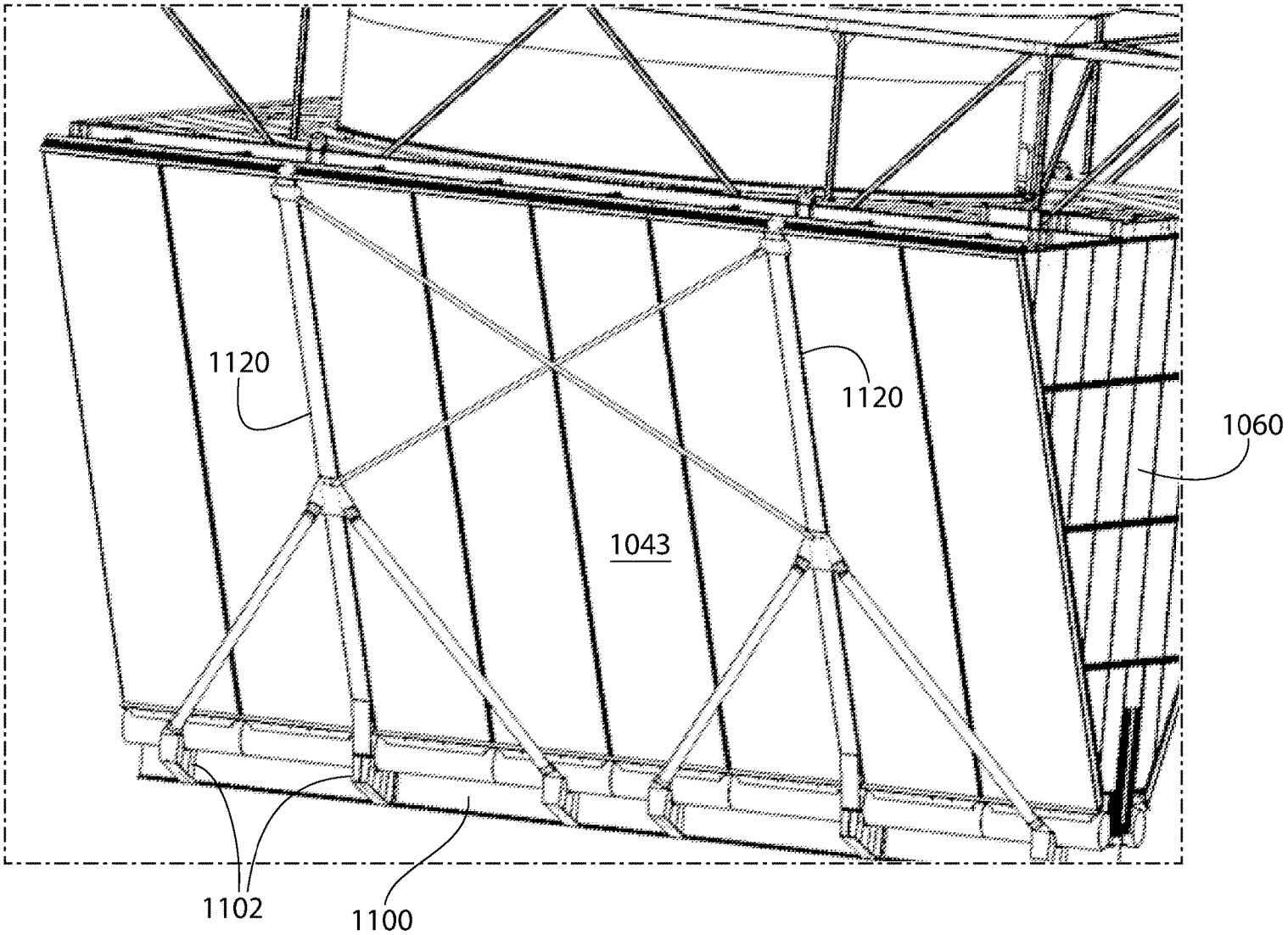
FIG. 42 is an enlarged detailed view thereof.
Figure 43:
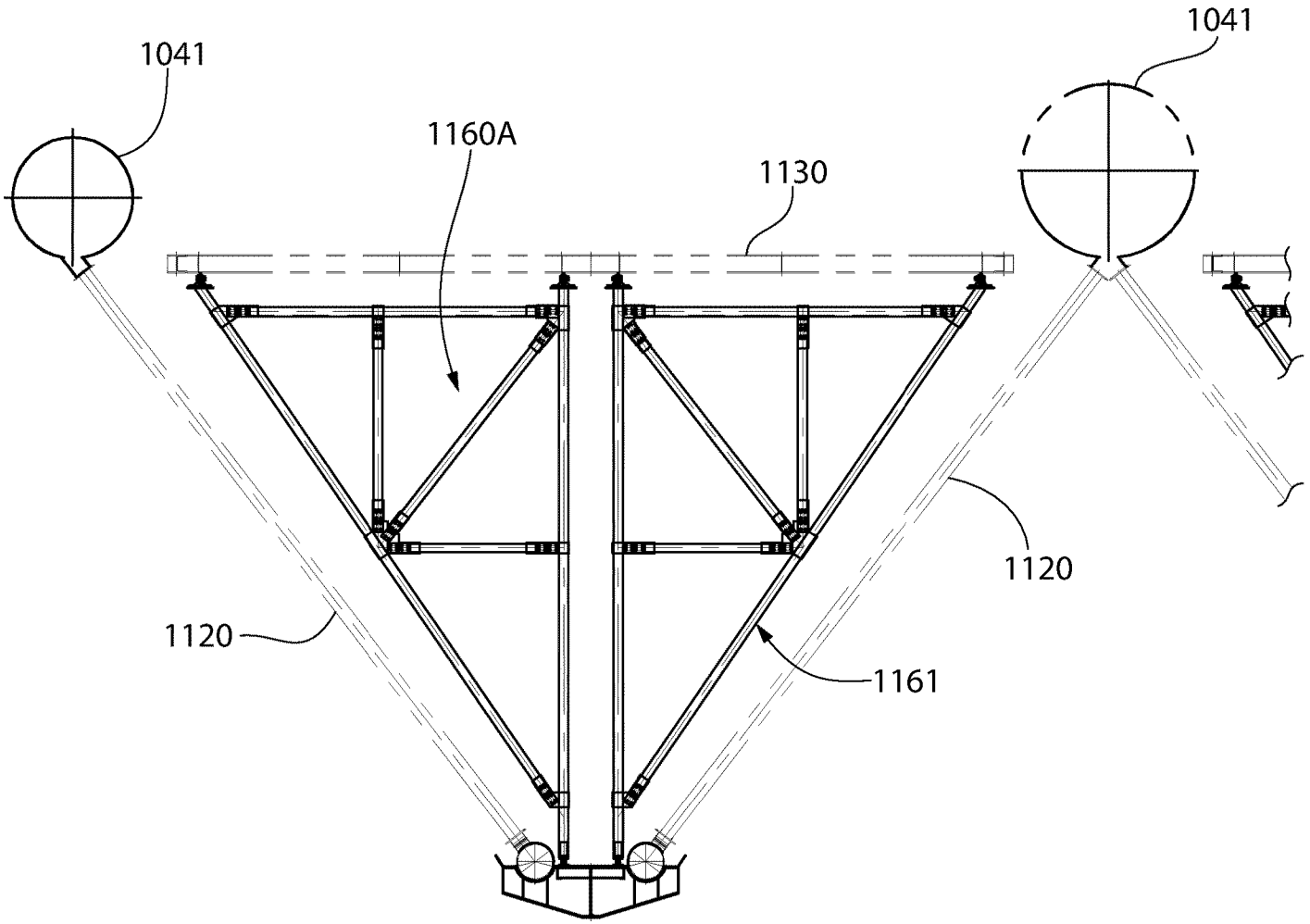
FIG. 43 is a side view of a cooling cell end wall support frame.
Figure 44:
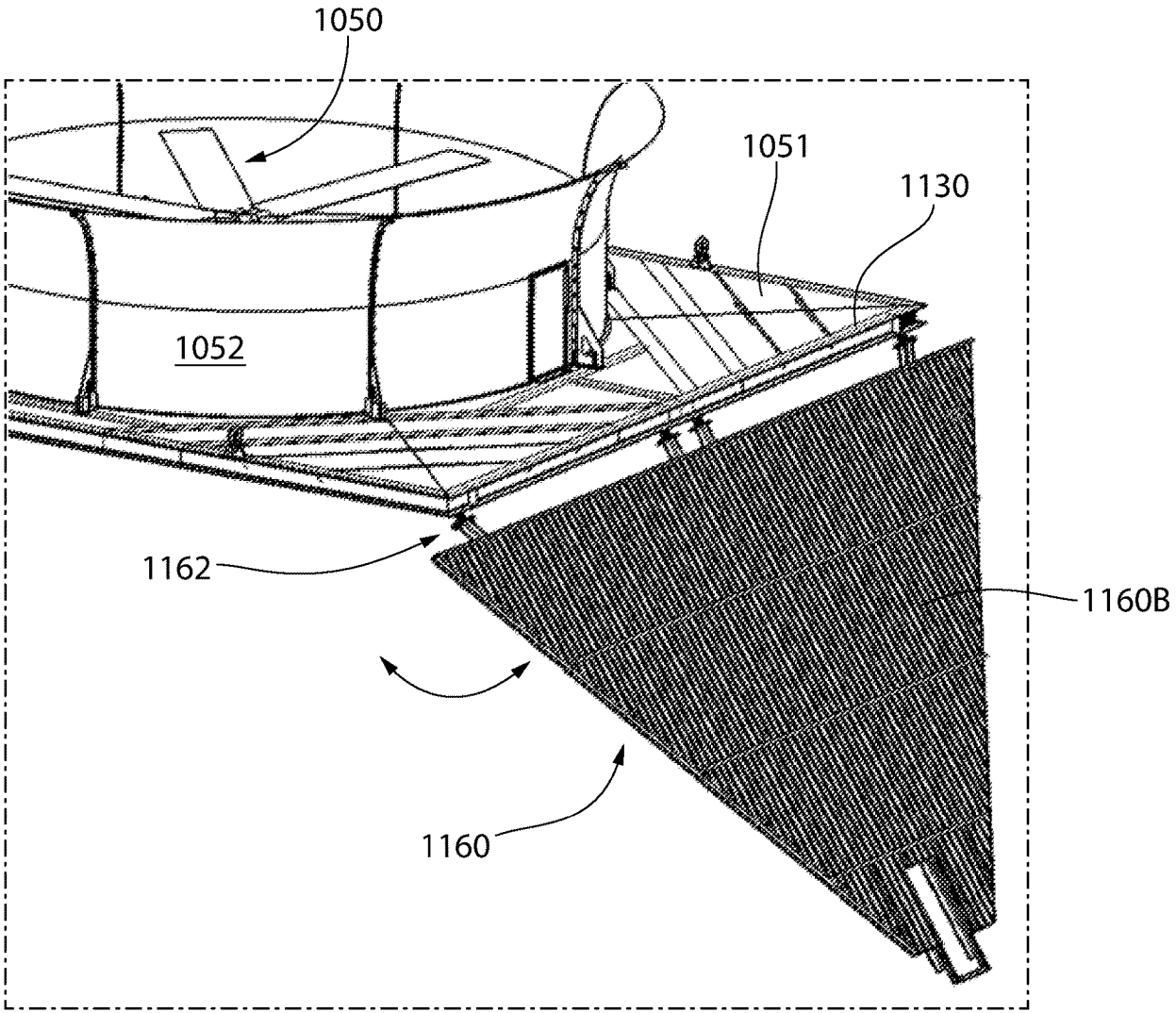
FIG. 44 is a perspective view of the end wall hinged mounting features showing the end wall in a partially mounted angled position.
Figure 45:
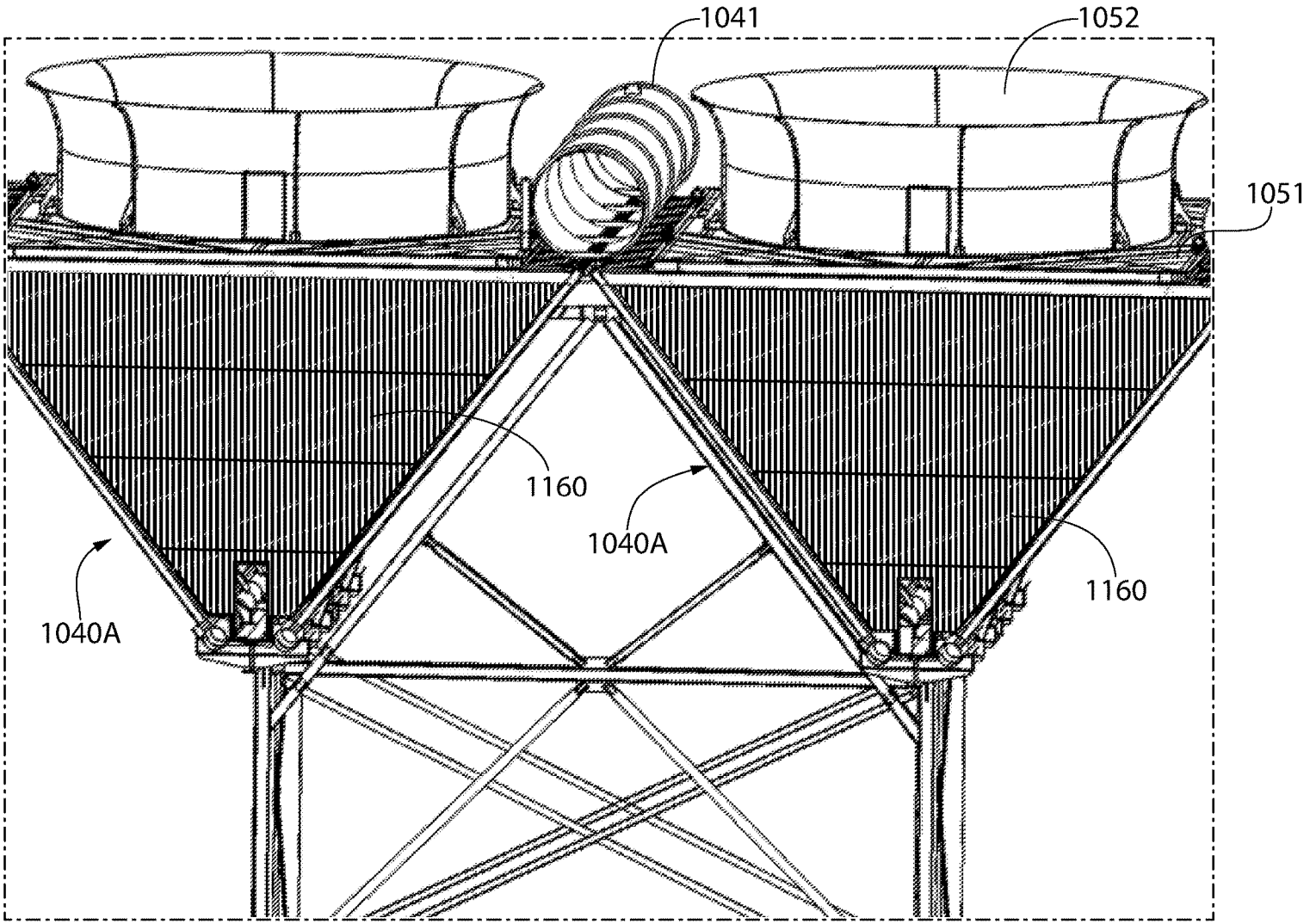
FIG. 45 is a perspective view of a pair of laterally adjacent cooling cell showing the end walls in a fully mounted vertical position.
Figure 46:
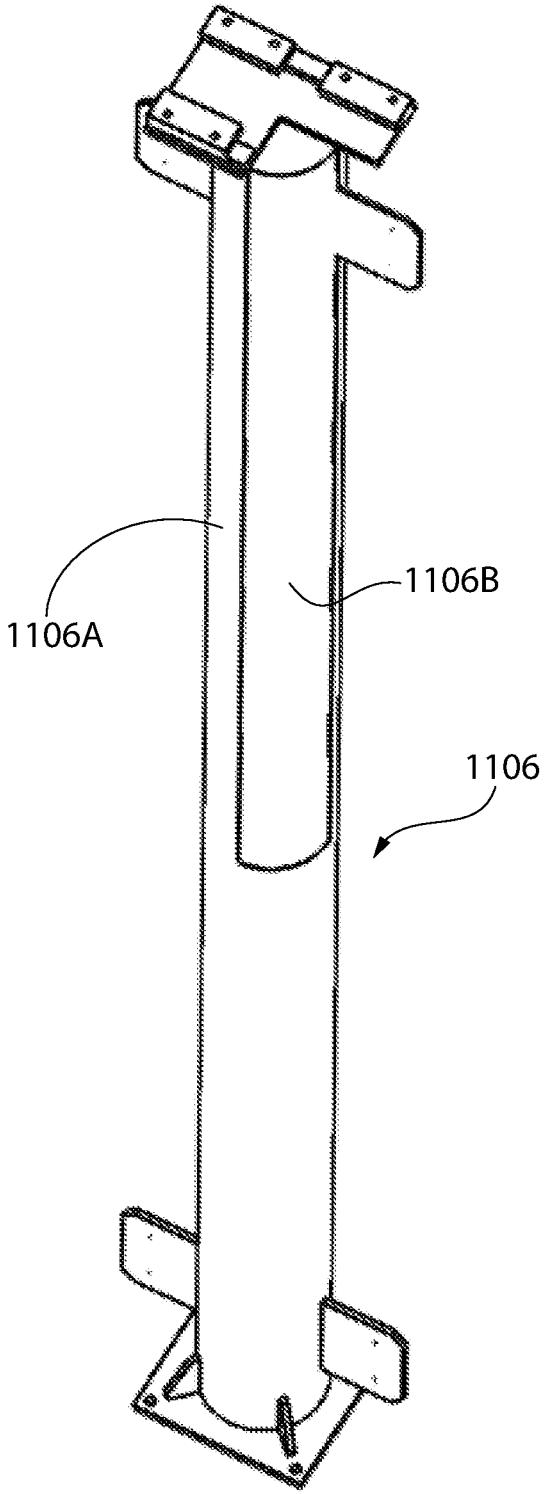
FIG. 46 is a perspective view of a hybrid support column including a steel outer pipe and inner concrete core for supporting the cooling cell.

Referring to FIG. 40, the inter cell assembly features are shown. Each cooling cell 1040A includes an upper cell coupling member 1150 and lower cell coupling lug 1153. The coupling member 1150 comprises a tube and perpendicularly oriented flat coupling plate with bolt holes at one free end of the tube (see also FIGS. 36-39). The other fixed end of the tube is attached to the DLB 1120 as shown. The lower cell coupling lugs 1153 of two adjacent cooling cells are coupled together via a tie bar 1152 with fasteners. When two laterally adjacent cooling cells 1040A are erected and coupled together at the installation site, shim plates (not shown) may be added between the adjoining upper cell coupling members 1150 of both cells to compensate for horizontal gaps between the coupling members. Horizontal gaps between lower cell coupling lugs 1153 may be accommodated by the tie bar 1152.

According to another aspect of the disclosure, the opposing end walls 1160 of each cooling cell 1040A may be erected via pivoting coupling mechanism. The end walls prevent ambient air from flowing directly through the ends of the cells to the fan, thereby forcing the ambient air to flow through the tube bundles 1043 instead to condense the steam. Referring to FIGS. 41-45, the end walls are formed of a structural frame 1160A of generally triangular configuration. Sheathing 1060B is applied to each frame to formed a solid end wall. A plurality of hinged joints 1162 are formed between the top peripheral edge of the end wall and the edge of the fan deck 1051. A related method of attaching each end wall 1160 to each longitudinal end of a cooling cell 1040A includes erecting a cooling cell at an installation site, lifting an end wall via a crane or other suitable equipment, aligning a first set of first hinge members (e.g. round barrels or knuckles defining through holes) on the top of the end wall with a corresponding second set of second hinge members on an upper portion of the cooling cell (e.g. fan deck), and inserting a pin through each set of first and second sets of hinge members defining a plurality of hinge joints. The method may also comprise pivoting the end wall from an open position to a closed position.

The headers, tubes and fins, flow plenums, fan platform and its support frame, saddle supports, monorail and its support system, and other fluid related or structural members described herein may preferably be made of an appropriate metallic material suitable for the service conditions encountered.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. An air-cooled condenser cell comprising:

a structural frame defining a longitudinal axis;

a pair of longitudinally-extending steam headers supported by the frame and configured for receiving steam from a source of steam;

a pair of longitudinally-extending condensate headers positioned below the steam headers and spaced laterally apart;

a pair of inclined tube bundles each comprising a plurality of tubes connected to an upper tubesheet and a lower tubesheet, the tube bundles disposed at an acute angle to each other;

each tube bundle extending between and fluidly coupled to one of the steam headers at top and a different one of the condensate headers at bottom forming a V-shaped tube structure;

a floating end cap rigidly affixed to the upper tubesheet, the floating end cap movable with the upper tubesheet within a plane of the tube bundles as the tubes thermally grow in length;

a fan mounted to the cell and arranged to flow ambient cooling air through the tube bundles; and a deflection limiter beam rigidly mounted to the frame;

wherein the deflection limiter beam is arranged between the tube bundles and coplanar therewith.

2. The air-cooled condenser cell according to claim 1, wherein the upper tubesheet, floating end cap, and tubes can thermally grow in a direction of the length of the tubes while the deflection limiter beam remains stationary.

3. The air-cooled condenser cell according to claim 1, wherein the deflection limiter beam is slideably received in a downwardly open channel of the floating end cap such that the floating end cap is movable independently of the deflection limiter beam.

4. The air-cooled condenser cell according to claim 1, wherein the floating end cap is configured to engage the deflection limiter beam when the tubes thermally grow to prevent the tube bundles from bowing out of plane.

5. The air-cooled condenser cell according to claim 4, wherein the channel is defined by a spaced apart pair of protrusions downwardly projecting from a flat plate affixed to the upper tubesheet.

6. The air-cooled condenser cell according to claim 5, wherein the deflection limiter beam is a wide flange I-beam comprising a pair of flanges and a web extending therebetween, and wherein the web is received between the protrusions of the floating end cap.

7. The air-cooled condenser cell according to claim 6, wherein the floating end cap is configured to allow limited movement of the upper tubesheet in an axial direction along the longitudinal axis when the upper tubesheet is heated.

8. The air-cooled condenser cell according to claim 1, wherein the frame comprises a longitudinally-extending main beam and a plurality of transversely arranged elongated condensate header support beams affixed to the main beam.

9. The air-cooled condenser cell according to claim 8, wherein the condensate header support beams each comprise a pair of arcuately curved saddle support surfaces, each saddle support surface engaging a bottom of one of the condensate headers on opposite sides of the main beam.

10. The air-cooled condenser cell according to claim 8, wherein the bottom end of the deflection limiter beam comprises an enlarged structural mounting end assembly coupled to one of the condensate header support beams.

11. The air-cooled condenser cell according to claim 10, wherein one of the condensate headers is trapped between the mounting end assembly and the one of the condensate header support beams.

12. The air-cooled condenser cell according to claim 11, wherein the one of the condensate headers is trapped between an upwardly concave support surface of the one of the condensate header support beams and a downwardly concave entrapment surface of the mounting end assembly of the deflection limiter beam.

13. The air-cooled condenser cell according to claim 1, further comprising at least one triangular shaped end wall pivotably coupled to the frame via a plurality of hinge joints.

14. The air-cooled condenser cell according to claim 13, wherein the cell is an induced draft arrangement condenser having a V-shape in which the fan draws air through the tube bundles.

15. An air-cooled condenser cell comprising:

a structural frame defining a longitudinal axis;

a pair of longitudinally-extending steam headers supported by the frame and configured for receiving steam from a source of steam;

a pair of longitudinally-extending condensate headers positioned below the steam headers and spaced laterally apart;

a pair of inclined tube bundles each comprising a plurality of tubes connected to an upper tubesheet and a lower tubesheet, the tube bundles disposed at an acute angle to each other;

each tube bundle extending between and fluidly coupled to one of the steam headers at top and a different one of the condensate headers at bottom forming a V-shaped tube structure;

a fan mounted to the cell and arranged to flow ambient cooling air through the tube bundles; and a deflection limiter beam rigidly mounted to the frame;

wherein the deflection limiter beam is arranged between the tube bundles and coplanar therewith;

wherein a bottom end of the deflection limiter beam comprises an arcuately curved entrapment surface engaging a top of one of the condensate headers to lock the condensate header to one of the condensate header support beams.

16. The air-cooled condenser cell according to claim 15, wherein the entrapment surface is defined by an enlarged structural mounting end assembly bolted one of the condensate header support beams.

17. The air-cooled condenser cell according to claim 16, wherein the mounting end assembly has a generally trapezoidal shape.

18. An air-cooled condenser comprising:

an array of cooling cells, each cooling cell comprising:

a structural frame defining a longitudinal axis and comprising a main beam, a plurality of transversely elongated condensate header support beams affixed to the main beam, and plurality of deflection limiter beams affixed to the condensate header support beams which collectively form a V-shaped structure;

a pair of longitudinally-extending steam headers mounted to a top of the frame which receive steam from a source of steam;

a pair of longitudinally-extending condensate headers mounted to condensate header support beams, one condensate header being arranged on each side of the main beam;

a pair of inclined tube bundles each comprising a plurality of tubes connected to an upper tubesheet and a lower tubesheet, the tube bundles disposed at an acute angle to each other;

each tube bundle arranged coplanar with the deflection limiter beams and fluidly coupled to one of the steam headers at top and one of the condensate headers at bottom;

a fan mounted at a top of the frame and operable to draw ambient cooling air through the tube bundles; and a floating end cap associated with each deflection limiter beam and rigidly affixed to the upper tubesheet, each deflection limiter beam having a top end slideably inserted in an open channel of the end cap;

wherein the end caps are configured to prevent out of plane bowing of the tube bundles via engaging the deflection limiter beams when the tubes thermally expand.

19. The air-cooled condenser according to claim 18, wherein each condensate headers is trapped between an upwardly concave support surface defined by each condensate header support beam and a downwardly concave entrapment surface defined by a bottom mounting end of the deflection limiter beams.

20. The air-cooled condenser according to claim 18, wherein the main beam is supported by a plurality of vertical support columns which elevation the air-cooled condenser above ground level.

21. The air-cooled condenser according to claim 18, wherein the fan is supported by a fan deck supported in turn directly from the deflection limiter beams.

* * * * *